US006859184B2

(12) United States Patent
Ohtani et al.

(10) Patent No.: US 6,859,184 B2
(45) Date of Patent: Feb. 22, 2005

(54) POLARIZED WAVE SEPARATING STRUCTURE, RADIO WAVE RECEIVING CONVERTER AND ANTENNA APPARATUS

(75) Inventors: Tetsuyuki Ohtani, Ikoma (JP); Atsushi Nagano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/146,413

(22) Filed: May 16, 2002

(65) Prior Publication Data

US 2002/0171503 A1 Nov. 21, 2002

(30) Foreign Application Priority Data

May 17, 2001 (JP) ..... 2001-147167
Nov. 15, 2001 (JP) ..... 2001-350117

(51) Int. Cl.[7] ..... H01Q 19/00
(52) U.S. Cl. ..... 343/756; 343/775; 333/20
(58) Field of Search ..... 343/756, 775, 343/772, 786, 909; 333/20

(56) References Cited

U.S. PATENT DOCUMENTS 4,707,702 A * 11/1987 Withers ..... 343/786
4,792,770 A * 12/1988 Parekh et al. ..... 333/113
4,829,313 A * 5/1989 Taggart ..... 343/756
5,061,037 A 10/1991 Wong et al. ..... 385/11
6,118,412 A * 9/2000 Chen ..... 343/756
6,445,260 B1 * 9/2002 Miyazaki et al. ..... 333/21 A
6,452,559 B1 * 9/2002 Yuanzhu ..... 343/756
6,522,215 B2 * 2/2003 Enokuma ..... 405/100

FOREIGN PATENT DOCUMENTS

EP 0 993 064 4/2000
JP 4-271601 9/1992

OTHER PUBLICATIONS

Miyazaki et al., U.S. Appl. No. 09/715,258, filed Nov. 20, 2000.

* cited by examiner

*Primary Examiner*—Shih-Chao Chen
(74) *Attorney, Agent, or Firm*—Nixon & Vanderhye P.C.

(57) ABSTRACT

The septum is extended through the opening to the radio wave receiving portion to separate respective polarized waves received by a pair of radio wave receiving portions, and a space between the septum and the radio wave receiving portion is set such that an end surface of the waveguide on the side of the substrate is surely in contact with a grounding surface provided on one surface of the substrate, and an end surface of the radio wave reflecting portion on the side of the substrate is surely in contact with the grounding surface provided on the other surface of the substrate.

37 Claims, 33 Drawing Sheets

FIG.11

COMPARISON OF POLARIZED WAVE SEPARATING CHARACTERISTIC WITH SECOND PRIOR ART EXAMPLE

| DISTANCE BETWEEN END SURFACE OF SEPTUM AND SLOT BOTTOM SURFACE L[mm] | POLARIZED WAVE SEPARATING CHARACTERISTIC [dBm] |
|---|---|
| 1.208 | 22.25 |
| 0.914 | 23.76 |
| 0.681 | 25.27 |
| 0.457 | 26.37 |
| 0.217 | 27.56 |
| 0.111 | 28.72 |
| 0.000 | 30.68 |

POLARIZED WAVE SEPARATING STRUCTURE IN ACCORDANCE WITH THE SECOND PRIOR ART EXAMPLE →25.82[dBm]

LOWER LIMIT OF PRACTICALLY TOLERABLE RANGE = 23.0 [dBm]

POLARIZED WAVE SEPARATING STRUCTURE, RADIO WAVE RECEIVING CONVERTER AND ANTENNA APPARATUS

BACKGROUND OF THE INVENTION

1. Field of the Invention

The present invention relates to a polarized wave separating structure, a radio wave receiving converter (LNB, Low Noise Blockdown Converter) receiving radio wave from a broadcasting satellite, a communication satellite or the like, and to an antenna apparatus.

2. Description of the Background Art

Microwaves used in satellite broadcasting generally include two components. As a representative, for example, circularly polarized waves include dextrorotatory polarized wave (hereinafter referred to as d-polarized wave) and a levorotatory polarized wave (hereinafter referred to as d-polarized wave).

Therefore, a receiving converter receiving radio waves from satellite broadcasting employs a polarized wave separating structure for separating these two components. Particularly when one of the two components (for example, d-polarized wave only) is to be received, higher degree of separation (degree of cross polarization discrimination) is attained by separating the components by the polarized wave separating structure and absorbing the other component (cross polarization component).

A first prior art example of the polarized wave separating structure of the receiving converter will be described with reference to FIG. 43, which is an exploded perspective view of the main part schematically representing the structure, and FIG. 44, which is a cross sectional view taken along the line XXXXIV—XXXXIV of FIG. 43.

On one side of a substrate 103 having a pair of radio wave receiving probes 104a and 104b, a waveguide 101 is arranged. In waveguide 101, there is formed a stepped waveguide septum 101a parting the inside of waveguide 101 into two. On the other side of substrate 103, a radio wave reflecting portion 102 is arranged. In the radio wave reflecting portion 102, there is formed a radio wave reflecting portion septum 102f parting the inside of radio wave reflecting portion 102 into two. On an end surface of radio wave reflecting portion 102 positioned opposite to substrate 103, a radio wave reflecting surface 102a is formed.

On that side of substrate 103 on which radio wave reflecting portion 102 is positioned, a grounding surface (pattern) 105 is provided, along and in contact with end surfaces of radio wave reflecting portion 102 and radio wave reflecting portion septum 102f. On that surface of substrate 103 on which wave guide 101 is positioned, a grounding surface (pattern, not shown) is formed along and in contact with end surfaces of wave guide 101 and wave guide septum 101a.

Grounding surface 105 in contact with radio wave reflecting portion 102 and the grounding surface in contact with waveguide 101 are electrically connected by means of through holes 106. Thus, waveguide 101 and radio wave reflecting portion 102 are kept, by means of the substrate 103, at the ground potential.

The pair of radio wave receiving probes 104a and 104b are formed on that side of substrate 103 on which radio wave reflecting portion 102 is formed. Wiring portions of radio wave receiving probes 104a and 10b are electrically insulated from grounding surface 105, radio wave reflecting portion 102 and waveguide 101.

By waveguide septum 101a and radio wave reflecting portion septum 102f, the inside of waveguide 101 and the inside of radio wave reflecting portion 102 are parted into two waveguide spaces. The circularly polarized wave entering waveguide 101 is separated by the stepped waveguide septum 101a to linearly polarized wave components, and guided to respective waveguide spaces.

In the first prior art example, in order to prevent leakage of radio wave inside waveguide 101 or radio wave reflecting portion 102 to the outside, or to reduce noise, end surfaces of septums 101a and 102f and of waveguide 101 and radio wave reflecting portion 102 are brought into contact with the grounding surfaces of substrate 103.

Now, waveguide 101 including septum 101a and radio wave reflecting portion 102 including septum 102f are formed by casting technique using, for example, aluminum die cast. Considering dimensional accuracy at the time of actual mass production, it is difficult to bring the end surfaces of septums 101a and 102f and of waveguide 101 and radio wave reflecting portion 102 surely into contact with the grounding surfaces of substrate 103.

More specifically, in the first prior art example, when the end surface of radio wave reflecting portion septum 102a is to be surely brought into contact with grounding surface 105 of substrate 103, it follows that the end surface of waveguide 101 cannot surely be brought into contact with the grounding surface, resulting in a gap at the contact portion. Consequently, it is possible that the radio wave leaks outside, or the noise increases.

In view of the foregoing, a second example has been proposed. The second prior art example will be described with reference to FIG. 45, which is an exploded perspective view of the main portion schematically representing the structure, and FIG. 46, which is a cross sectional view taken along the line XXXXVI—XXXXVI of FIG. 45.

In the second prior art example, an opening 103a is provided in substrate 103, and waveguide septum 101a is extended to pass through the opening 103a of substrate 103. Radio wave reflecting portion septum 102f of the first prior art example is not formed at radio wave reflecting portion 102, and, alternatively, a hole 102i receiving the end surface of the extended waveguide septum 101a is formed.

Further, in the second prior art example, the hole 102i of radio wave reflecting portion 102 is communicated with the outside. Therefore, in order to prevent in-coming/out-going of radio wave from/to the outside, the gap between waveguide septum 101a and hole 102i is sealed by a conductive member 107 formed, for example, of a sheet metal having elasticity.

According to the second prior art example, even when there is a variation in dimensional accuracy at the time of mass production, conductive member 107 deforms, and therefore, it becomes easier to attain sure contact between the entire end surfaces of waveguide 101 and radio wave reflecting portion 102 with the grounding surfaces of substrate 103.

FIG. 47A is a perspective view showing the appearance of conductive member 107 shown in FIG. 46, FIG. 47B is a cross section taken along the line XXXXVIIB—XXXXVIIB of FIG. 47A, and FIG. 47C is a cross section showing a state in which conductive member 107 and septum 101a are attached to hole 102i.

Conductive member 107 will be described with reference to FIGS. 47A, 47B and 47C. Conductive member 107 has an engaging portion 107a that abuts radio wave reflecting surface 102a, and an inward cutout portion 107b having a tip end abutting septum 101a. The width A of FIG. 47A is set to be slightly larger than the width B of hole 102i of radio wave reflecting portion 102 shown in FIG. 47C. Such a structure is to prevent slipping off during assembly, and to attain sure electrical conduction between septum 101a and radio wave reflecting portion 102.

The second prior art example described above, however, has the following problem.

In the second prior art example, a separate conductive member 107 is used. Therefore, cost of the raw material increases, and considering the manufacturing steps, the step of attaching conductive member 107 increases. Thus, the cost is significantly increased.

Further, in the manufacturing step at mass production, it may be possible that attachment of conductive member 107 is unsatisfactory. In such a case, radio wave may be leaked outside through hole 102i or the noise may be increased, and therefore increase of the ratio of defective products and degradation of products are expected. Further, there may be a gap around the cutout portion 107b of conductive member 107, as shown in FIGS. 47A to 47C, and the gap between waveguide septum 101a and hole 102i cannot be sealed by the two side surfaces at which cutout portion 107b is not formed. In other words, it is difficult to actually seal the gap by the structure that employs a separate member to fill the gap between septum 101a and hole 102i, possibly resulting in degradation of product characteristics.

SUMMARY OF THE INVENTION

Therefore, an object of the present invention is to provide a polarization wave separating structure, a radio wave receiving converter and an antenna apparatus that can be manufactured at a low cost, suitable for mass production and have high performance.

Briefly stated, the present invention provides a polarized wave separating structure, including: a substrate portion having an opening and provided with a pair of radio wave receiving portions; a waveguide arranged on one side of the substrate portion and having a septum provided therein; and a radio wave reflecting portion arranged on the other side of the substrate portion and having a radio wave reflecting surface provided on an inner side; wherein the septum portion is extended through the opening to the radio wave reflecting portion so as to separate respective polarized waves received by the pair of radio wave receiving portions; and a space between the septum portion and the radio wave reflecting portion is set such that an end surface of the wave guide on the substrate side is surely in contact with a grounding surface provided on one surface of the substrate portion and an end surface of the radio wave reflecting portion on the side of the substrate portion is surely in contact with a grounding surface provided on the other surface of the substrate portion.

Therefore, according to the present invention, a polarized wave separating structure can be provided that can attain fully satisfactory polarized wave separating characteristic without leakage of the radio wave to the outside or increase of noise, that have simple structure enabling improvement of satisfactory product ratio of mass production and that can be manufactured at a low cost and is suitable for mass production.

More preferably, when the space between the septum portion and the radio wave reflecting portion is made very small with respect to the wavelength of the radio wave, the radio wave hardly leaks through the space from one to the other of the waveguide spaces parted by the septum portion. Namely, even with such a space, fully satisfactory polarized wave separating characteristic can be attained. Therefore, even when there is a variation at the time of mass production, the end surface of the waveguide on the side of the substrate is surely brought into contact with the grounding surface formed on one surface of the substrate portion and the end surface of the radio wave reflecting portion on the side of the substrate portion is surely brought into contact with the grounding surface formed on the other surface of the substrate portion, and hence, unlike the first prior art example described above, leakage of radio wave to the outside or increase of noise can be prevented.

Further, the structure is not the type of the second prior art example in which the gap between the septum portion of the waveguide and the hole of the radio wave reflecting portion is filled by a separate member. Therefore, the cost including the cost of raw materials and manufacturing can be reduced, and increase in the ratio of defective products and degradation of product characteristics caused by leakage of radio wave to the outside or increased noise can be prevented.

Preferably, the space is set such that the septum portion and the radio wave reflecting portion are not in contact with each other.

When the space is set so as to prevent contact between the septum portion and radio wave reflecting portion, the end surface of the waveguide on the side of the substrate portion can more surely be brought into contact with the grounding surface provided on one surface of the substrate portion, and the end surface of the radio wave reflecting portion on the side of substrate portion can more surely be brought into contact with the grounding surface provided on the other surface of the substrate portion.

More preferably, the septum portion is provided not to be in contact with an inner surface of the opening.

By this structure in which the septum portion is not in contact with the inner surface of the opening of the substrate portion, it becomes possible to bring the end surface of the waveguide on the side of the substrate portion more surely into contact with the grounding surface provided on one surface of the substrate portion and to bring the end surface of the radio wave reflecting portion on the side of the substrate portion to be in contact with the grounding surface provided on the other surface of the substrate portion.

More preferably, a slot to which the septum portion is partially inserted is provided on the inner surface of the radio wave reflecting portion. The slot may be provided on the radio wave reflecting surface of the radio wave reflecting portion.

By this structure in which a slot is provided on the inner surface of the radio wave reflecting portion to which an end surface of the septum portion is inserted, leakage of the radio wave from one to the other of the waveguide spaces parted by the septum portion can more effectively be suppressed, and the polarized wave separating characteristic can be improved.

More preferably, a protruded portion is provided on the inner surface of the radio wave reflecting portion, and a slot to which the protruded portion is inserted is provided on the end surface of the septum portion. The protrude portion may be provided on an inner surface of a cylindrical portion of the radio wave reflecting portion.

By providing a protruded portion on the inner surface of the radio wave reflecting portion and providing a slot to which the protruded portion is inserted on the end surface of the septum portion, leakage of the radio wave from one to the other one of the waveguide spaces parted by the septum portion can more effectively be suppressed, and the polarized wave separating characteristic can be improved.

In a structure in which a slot is provided on the inner surface of the cylindrical portion of the radio wave reflecting portion and the septum portion of the waveguide is inserted to the slot, it becomes necessary to change the shape of the opening of the substrate portion. In contrast, in the structure in which the protruded portion is provided on the inside of the cylindrical portion of the radio wave reflecting portion, such a change in shape of the substrate opening becomes unnecessary.

According to the present invention, a protruded portion is provided on an inner peripheral surface of the radio wave reflecting portion, and a slot for inserting the protrude portion is provided on the septum portion. The protruded portion may be provided on the inner surface of the radio wave reflecting surface, or of the cylindrical portion of the radio wave reflecting portion.

By providing a protruded portion on the inner surface of the radio wave reflecting portion and providing a slot to which the protruded portion is inserted on the septum portion, leakage of the radio wave from one to the other one of the waveguide spaces parted by the septum portion can more effectively be sup pressed, and the polarized wave separating characteristic can be improved.

In a structure in which a slot is provided on the inner surface of the cylindrical portion of the radio wave reflecting portion and the septum portion of the waveguide is inserted to the slot, it becomes necessary to change the shape of the opening of the substrate portion. In contrast, in the structure in which the protruded portion is provided on the inside of the cylindrical portion of the radio wave reflecting portion, such a change in shape of the substrate opening becomes unnecessary.

More preferably, the slot is formed to have a shape widening from the bottom toward the opening side.

When the slot has such a shape that widens from the bottom to the opening side, easy manufacturing by casting technique, for example by aluminum die cast, becomes possible.

More preferably, the slot is provided on the inner surface of the cylindrical portion of the radio wave reflecting portion, or at the end surface of the septum opposing to the cylindrical portion of the radio wave reflecting portion, and at least a part of the bottom portion of the slot is formed to have such a shape that widens from the radio wave reflecting surface side to the substrate side.

As the bottom portion of the slot has such a shape that widens from the side of the radio wave reflecting surface to the side of the substrate, easy manufacturing by casting technique, for example by aluminum die cast, becomes possible.

According to another aspect, the present invention provides a polarized wave separating structure, including: a substrate portion having an opening and provided with a pair of radio wave receiving portions; a waveguide arranged on one side of the substrate portion; and a radio wave reflecting portion arranged on the other side of the substrate portion and having a radio wave reflecting surface on an inner side and a septum provided therein; wherein the septum portion is extended through the opening to the side of the wave guide so as to separate respective polarized waves received by the pair of radio wave receiving portions, and a space between the septum portion and the waveguide is set such that an end surface of the waveguide on the side of the substrate portion is in contact with a grounding surface provided on one surface of the substrate portion and an end surface of the radio wave reflecting portion on the side of the substrate portion is in contact with a grounding surface provided on the other surface of the substrate portion.

Here, when the space between the septum portion and the waveguide is made very small with respect to the wavelength of the radio wave, the radio wave hardly leaks through the space from one to the other of the waveguide spaces parted by the septum portion. Namely, even with such a space, fully satisfactory polarized wave separating characteristic can be attained. Therefore, even when there is a variation at the time of mass production, the end surface of the waveguide on the side of the substrate is surely brought into contact with the grounding surface formed on one surface of the substrate portion and the end surface of the radio wave reflecting portion on the side of the substrate portion is surely brought into contact with the grounding surface formed on the other surface of the substrate portion, and hence, unlike the first prior art example described above, leakage of radio wave to the outside or increase of noise can be prevented.

Further, the structure is not the type of the second prior art example in which the gap between the septum portion of the waveguide and the hole of the radio wave reflecting portion is filled by a separate member. Therefore, the cost including the cost of raw materials and manufacturing can be reduced, and increase in the ratio of defective products and degradation of product characteristics caused by leakage of radio wave to the outside or increased noise can be prevented.

Therefore, according to the present invention, a polarized wave separating structure can be realized that attains fully satisfactory polarized wave separating characteristic without leakage of radio wave to the outside or increase of noise, that has a simple structure and improves ratio of satisfactory products of mass production and that can be manufactured at a low cost and hence suitable for mass production.

Preferably, the space is set such that the septum portion and the waveguide are not in contact with each other.

When the space is set so as to prevent contact between the septum portion and the waveguide, the end surface of the waveguide on the side of the substrate portion can more surely be brought into contact with the grounding surface provided on one surface of the substrate portion, and the end surface of the radio wave reflecting portion on the side of substrate portion can more surely be brought into contact with the grounding surface provided on the other surface of the substrate portion.

More preferably, the septum portion is provided to be not in contact with the inner surface of the opening.

By this structure in which the septum portion is not in contact with the inner surface of the opening of the substrate portion, it becomes possible to bring the end surface of the waveguide on the side of the substrate portion more surely into contact with the grounding surface provided on one surface of the substrate portion and to bring the end surface of the radio wave reflecting portion on the side of the substrate portion into contact with the grounding surface provided on the other surface of the substrate portion.

More preferably, a slot to which the septum portion is partially inserted is formed on the inner surface of the waveguide.

By the structure in which a slot is provided on the inner surface of the waveguide to which the septum portion is partially inserted, leakage of the radio wave from one to the other of the waveguide spaces parted by the septum portion can more effectively be suppressed, and the polarized wave separating characteristic can be improved.

More preferably, a protruded portion is formed on the inner surface of the waveguide, and a slot to which the protruded portion is inserted is formed in the septum portion.

By providing a protruded portion on the inner surface of the waveguide and providing a slot to which the protruded portion is inserted on the septum portion, leakage of the radio wave from one to the other one of the waveguide spaces parted by the septum portion can more effectively be suppressed, and the polarized wave separating characteristic can be improved.

More preferably, the slot is formed to have such a shape that widens from the bottom portion to the opening side.

When the slot has such a shape that widens from the bottom to the opening side, easy manufacturing by casting technique, for example by aluminum die cast, becomes possible.

More preferably, the bottom portion of the slot is formed to have such a shape that widens from the radio wave entrance side of the waveguide to the substrate side.

As the bottom portion of the slot has such a shape that widens from the the radio wave entrance side of the waveguide to the side of the substrate, easy manufacturing by casting technique, for example by aluminum die cast, becomes possible.

According to a still further aspect, the present invention provides a polarized wave separating structure, including: a substrate portion having an opening and provided with a pair of radio wave receiving portions; a waveguide arranged on one side of the substrate portion and having a septum provided therein; and a radio wave reflecting portion arranged on the other side of the substrate portion and having a radio wave reflecting surface provided on an inner side and a septum provided therein; wherein both septum portions are arranged opposed to each other to separate respective polarized waves received by the pair of radio wave receiving portions; and the space between the two septum portions is set such that an end surface of the waveguide on the side of the substrate is surely in contact with a grounding surface provided on one surface of the substrate portion and an end surface of the radio wave reflecting portion on the side of the substrate portion is surely in contact with a grounding surface provided on the other surface of the substrate portion.

More preferably, when the space between the two septum portions is made very small with respect to the wavelength of the radio wave, the radio wave hardly leaks through the space from one to the other of the waveguide spaces parted by the septum portion. Namely, even with such a space, fully satisfactory polarized wave separating characteristic can be attained. Therefore, even when there is a variation at the time of mass production, the end surface of the waveguide on the side of the substrate is surely brought into contact with the grounding surface formed on one surface of the substrate portion and the end surface of the radio wave reflecting portion on the side of the substrate portion is surely brought into contact with the grounding surface formed on the other surface of the substrate portion, and hence, unlike the first prior art example described above, leakage of radio wave to the outside or increase of noise can be prevented.

Further, the structure is not the type of the second prior art example in which the gap between the septum portion of the waveguide and the hole of the radio wave reflecting portion is filled by a separate member. Therefore, the cost including the cost of raw materials and manufacturing can be reduced, and increase in the ratio of defective products and degradation of product characteristics caused by leakage of radio wave to the outside or increased noise can be prevented.

Therefore, according to the present invention, a polarized wave separating structure can be provided that can attain fully satisfactory polarized wave separating characteristic without leakage of the radio wave to the outside or increase of noise, that have simple structure enabling improvement of satisfactory product ratio of mass production and that can be manufactured at a low cost and is suitable for mass production.

More preferably, the space is set such that the septum portion of the waveguide is not in contact with the septum portion of the radio wave reflecting portion.

When the space is set so as to prevent contact between the septum portion of the waveguide and the septum portion of the radio wave reflecting portion, the end surface of the waveguide on the side of the substrate portion can more surely be brought into contact with the grounding surface provided on one surface of the substrate portion, and the end surface of the radio wave reflecting portion on the side of substrate portion can more surely be brought into contact with the grounding surface provided on the other surface of the substrate portion.

More preferably, both the septum portion of the waveguide and the septum portion of the radio wave reflecting portion are provided to be not in contact with the inner surface of the opening.

By this structure in which neither the septum portion of the waveguide nor the septum portion of the radio wave reflecting portion is not in contact with the inner surface of the opening of the substrate portion, it becomes possible to bring the end surface of the waveguide on the side of the substrate portion more surely into contact with the grounding surface provided on one surface of the substrate portion and to bring the end surface of the radio wave reflecting portion on the side of the substrate portion into contact with the grounding surface provided on the other surface of the substrate portion.

More preferably, both the septum portion of the waveguide and the septum portion of the radio wave reflecting portion are arranged not to pass through the opening.

By the structure in which both the septum portion of the waveguide and the septum portion of the radio wave reflecting portion do not pass through the opening of the substrate portion, the septum portions can be extended to positions of the end surfaces on the side of the substrate portion of the cylindrical portion of the waveguide and the cylindrical portion of the radio wave reflecting portion. Therefore, the polarized wave separating characteristic can be improved.

Preferably, of the opposing end surfaces of the waveguide side septum portion and the radio wave reflecting side septum portion, one is provided with a protruded portion and the other is provided with a slot to which the protruded portion is inserted.

In this manner, as a protruded portion is provided on an end surface of one of the septum portions and a slot for receiving the protruded portion is provided on the end surface of the other septum portion, leakage of the radio wave from one to the other of the waveguide spaces parted by the septum portions can more effectively be suppressed, and the polarized wave separating characteristic can be improved.

More preferably, the slot is formed to have such a shape that widens from the bottom portion to the opening side.

When the slot has such a shape that widens from the bottom to the opening side, easy manufacturing by casting technique, for example by aluminum die cast, becomes possible.

More preferably, on one of the pair of radio wave receiving portions provided on the substrate, a reflection free terminating portion absorbing the received polarized wave is provided.

As the reflection free terminating portion is provided, the problem of unsatisfactory grounding contact between the septum of the radio wave reflecting portion and the grounding surface of the substrate can be solved.

Preferably, the reflection free terminating portion is grounded through a terminating resistor. As the terminating resistance is provided, the polarized wave that is not to be received can sufficiently be attenuated.

More preferably, the reflection free terminating portion includes a receiving probe to which the terminating resistor is connected, and a stub matching portion formed between the receiving probe and the terminating resistor.

Because of the stub matching portion, the resistance can be adjusted to general resistance, and therefore, the polarized wave that is not to be received can sufficiently be attenuated, and the cost can be reduced.

According to a still further aspect, the present invention provides a polarized wave separating structure, including: a substrate portion having an opening and provided with one radio wave receiving portion; a waveguide arranged on one surface side of the substrate portion and provided with a septum portion therein; and a radio wave reflecting portion arranged on the other surface side of the substrate portion and having a radio wave reflecting portion formed on an inner side; wherein the waveguide, the substrate portion and the radio wave reflecting portion form a waveguide space, the septum portion passes through the opening and extends to the radio wave reflecting portion to divide the radio wave reflecting surface into two, the septum portion parts the waveguide space into one waveguide space in which the one radio wave receiving portion is positioned and the other waveguide space, and a reflection free terminating portion is formed in the other waveguide space.

As only one radio wave receiving portion for the polarized wave to be received is provided, the radio wave that is not to be received do not go over the substrate as a reflected wave.

More preferably, one part of the waveguide separated into two by the septum at the end portion on the substrate portion side is closed with its inner surface providing a reflecting surface, and the other part separated by the septum is opened to transmit the polarized wave to the succeeding stage, the substrate portion has an opening of the same shape as the opening of the waveguide, and the radio wave reflecting portion is formed to have the same shape as the opening of the waveguide.

More preferably, one part of the waveguide that is divided into two by the septum at the end portion on the substrate portion side is closed with its inner surface forming a reflecting surface, and the other part separated by the septum opened to transmit the polarized wave to the succeeding stage, the septum of the waveguide passes through the substrate opening to extend to the radio wave reflecting portion of the succeeding stage, and the shape of the substrate opening and the shape of the opening of the radio wave reflecting portion of the succeeding stage correspond to the shape of the opening at the waveguide and the cross sectional shape of the septum of the waveguide.

More preferably, the reflection free terminating portion is formed at the reflecting surface provided by closing one of the separated portions of the waveguide.

As the reflection free terminating portion is attached, attenuation is attained in the waveguide space, and hence, reflection wave can more effectively be suppressed.

Preferably, the reflection free termination portion formed at the reflecting surface is a plate-shaped radio wave absorber, and hence cost reduction is possible.

The reflection free terminating portion formed at the reflecting surface is a semi-columner radio wave absorber, and generation of reflective wave can more effectively be suppressed.

More preferably, the reflection free terminating portion formed at the reflecting surface is a semi-conical radio wave absorber, better adjustment is attained when the polarized wave enters from the space to the radio wave absorber, and the reflective wave is reduced.

More preferably, the radio wave absorber of the refection free terminating portion is a resistance plate. As the resistance plate attenuates only the polarized wave that is parallel to the resistance plate, it is effective to attenuate only the polarized wave that is not to be received.

More preferably, a cutout portion is formed at one end of the resistance plate on the side of the waveguide that is opened. The cutout portion attains adjustment when the polarized wave enters from the space to the resistance plate, and the reflective wave generated at that portion can be suppressed.

Preferably, a radio wave receiving converter includes any of the above described polarized wave separating structures.

Therefore, a radio wave receiving converter can be realized that attains fully satisfactory polarized wave separating characteristic without leakage of radio wave to the outside or increase of noise, that has a simple structure and improves the ratio of satisfactory products of mass production and that can be manufactured at a low cost and is suitable for mass production.

Further, an antenna apparatus is provided that includes the above described radio wave receiving converter and a reflecting parabola portion that reflects the received radio wave and guides the reflected radio wave to the radio wave receiving converter.

Accordingly, an antenna apparatus can be realized that can attain fully satisfactory polarized wave separating characteristic without leakage of radio wave to the outside or increase of noise, that has a simple structure and improves the ratio of satisfactory products of mass production, and that can be manufactured at a low cost and is suitable for mass production.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 11 is a table of comparison of the polarized wave separating characteristic between Embodiment 2 and the second prior art example.

FIGS. 13A to 13C represent the polarized wave separating structure in accordance with Embodiment 3 of the present invention, in which FIG. 13A is a partial vertical section, and FIGS. 13B and 13C are partially enlarged cross sections of the region β of FIG. 13A.

FIGS. 14A and 14B represent a polarized wave separating structure in accordance with Embodiment 4 of the present invention, in which FIG. 14A is a partial perspective view representing a schematic structure of the radio wave reflecting portion, and FIG. 14B is a cross section representing the polarized wave separating structure.

FIGS. 28A to 28C represent the polarized wave separating structure in accordance with Embodiment 10 of the present invention, in which FIG. 28A is a partial vertical section, and FIGS. 28B and 28C are partially enlarged cross section of the region γ of FIG. 28A.

FIGS. 47A to 47C represent the structure of the conductive member 107 in accordance with the second prior art example, in which FIG. 47A is a perspective view, FIG. 47B is a cross section taken along the line XXXXVIIB—XXXXVIIB, and FIG. 47C is a cross section showing the conductive member 107 and septum 101*a* attached to hole 102*i*.

DESCRIPTION OF THE PREFERRED EMBODIMENTS

Embodiments of the present invention will be described with reference to the figures.

Figure 1:
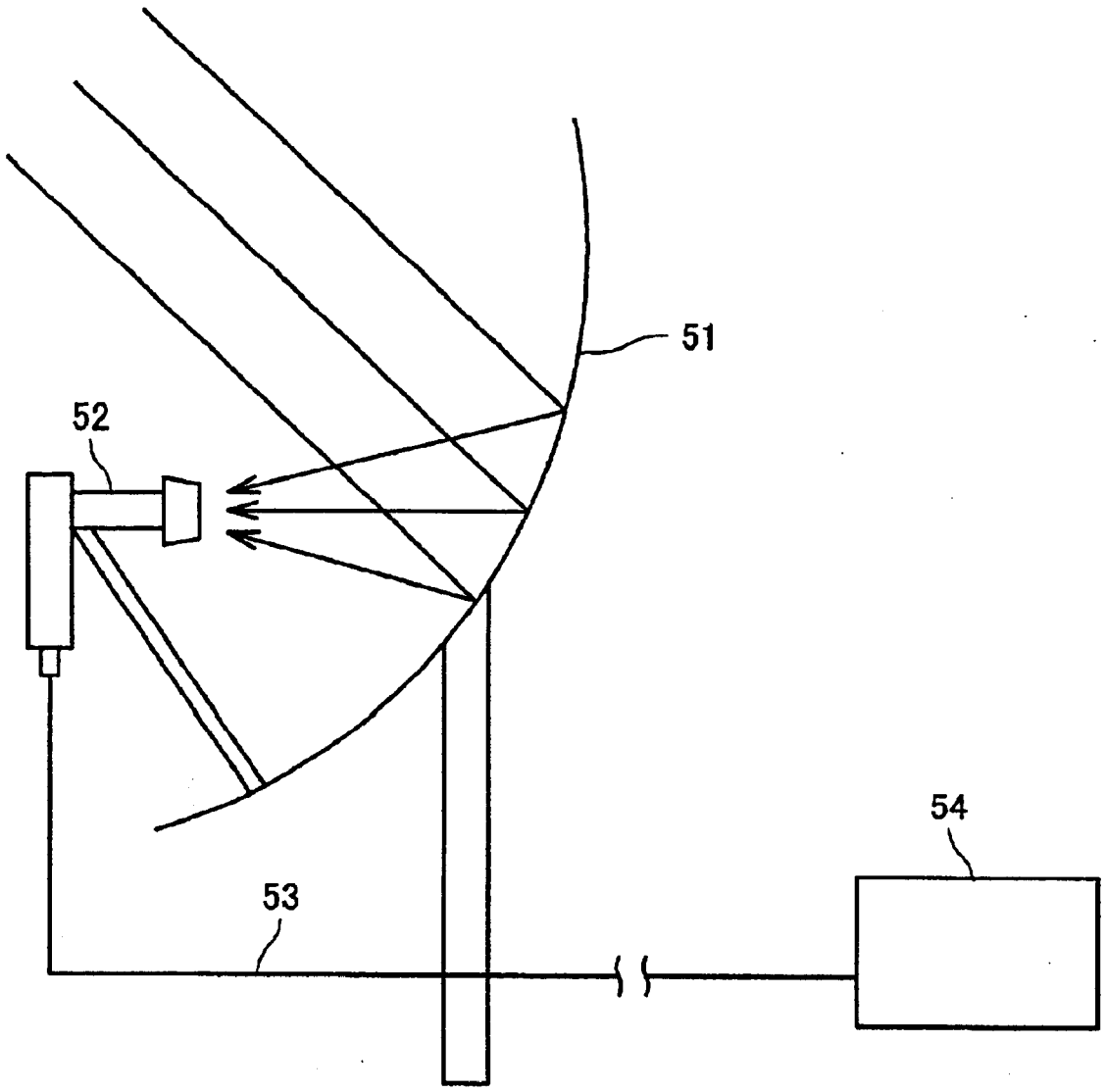
FIG. 1 is an illustration of a receiving converter and an antenna apparatus in accordance with one embodiment of the present invention.

First, referring to FIG. 1, a receiving converter (LNB: Low Noise Blockdown Converter) for receiving radio waves from a satellite and an antenna apparatus will be described. The radio waves from the satellite are reflected and concentrated by a reflecting parabola portion 51, guided to and taken in by a radio wave receiving converter 52. Reflecting parabola portion 51 and radio wave receiving converter 52 form the antenna apparatus.

In the embodiments described in the following, the radio waves from the satellite are circularly polarized waves including d-polarized wave and l-polarized wave. Converter 52 separates these two components, amplifies each of the components, and converts the radio waves in the band of several GHz to signals of 1 GHz band. The converted signals are transmitted through a cable 53 to an indoor receiving device 54.

In the embodiments, polarized wave separating structures used for such a radio wave receiving converter or an antenna apparatus will be described.

Embodiment 1

A polarized wave separating structure in accordance with Embodiment 1 of the present invention will be described with reference to FIGS. 2 to 4.

Figure 2:
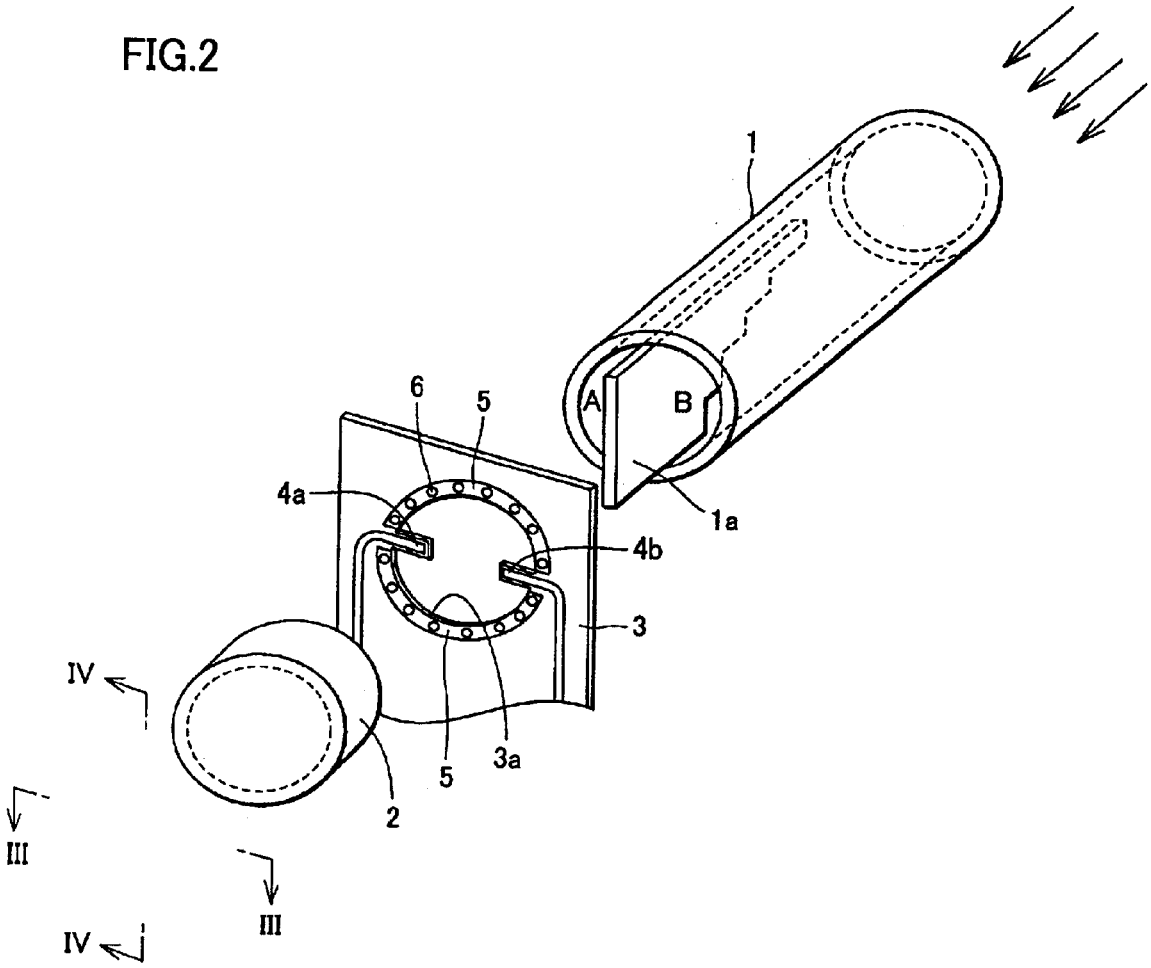
FIG. 2 is an exploded perspective view showing the polarized wave separating structure in accordance with Embodiment 1 of the present invention.
Figure 3:
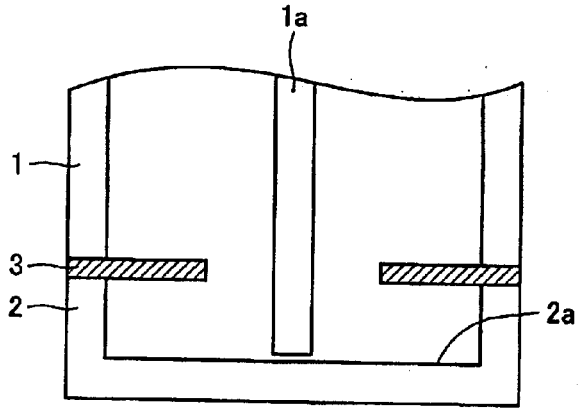
FIG. 3 is a partial cross section taken along the line III—III of FIG. 2.
Figure 4:
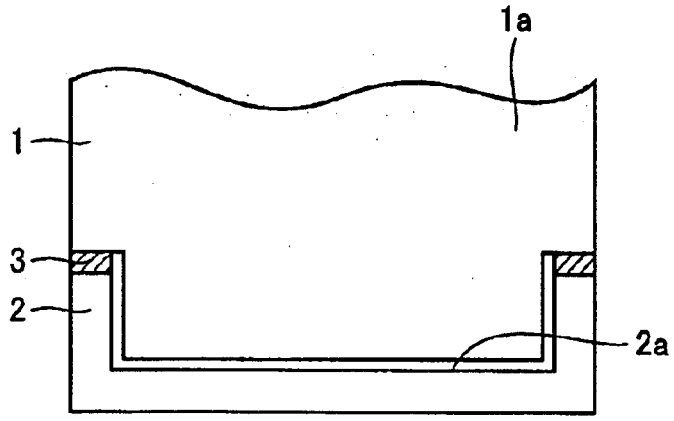
FIG. 4 is a partial cross section taken along the line IV—IV of FIG. 2.

FIG. 2 is an exploded perspective view of a main portion showing a schematic structure of Embodiment 1, FIG. 3 is a partial cross section taken along the line III—III of FIG. 2, and FIG. 4 is a partial cross section taken along the line IV—IV of FIG. 2.

The polarized wave separating structure mainly includes a waveguide 1, a radio wave reflecting portion 2 and a substrate 3.

Substrate 3 has an opening 3*a* formed therein. On substrate 3, a pair of radio wave receiving probes (radio wave receiving portions) 4*a* and 4*b* are formed in the form of conductive film patterns, at opposing positions to protrude into the opening 3*a*. The pair of radio wave receiving probes 4*a* and 4*b* are formed on that surface of substrate 3 on which radio wave reflecting portion 2 is positioned. Substrate 3 is formed of an insulative substrate such as an insulative resin substrate or a glass epoxy substrate, with a pattern of a conductive film of copper, for example, formed thereon.

At portions of substrate 3 except for the conductive film patterns forming the radio wave receiving probes 4*a* and 4*b*, a grounding surface 5 to be in contact with radio wave reflecting portion 2 is formed by a conductive film pattern, around opening 3*a*. Further, on the surface of substrate 3 opposite to the grounding surface 5, a grounding surface (not shown) to be in contact with an end portion of waveguide 1 is formed by a conductive film pattern. The grounding surface in contact with the end surface of radio wave reflecting portion 2 and the grounding surface in contact with the end surface of waveguide 1 are connected to each other by means of through holes 6. Thus, through substrate 3, waveguide 1 and radio wave reflecting portion 2 are kept at the grounding potential. The wiring portion of the conductive film patterns forming radio wave receiving probes 4*a* and 4*b* formed on substrate 3 are electrically insulated from respective grounding surfaces, waveguide 1 and radio wave reflection portion 2.

On one side of substrate 3, waveguide 1 is arranged. Waveguide 1 is provided with a septum (septum portion) 1*a* with a stepped portion. Septum 1*a* extends through the opening 3*a* of substrate 3 to radio wave reflecting portion 2. In the present embodiment, waveguide 1 and septum 1*a* are formed integrally. For example, these may be formed as one piece by casting technique using, for example, aluminum die cast.

Radio wave reflecting portion 2 includes a cylindrical portion and a flat plate portion at an end, which is approximately parallel to the substrate 3, and inside the reflecting portion, the inner surface of the plate shaped portion serves as a radio wave reflecting surface 2*a*. Radio wave reflecting portion 2 can also be formed by casting technique using, for example, aluminum die cast.

In the present embodiment, a space between septum 1*a* and the inner surface (inside surface) of radio wave reflecting portion 2 is set such that the end surface of waveguide 1 on the side of substrate 3 is surely in contact with the grounding surface provided on one surface of substrate 3 and the end surface of radio wave reflecting portion 2 on the side of substrate 3 is surely in contact with grounding surface 5 provided on the other surface of substrate 3, while septum 1*a* is not in contact with radio wave reflecting portion 2.

More specifically, in the present embodiment, a structure is provided in which the end surface of waveguide 1 on the side of the substrate 3 is in tight contact without any gap with and along the grounding surface provided on one surface of substrate 3 and the end surface of radio wave reflecting portion 2 on the side of substrate 3 is in tight contact without any gap with and along the grounding surface 5 provided on the other surface of substrate 3, whereby radio wave does not leak to the outside and any noise component does not enter from the outside, at the contact portion between the end surface of waveguide 1 on the side of substrate 3 and the grounding surface provided on one surface of substrate 3 and at the contact portion between the end surface of radio wave reflecting portion 2 on the side of substrate 3 and grounding surface 5 provided on the other surface of substrate 3.

In the present embodiment, septum 1*a* is provided not in contact with the inner surface of opening 3*a*, so that the end surface of waveguide 1 on the side of substrate 3 is surely in contact with the grounding surface provided on one surface of substrate 3 and the end surface of radio wave receiving portion 2 on the side of substrate 3 is surely in contact with grounding surface 5 provided on the other surface of substrate 3.

More specifically, as shown in FIGS. 3 and 4, the end surface of septum 1*a* is not in contact with the radio wave reflecting surface 2*a* or the inner surface (inside surface) of the cylindrical portion of the radio wave reflecting portion 2. Further, as shown in FIGS. 3 and 4, the end surface of septum 1*a* is not in contact with the inner surface (inside surface) of opening 3*a* of substrate 3, either. Generally, such a radio wave receiving converter has the inside made airtight. Therefore, between septum 1*a* and radio wave reflecting portion 2 and between septum 1*a* and opening 3*a*, there is no separate member interposed, but gas, such as air, exists only.

In such a structure, waveguide 1, substrate 3 and radio wave reflecting portion 2 form a waveguide space, and the waveguide space is parted by septum portion 1*a* into one waveguide space in which one of the pair of radio wave receiving probes 4*a* and 4*b* is positioned, and the other waveguide space in which the other radio wave receiving probe is positioned. In the waveguide space, substrate 3 and radio wave reflecting surface 2*a* are arranged to be approximately vertical to the direction of progress of the radio wave, while septum 1*a* is arranged along the direction of progress of the radio wave.

The operation of the above described polarized wave separating structure is as follows. When circularly polarized wave as an input radio wave enters from the direction of the arrow shown in FIG. 2, the circularly polarized wave caught by waveguide 1 is converted to a linearly polarized wave by the stepped portion of septum 1*a*. Here, as the circularly polarized wave includes d-polarized wave and l-polarized wave, the linearly polarized wave resulting from the conversion includes a component resulting from conversion of the d-polarized wave and a component resulting from the conversion of the l-polarized wave.

The stepped portion of septum 1*a* functions as a circularly polarized wave-linearly polarized wave converting portion for changing the circularly polarized wave to linearly polarized wave. The shape is not limited to steps, and it may be tapered, widening linearly from the radio wave entrance side to the substrate 3, for example. Namely, any shape may be used provided that it functions as the circularly polarized wave-linearly polarized wave converting portion. The description as to the stepped portion of the septum is common to any of the following embodiments.

Thereafter, of the two parted waveguide spaces parted by septum 1*a*, one waveguide space (waveguide space A) captures the linearly polarized component (component A) resulting from conversion of the d-polarized wave, and the other waveguide space (waveguide space B) captures the linearly polarized component (component B) resulting from conversion of the l-polarized wave.

Component A separated in this manner passes through opening 3*a*, is reflected at radio wave reflecting portion 2*a*, and received by radio wave receiving probe 4*a*, as one of the pair of radio wave receiving probes 4*a* and 4*b*. Similarly, component B passes through opening 3*a*, is reflected at radio wave reflecting portion 2*a* and received by the other radio wave receiving probe 4*b*.

The components A and B of respective linearly polarized waves received by the pair of radio wave receiving probes 4*a* and 4*b* are input to a prescribed circuit (not shown) provided in substrate 3 of the converter.

In the present embodiment, as already described, the space between septum 1*a* and the inner surface (inside surface) of radio wave reflecting portion 2 is set such that septum 1*a* is not in contact with radio wave reflecting portion 2, so that the end surface of waveguide 1 on the side of substrate 3 is surely in contact with the grounding surface provided on one surface of substrate 3, and the end surface of radio wave reflecting portion 2 on the side of substrate 3 is surely in contact with grounding surface 5 provided on the other surface of substrate 3.

In the present embodiment, the distance between the inner surface (inside surface) of radio wave reflecting portion 2 and the end surface of septum 1*a* opposing thereto is designed to be 0.2 mm to 0.3 mm. This is determined in consideration that, when waveguide 1 including septum 1*a* and radio wave reflecting portion 2 are formed by casting technique such as aluminum die cast, error in dimensional accuracy is generally ±0.05 mm. More specifically, assuming that there is an error of +0.05 mm on the side of waveguide 1 and +0.05 mm on the side of radio wave reflecting portion 2, the error in total is +0.1 mm. In an actual product, waveguide 1 and radio wave reflecting portion 2 are fixed by screws with substrate 3 interposed. By the screwing, substrate 3 is compressed to some extent, resulting in dimensional variation at the time of mass production. Therefore, in the present embodiment, in design, the distance between the inner surface (inside surface) of radio wave reflecting portion 2 and the end surface of septum 1*a* opposing thereto is set to be at least 0.2 mm. When the design value is at least 0.2 mm, the space between septum 1*a* of waveguide 1 and radio wave reflecting portion 2 of about 1 mm or larger can be ensured, even when there is a variation in mass production. Therefore, the end surface of waveguide 1 on the side of substrate 3 can more surely be brought into contact with the grounding surface provided on one surface of substrate 3, and the end surface of radio wave reflecting portion 2 on the side of substrate 3 can more surely be brought into contact with the grounding surface 5 provided on the other surface of substrate 3.

The wavelength of the radio wave (microwave) used for satellite broadcasting or satellite communication is about several cm. The distance between the inner surface (inside surface) of radio wave reflecting portion 2 and the end surface of septum 1*a* opposing thereto have only to be sufficiently smaller than the wavelength. Therefore, in the present embodiment, the value is set to be at most 0. 3 mm. Considering the above described dimensional error, the distance would be at most about 0.4 mm. With such a value, fully satisfactory polarized wave separating characteristic can be attained.

In this manner, according to the present embodiment, even when there is a variation in mass production, the end surface of waveguide 1 on the side of substrate 3 is surely in contact with the grounding surface provided one surface of substrate 3, and the end surface of radio wave reflecting portion 2 on the side of substrate 3 can be surely in contact with the grounding surface 5 provided on the other surface of substrate 3.

As a result, leakage of the radio wave to the outside of the waveguide space or increase of noise can be suppressed, while maintaining fully satisfactory polarized wave separating characteristic.

Further, unlike the second prior art example described above, a separate member for connecting the waveguide and the radio wave reflecting portion is unnecessary. Therefore, cost and time necessary for manufacture can be reduced. For example, as compared with the second prior art example described above, in the process of mass production and mounting for forming the waveguide space and the polarized wave separating structure, the cost necessary for manufacture can be reduced by about 10%, and the time necessary for manufacture can be reduced by about 50%. Further, as the structure is simple, manufacturing is facilitated, and the ratio of satisfactory products of mass production can be improved.

Embodiment 2

The polarized wave separating structure in accordance with Embodiment 2 of the present invention will be described with reference to FIGS. 5 to 13.

Figure 5:
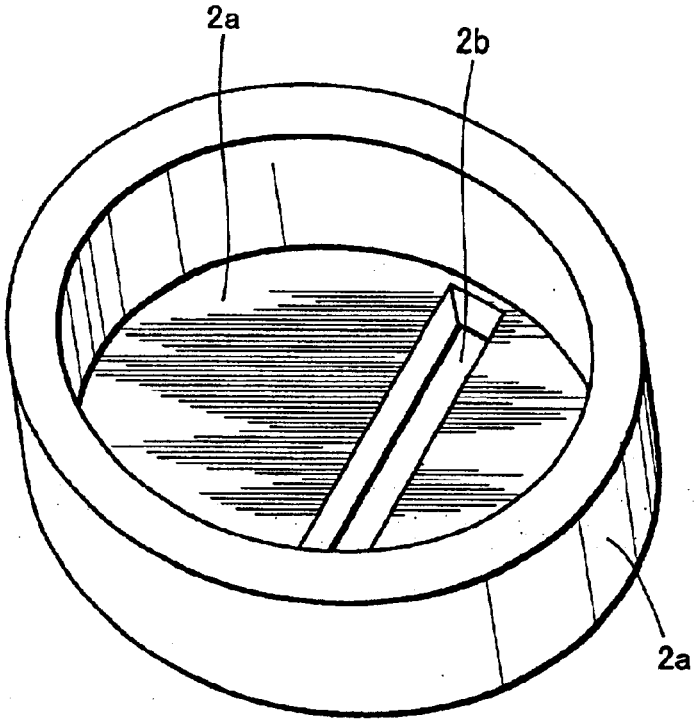
FIG. 5 is a perspective view of a main portion representing a schematic structure of the radio wave reflecting portion in accordance with Embodiment 2 of the present invention.
Figure 6:
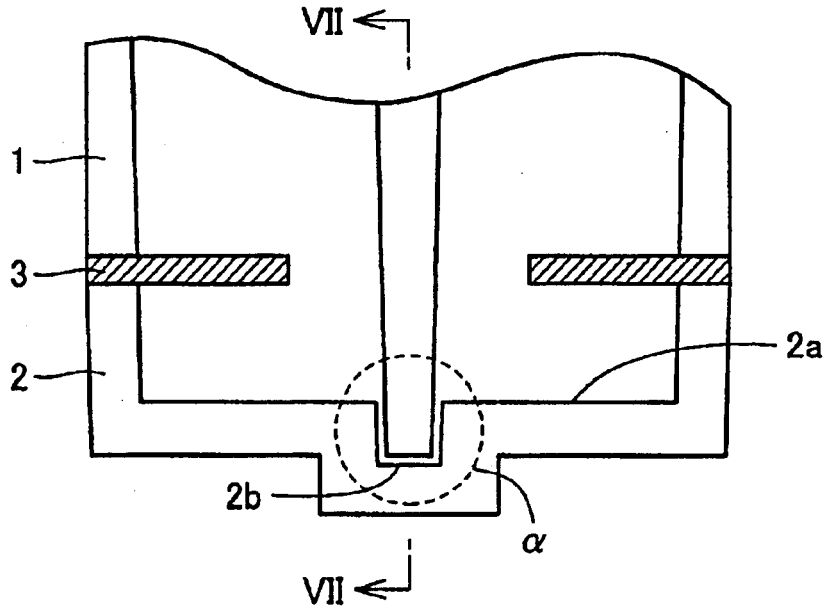
FIG. 6 is a partial vertical section representing a schematic structure of the polarized wave separating structure in accordance with Embodiment 2.
Figure 7:
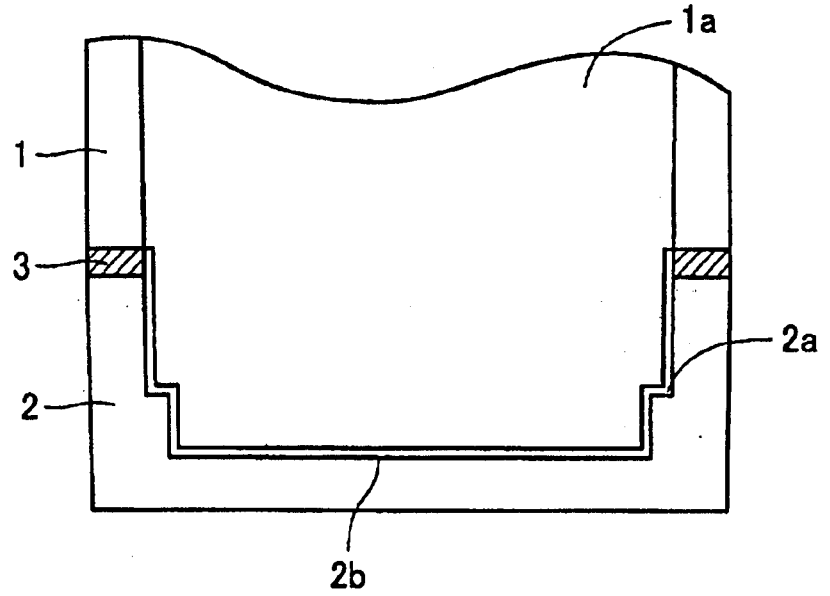
FIG. 7 is a partial cross section taken along the line VII—VII of FIG. 6.
Figure 8:
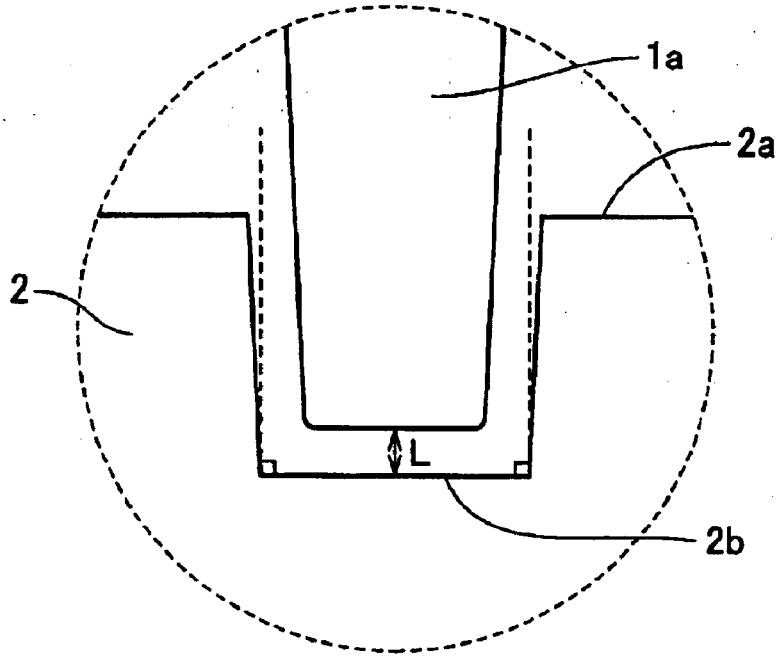
FIG. 8 is a partially enlarged cross section of a region a of FIG. 6.
Figure 9:
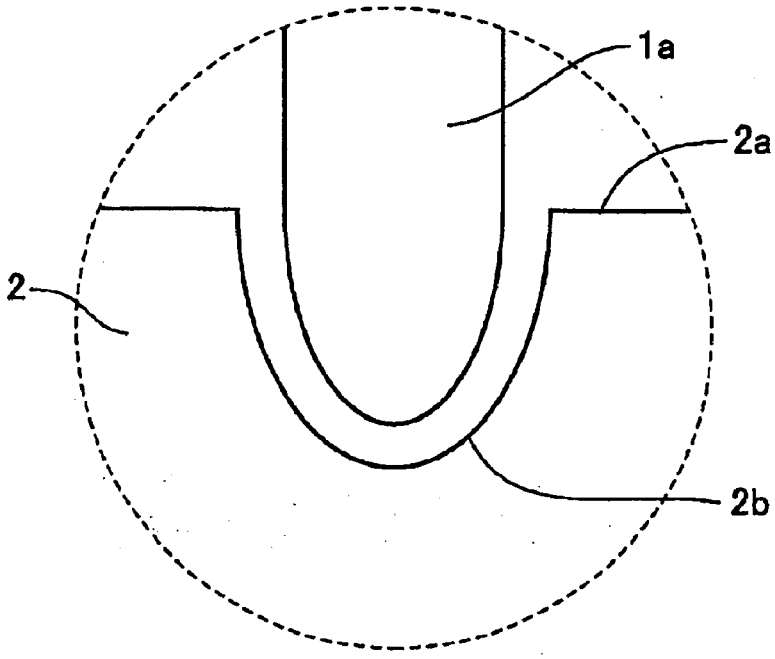
FIG. 9 is a partially enlarged cross section of the region α of FIG. 6.
Figure 10A:
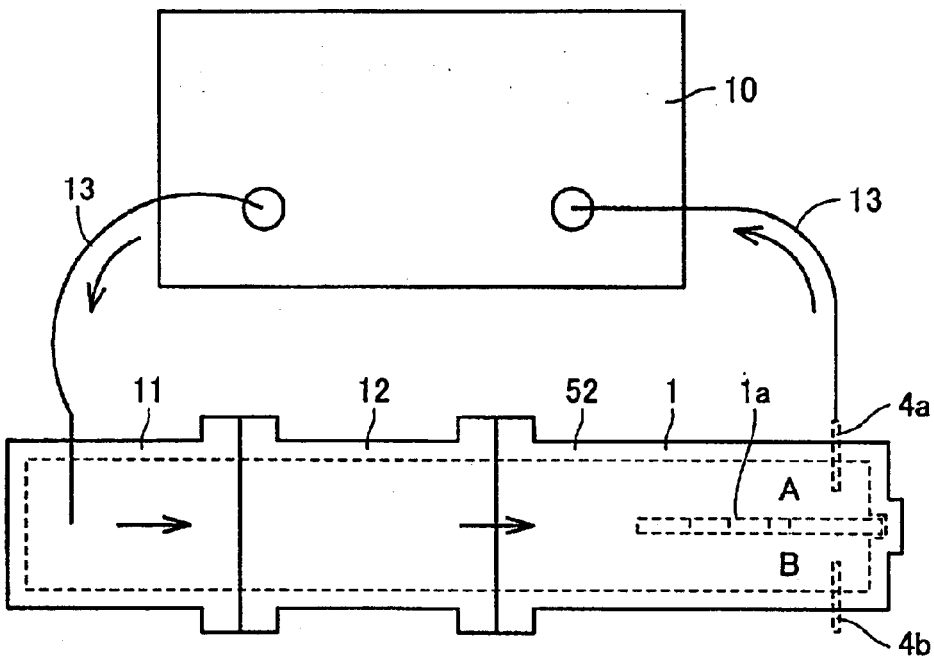
FIGS. 10A and 10B are illustrations representing a measurement system for measuring polarized wave separating characteristic of Embodiment 2.
Figure 10B:
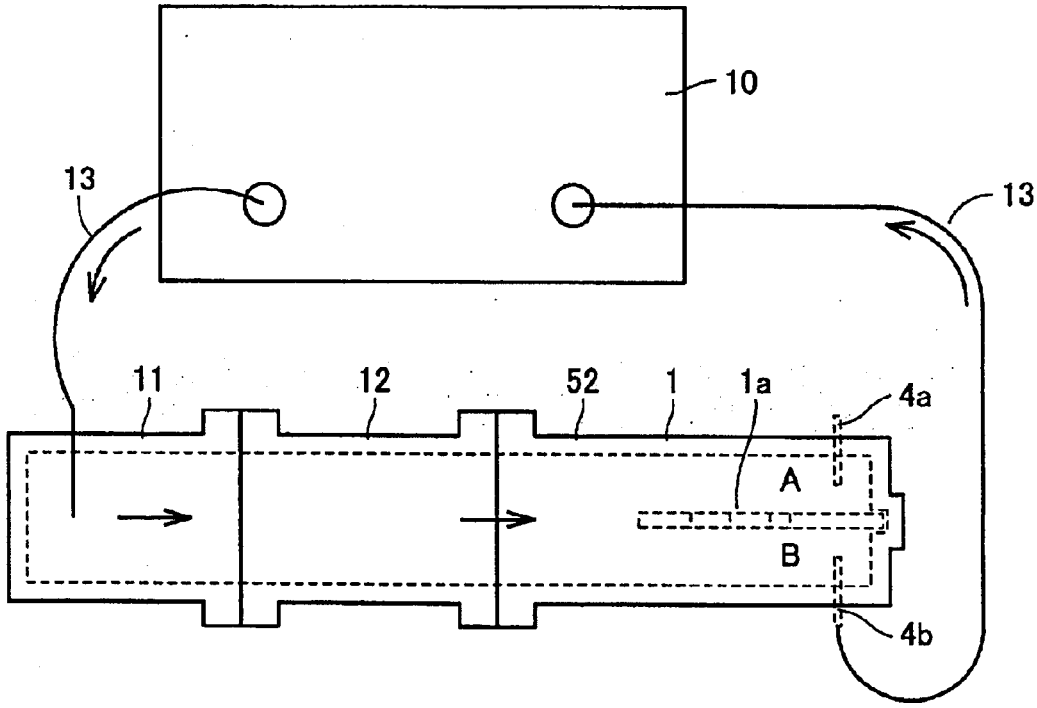
Figure 12:
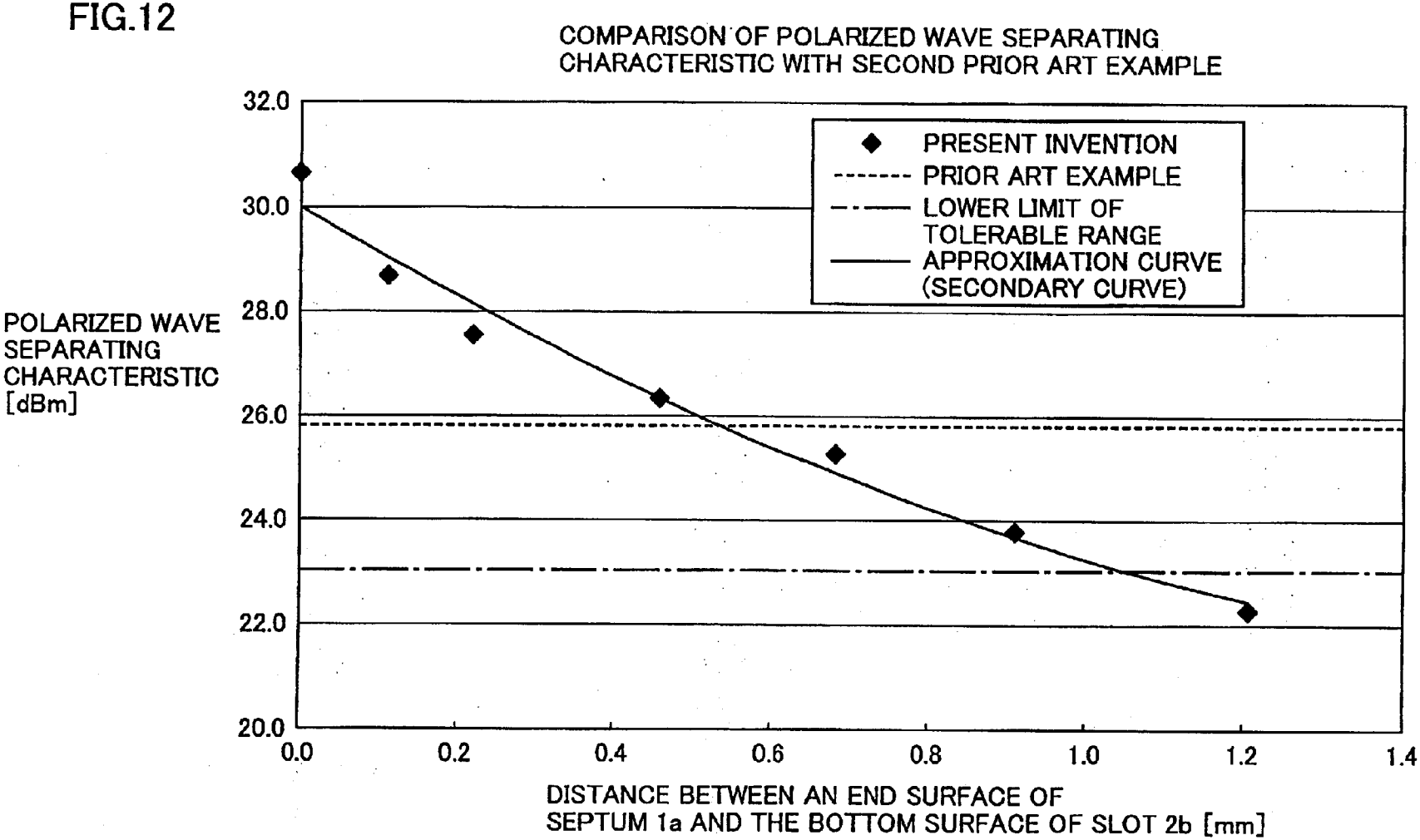
FIG. 12 is a graph representing the result of comparison of polarized wave separating characteristic between Embodiment 2 and the second prior art example.

FIG. 5 is a perspective view of a main portion representing the schematic structure of radio wave reflecting portion 2 in accordance with the present embodiment, FIG. 6 is a partial cross section of the polarized wave separating structure using the radio wave reflecting portion 2, and FIG. 7 is a partial cross section taken along the line VII—VII of FIG. 6. FIGS. 8 and 9 are partially enlarged views of the region a of FIG. 6, FIGS. 10A and 10B are illustrations representing systems for measuring the polarized wave separating characteristic of the present embodiment, and FIGS. 11 and 12 represent comparison of polarized wave separating characteristic of the present embodiment and the second prior art example described above.

Embodiment 2 differs from Embodiment 1 described above mainly in that a slot 2*b* is provided at the radio wave reflecting surface 2*a* of radio wave reflecting portion 2, and that a part of septum 1*a* of waveguide 1 is further extended to be inserted to the slot 2*b* while radio wave reflecting portion 2 and septum 1*a* are not in contact with each other. Unlike hole 102*i* of the second prior art example described above, slot 2*b* is not penetrating through the radio wave reflecting portion to expose the waveguide space to the outside. In the present embodiment also, the space between septum 1*a* and radio wave reflecting portion 2, that is, the distance between septum 1*a* and the inner surface of radio wave reflecting portion 2 should preferably be set, as a design value, from 0.2 mm to 0.3 mm as in Embodiment 1 above.

In the present embodiment, the side portion of slot 2*b* has such a shape that widens from the bottom to the opening, as shown in FIGS. 6 to 8. More specifically, four side surfaces of slot 2*b* are formed as planes inclined from the direction vertical to the bottom surface of trench 2*b*. In the present embodiment, the angle of inclination is about 1.5 degrees. Further, the space between opposing ones of the four side surfaces of slot 2*b* is closest on the side of the bottom surface of slot 2*b*, and largest on the side of radio wave reflecting surface 2*a*.

As the side portion of slot 2*b* has such a shape that widens from the bottom surface to the opening, slot 2*b* can easily be formed by casting technique using aluminum die cast, for example, without the necessity of cutting process. As a result, the cost necessary for forming slot 2*b* can significantly be reduced.

As to the shape of slot 2*b* with the side portion widening from the bottom portion to the opening, slot 2*b* may have a cross sectional shape of elliptical arc, as shown in FIG. 9. Here, when the end surface of septum 1*a* to be inserted to slot 2*b* also has a cross sectional shape of elliptical arc, contact between septum 1*a* and radio wave reflecting portion 2 can more easily be avoided.

In the present embodiment, such a slot 2*b* is formed in the radio wave reflecting surface 2*a* of radio wave reflecting portion 2, and a part of septum 1*a* of waveguide 1 is inserted to slot 2*b*. Therefore, at the portion of slot 2*b*, the gap formed by the space between septum 1*a* and radio wave reflecting portion 2 is not continuous as in the first prior example but disconnected, on one same plane in a direction approximately vertical to the direction of progress of the radio wave within the waveguide space. In other words, the gap detours between waveguide space A and waveguide space B, because of slot 2*b* and septum 1*a* inserted thereto.

Therefore, leakage of the radio wave between waveguide spaces A and B can more effectively reduced as compared with Embodiment 1 above, and the polarized wave separating characteristic can be improved.

In FIG. 7, there are steps provided at lower portions on both left and right sides of septum 1*a*. Such steps may not be provided and septum 1*a* as a whole may be extended. In that case, slot 2*b* may be extended in the left and right directions of FIG. 7 correspondingly.

Except for these points described above, the structure is the same as Embodiment 1.

The polarized wave separating characteristic of the receiving converter provided with the polarized wave separating structure in accordance with the present embodiment will be compared with that of the second prior art example.

First, the method of measurement will be described with reference to the illustrations representing the measuring system of FIGS. 10A and 10B.

Referring to FIGS. 10A and 10B, the polarized wave separating characteristic was measured using a network analyzer 10. Waveguide 11 is attached on the side of radio wave entrance side of a circularly polarized wave generator 12, and circularly polarized wave generator 12 is attached on the radio wave entrance side of receiving converter 52. An input signal is supplied through a coaxial cable 13 to waveguide 11, propagated as a linearly polarized wave through waveguide 11, and reaches circularly polarized wave generator 12. The input signal is converted to circularly polarized wave as it passes through circularly polarized wave generator. There are two types of circularly polarized wave generator 12. Namely, one that converts the input signal to d-polarized wave (d-polarized wave generator) and the one that converts the input signal to the l-polarized wave (l-polarized wave generator).

First, using d-polarized wave generator 12, the d-polarized wave is introduced to waveguide 1 of receiving converter 52. The frequency of the input signal is continuously changed in the range of 12.2 GHz (wavelength $\lambda$=2.459 cm) to 12.7 GHz (wavelength $\lambda$=2.362 cm).

The d-polarized wave that entered the waveguide 1 is converted to linearly polarized wave by septum 1*a*, captured by waveguide space A, and received by radio wave receiving probe 4*a*. Assuming that the polarized wave separating characteristic is perfect, there is no radio wave existing in waveguide space B, and therefore, the received signal intensity of radio wave receiving probe 4*b* is zero. Actually, the polarized wave separating characteristic is imperfect, and therefore, there is little radio wave existing in waveguide space B, which is received by radio wave receiving probe 4*b*. The signal intensity (signal intensity a) received by radio wave receiving probe 4*a* and signal intensity (signal intensity b) received by radio wave receiving probe 4*b* were measured through coaxial cable 13 by network analyzer 10. The polarized wave separating characteristic was calculated in accordance with the following equation.

When the d-polarized wave is introduced to waveguide 1, the polarized wave separation characteristic is polarized wave separation characteristic=10×log (signal intensity a/signal intensity a/signal intensity b) [dBm]

Therefore, when the signal intensity b is 1/100 of signal intensity a, the polarized wave separation characteristic is 20 dBm.

Next, using d-polarized wave generator 12, the l-polarized wave is introduced to waveguide 1 of receiving converter 52. Here again, the frequency of the input signal was continuously changed in the range of 12.2 GHz (wavelength X=2.459 cm) to 12.7 GHz (wavelength $\lambda$=2.362 cm). The polarized wave separating characteristic was calculated in accordance with the following equation.

When the l-polarized wave is introduced to waveguide 1, the polarized wave separating characteristic is polarized wave separating characteristic=10×log (signal intensity b/signal intensity a) [dBm]

Referring to the graph representing the polarized wave separating characteristic of FIG. 12, first, the minimum value of the polarized wave separating characteristic over the entire range of input signal frequency was calculated when the d-polarized wave was introduced to waveguide 1 and when the l-polarized wave is introduced to waveguide 1, and smaller of the two was taken as the measurement. Practically, it is desired that the measurement value is at least 23 dBm.

Here, the value of the polarized wave separating characteristic (dBm) is measured with the distance L (mm) between the end surface of septum 1*a* shown in FIG. 8 and the opposing bottom surface of slot 2*b* of radio wave reflecting portion 2 varied, the result of which is given in the form of a table in FIG. 11 and in the form of a graph in FIG. 12. In the measurement, the distance between four side surfaces of slot 2*b* and septum 1*a* was set to 0.25 mm, and the distance between the radio wave reflecting surface 2*a* where slot 2*b* is not formed and the end surface of septum 1*a* was set to 0.2 mm, while the distance L between the end surface of septum 1*a* and the bottom surface of slot 2*b* of radio wave reflecting portion 2 only is changed, and the polarized wave separating characteristic was measured.

FIGS. 11 and 12 also show the results of measurement of the second prior art example, obtained through similar measurement as the present embodiment.

From the results shown in FIGS. 11 and 12, it can be understood that when the distance L between the end surface of septum 1*a* and the bottom surface of slot 2*b* of radio wave reflecting portion 2 is 1.0 mm or smaller, fully satisfactory polarized wave separating characteristic (of 23.0 dBm or higher) for practical use can be attained. Accordingly, it is understood that fully satisfactory polarized wave separating characteristic can be attained when the space between septum 1*a* and radio wave reflecting portion 2 is set to 1.0 mm or smaller.

From the comparison with the second prior art example, it can be understood that when the distance L between the end surface of septum 1*a* and the bottom surface of slot 2*b* of radio wave reflecting portion 2 is 0.5 mm or smaller, polarized wave separating characteristic higher than that of the second prior art example can be attained and that satisfactory polarized wave separating characteristic is realized. Accordingly, it is understood that more satisfactory polarized wave separating characteristic can be attained when the space between septum 1*a* and radio wave reflecting portion 2 is set to 0.5 mm or smaller. Therefore, it is preferred that the space between septum 1*a* and radio wave reflecting portion 2 is set to 1.0 mm or smaller and, more preferably, 0.5 mm or smaller.

The condition of the space distance is the same in Embodiment 1 above as well as in Embodiments 3 to 10, which will be described later. Namely, when the distance is set to 1.0 mm or smaller, satisfactory polarized wave separating characteristic can be attained, and when it is set to 0.5 mm or smaller, more satisfactory polarized wave separating characteristic can be attained.

Embodiment 3

The polarized wave separating structure in accordance with Embodiment 3 of the present invention will be described with reference to FIGS. 13A to 13C.

Figure 13A:
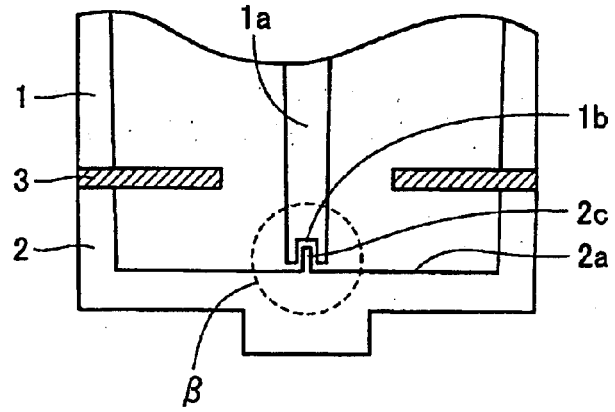
Figure 13B:
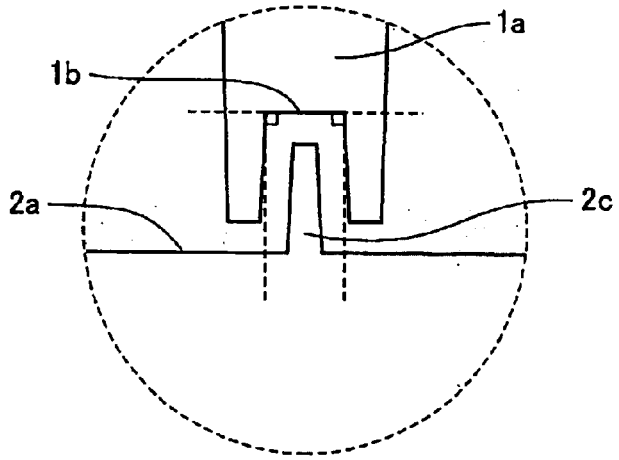
Figure 13C:
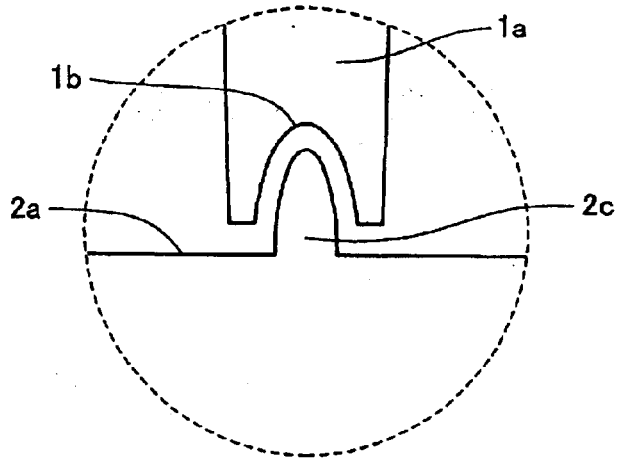

FIG. 13A is a partial cross section showing a schematic structure of the polarized wave separating structure in accordance with the present embodiment that corresponds to FIG. 6 of Embodiment 2, and FIGS. 13B and 13C are partially enlarged views of the region β of FIG. 13A.

Embodiment 3 differs from Embodiment 1 described above mainly in that a protruded portion 2*c* is provided at radio wave reflecting surface 2*a* of radio wave reflecting portion 2, and a slot 1*b* is provided on the end surface of septum 1*a* of waveguide 1 such that protruded portion 2*c* is inserted thereto while radio wave reflecting portion 2 is not in contact with septum 1*a*.

In the present embodiment, protruded portion 2*c* is formed integrally with radio wave reflecting portion 2 and this can be formed as one piece by casting technique using, for example, aluminum die cast. In this embodiment also, the space between septum 1*a* and radio wave reflecting portion 2, that is, the distance between septum 1*a* and the inner surface of radio wave reflecting portion 2 should preferably be 0.2 mm to 0.3 mm as a design value, as in Embodiment 1 above.

Further, in the present embodiment, the side portion of slot 1*b* has such a shape that widens from the bottom portion to the opening as shown in FIG. 13B. More specifically, the side surface of slot 1*b* is a plane inclined from the direction vertical to the bottom surface of slot 1*b*. In the embodiment, the angle of inclination is set to about 1.5 degrees. Further, the space between opposing side surfaces of slot 1*b* is the closest on the side of the bottom surface of slot 1*b* and farthest at the opening of slot 1*b*.

As the side portion of slot 1*b* has such a shape that widens from the bottom surface to the opening, slot 1*b* can easily be formed by casting technique using aluminum die cast, for example, without the necessity of cutting process. As a result, the cost necessary for forming slot 1*b* can significantly be reduced.

As to the shape of slot 1*b* with the side portion widening from the bottom portion to the opening, slot 1*b* may have a cross sectional shape of elliptical arc, as shown in FIG. 13C. Here, when the end surface of protruded portion 2*c* of radio wave reflecting portion 2 to be inserted to slot 1*b* also has a cross sectional shape of elliptical arc, contact between septum 1*a* and radio wave reflecting portion 2 can more easily be avoided.

In the present embodiment, a protruded portion 2*c* is provided on the radio waver reflecting surface 2*a* of radio wave reflecting portion 2, and a slot 1*b* to which the protruded portion 2*c* is inserted is formed on the end surface of septum portion 1*a*. Therefore, at the portion of slot 1*b*, the gap between septum 1*a* and radio wave reflecting portion 2 is not continuous as in Embodiment 1 but disconnected in one plane in a direction approximately vertical to the direction of progress of the radio wave in the waveguide space. In other words, the gap detours between waveguide spaces A and B, because of the protruded portion 2*c* and slot 1*b* to which the protruded portion is inserted.

Therefore, leakage of the radio wave between waveguide spaces A and B can more effectively reduced as compared with Embodiment 1 above, and the polarized wave separating characteristic can be improved.

Except for these points, the embodiment is the same as Embodiment 1 described above.

Embodiment 4

Referring to FIGS. 14A to 16, the polarized wave separating structure in accordance with Embodiment 4 of the present invention will be described.

Figure 14A:
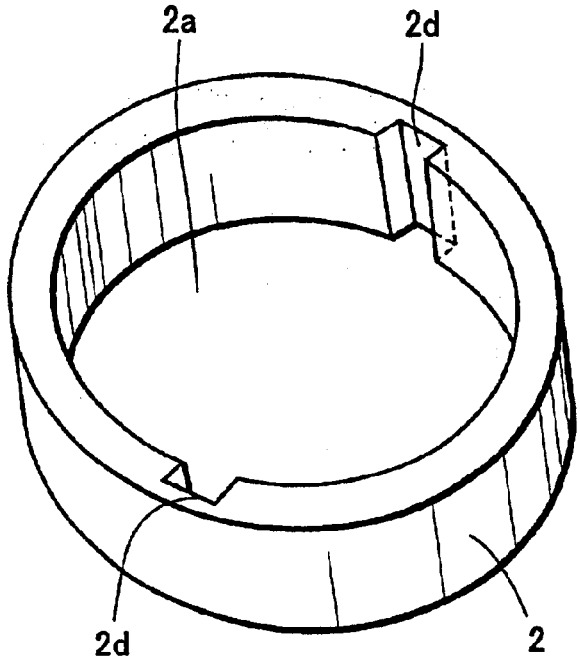
Figure 14B:
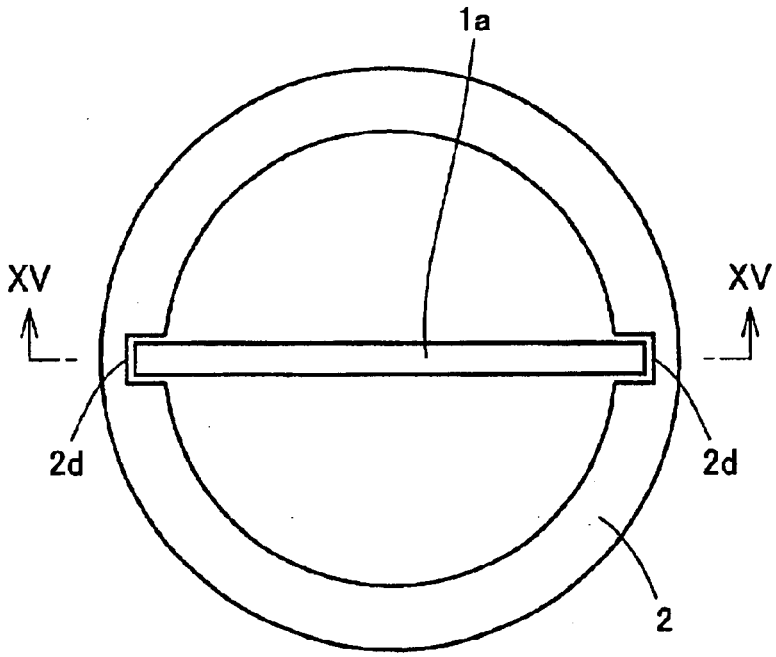
Figure 15:
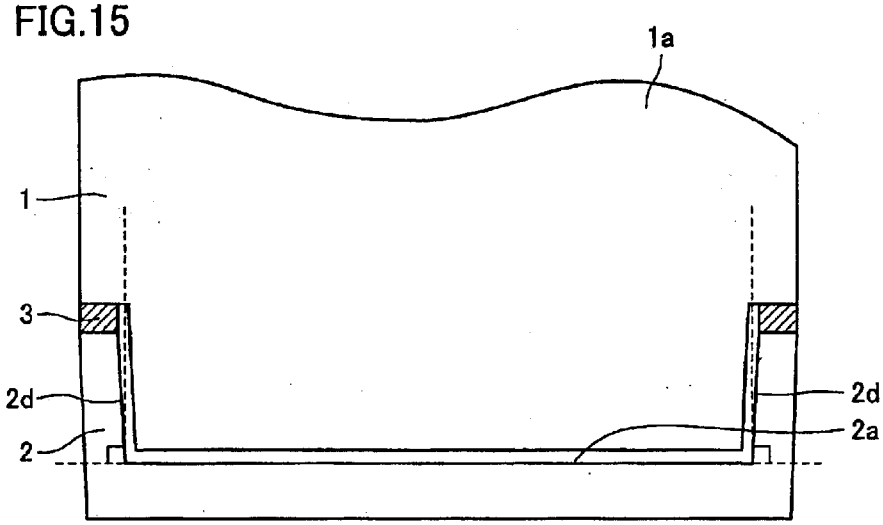
FIG. 15 is a partial cross section taken along the line XV—XV of FIG. 14B.
Figure 16:
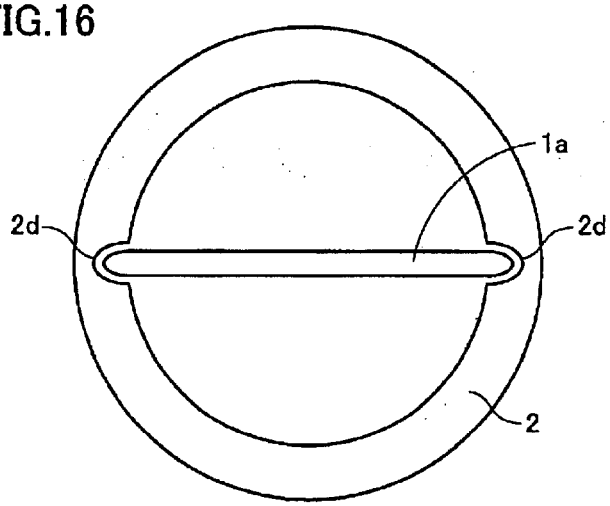
FIG. 16 is a cross section representing the polarized wave separating structure in accordance with Embodiment 4.

FIG. 14A is a partial perspective view representing a schematic structure of radio wave reflecting portion 2 of the present embodiment, and FIG. 14B is a cross section of the polarized wave separating structure using the radio wave reflecting portion 2, viewed from the direction of entrance of the radio wave. FIG. 15 is a partial cross section taken along the line XVXV of FIG. 14B, and FIG. 16 is a cross section of the polarized wave separating structure viewed from the direction of entrance of the radio wave, that corresponds to FIG. 14B.

Embodiment 4 differs from Embodiment 1 above mainly in that two slots 2*d* are provided on an inner peripheral surface of the cylindrical portion of radio wave reflecting portion 2, and opposing end surfaces of septum 1*a* of waveguide 1 are extended to be inserted to the slots 2*d*, while the radio wave reflecting portion 2 is not in contact with septum 1*a*. Unlike hole 102*i* of the second prior art example described above, slot 2*d* is not penetrating through the radio wave reflecting portion to expose the waveguide space to the outside. In the present embodiment also, the space between septum 1*a* and radio wave reflecting portion 2, that is, the distance between septum 1*a* and the radio wave reflecting surface 2*a* of radio wave reflecting portion 2 should preferably be set, as a design value, from 0.2 mm to 0.3 mm as in Embodiment 1 above.

Further, in the present embodiment, as shown in FIG. 15, the bottom portion of slot 2*d* has such a shape that widens from the side of radio wave reflecting surface 2*a* to the substrate 3. More specifically, the bottom surface of slot 2*d* is a plane inclined from the direction vertical to the radio wave reflecting surface 2*a*. In the present embodiment, the angle of inclination is about 1.5 degrees. Further, as shown in FIG. 15, the space between bottom surfaces of opposing slots 2*d* is closest at the side of radio wave reflecting surface 2*a* and farthest on the side of the substrate 3.

Though not shown, as in Embodiment 2, the side portion of slot 2*d* may have such a shape that widens from the bottom portion to the opening. More specifically, three side surfaces of slot 2*d* may be formed as planes inclined by an angle of about 1.5 degrees, for example, from the direction vertical to the bottom surface of slot 2*d*. As to the shape of slot 2*d* having the side portion widening from the bottom portion to the opening, the cross sectional shape of slot 2*d* may be an elliptical arc as shown in FIG. 16. When the cross sectional shape of the end surface of septum 1*a* to be inserted to the slot 2*d* is also an elliptical arc, contact between septum 1*a* and radio wave reflecting portion 2 can easily be avoided.

When the bottom portion of slot 2*d* has such a shape that widens from the side of radio wave reflecting surface 2*a* to the side of substrate 3, similar to the example in which the side portion of the slot has such a shape that widens from the bottom portion to the opening, slot 2*d* can easily be formed by casting technique using, for example, aluminum die cast, without the necessity of using cutting process. As a result, the cost necessary for forming slot 2*d* can significantly be reduced.

In the present embodiment, such slots 2*d* are formed on the inner surface of the cylindrical portion of radio wave reflecting portion 2, and parts of septum 1*a* of waveguide 1 are inserted to slots 2*d*. Therefore, at the portion of slot 2*d*, the space between septum 1*a* and radio wave reflecting portion 2 is not continuous as in Embodiment 1 above but disconnected in a curved surface along the inner surface of the cylindrical portion of radio wave reflecting portion 2. In other words, the gap detours between waveguide space A and waveguide space B, because of slot 2*d* and septum 1*a* inserted thereto.

Therefore, leakage of the radio wave between waveguide spaces A and B can more effectively reduced as compared with Embodiment 1 above, and the polarized wave separating characteristic can be improved.

Except for these points, the embodiment is the same as Embodiment 1 above. Further, in the present embodiment, the structure at radio wave reflecting surface 2*a* as described in Embodiment 2 or 3 may be combined, so as to further improve the polarized wave separating characteristic.

Embodiment 5

Figure 17:
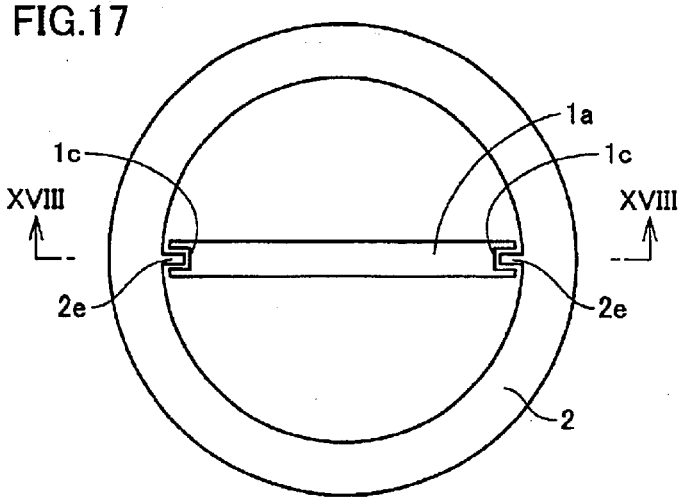
FIG. 17 is a cross section representing the polarized wave separating structure in accordance with Embodiment 5 of the present invention.
Figure 18:
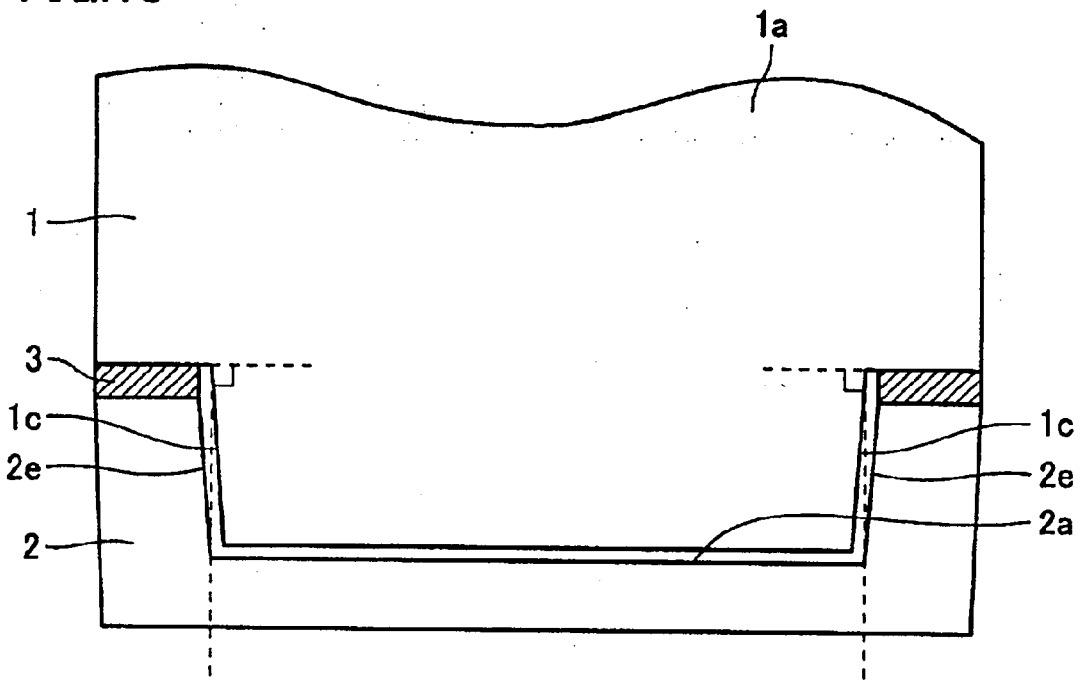
FIG. 18 is a partial cross section taken along the line XVIII—VXIII of FIG. 17.
Figure 19:
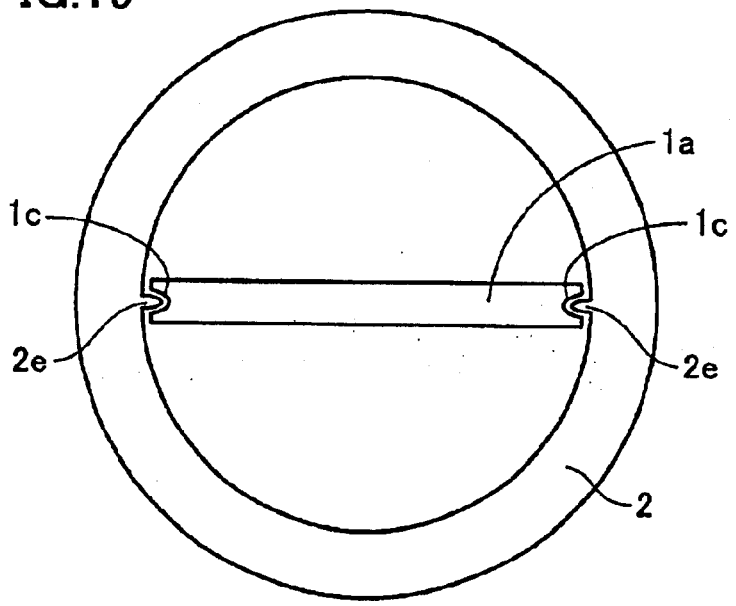
FIG. 19 is a cross section representing the polarized wave separating structure in accordance with Embodiment 5 of the present invention.

Referring to FIGS. 17 to 19, the polarized wave separating structure in accordance with Embodiment 5 of the present invention will be described.

FIG. 17 is a cross section representing a schematic structure of the polarized wave separating structure in accordance with the present embodiment viewed from the direction of entrance of the radio wave, FIG. 18 is a partial cross section taken along the line XVIII—XVIII of FIG. 17, and FIG. 19 is a cross section of the polarized wave separating structure viewed from the direction of entrance of the radio wave corresponding to FIG. 17.

Embodiment 5 differs from Embodiment 1 described above mainly in that two protruded portions 2*e* are provided at the inner surface of cylindrical portion of radio wave reflecting portion 2, and slots 1*c* are provided on opposing end surfaces of septum 1*a* of waveguide 1 such that protruded portions 2*e* are inserted thereto while radio wave reflecting portion 2 is not in contact with septum 1*a*.

In the present embodiment, protruded portions 2*e* are formed integrally with radio wave reflecting portion 2 and these can be formed as one piece by casting technique using, for example, aluminum die cast. In this embodiment also, the space between septum 1*a* and radio wave reflecting portion 2, that is, the distance between septum 1*a* and the inner surface of radio wave reflecting portion 2 should preferably be 0.2 mm to 0.3 mm as a design value, as in Embodiment 1 above.

Further, in the present embodiment, as shown in FIG. 18, the bottom portion of slot 1*c* has such a shape that widens from the side of radio wave reflecting surface 2*a* to the substrate 3. More specifically, the bottom surface of slot 1*c* is a plane inclined from the direction vertical to the radio wave reflecting surface 2*a*. In the present embodiment, the angle of inclination is about 1.5 degrees. Further, as shown in FIG. 18, the space between bottom surfaces of opposing slots 1*c* is closest at the side of radio wave reflecting surface 2*a* and farthest on the side of the substrate 3.

Though not shown, as in Embodiment 3, the side portion of slot 1*c* may have such a shape that widens from the bottom portion to the opening. More specifically, the side surface of slot 1*c* may be formed as a plane inclined by an angle of about 1.5 degrees, for example, from the direction vertical to the bottom surface of slot 1*c*. As to the shape of slot 1*c* having the side portion widening from the bottom portion to the opening, the cross sectional shape of slot 1*c* may be an elliptical arc as shown in FIG. 19. When the cross sectional shape of the protruded portion 2*e* to be inserted to the slot 1*c* is also an elliptical arc, contact between septum 1*a* and radio wave reflecting portion 2 can easily be avoided.

When the bottom portion of slot 1*c* has such a shape that widens from the side of radio wave reflecting surface 2*a* to the side of substrate 3, similar to the example in which the side portion of the slot has such a shape that widens from the bottom portion to the opening, slot 1*c* can easily be formed by casting technique using, for example, aluminum die cast, without the necessity of using cutting process. As a result, the cost necessary for forming slot 1*c* can significantly be reduced.

In the present embodiment, protruded portions 2*e* are formed on the inner surface of the cylindrical portion of radio wave reflecting portion 2, and slots 1*c* to which the protruded portions 2*e* are inserted are formed on end surfaces of septum portion 1*a*. Therefore, at the portion of slot 1*c*, the space between septum 1*a* and radio wave reflecting portion 2 is not continuous as in Embodiment 1 above but disconnected in a curved surface along the inner surface of the cylindrical portion of radio wave reflecting portion 2. In other words, the gap detours between waveguide space A and waveguide space B, because of slot 1*c* and the protruded portion 2*e* inserted thereto.

Therefore, leakage of the radio wave between waveguide spaces A and B can more effectively reduced as compared with Embodiment 1 above, and the polarized wave separating characteristic can be improved. Further, in Embodiment 4 described above, a slot 2*d* is formed on the inner surface of the cylindrical portion of radio wave reflecting portion 2 and a part of septum 1*a* is extended to be inserted to the slot 2*d*. Therefore, it becomes necessary to change the shape of opening 3*a* of substrate 3 accordingly. By contrast, in the present embodiment, protruded portions 2*e* are formed on the inner surface of the cylindrical portion of radio wave reflecting portion 2, and slots 1*c* are formed on septum 1*a* to which the protruded portions are inserted. Therefore, it is unnecessary to change the shape of opening 3*a* of substrate 3.

Except for these points, the embodiment is the same as Embodiment 1 above. Further, in the present embodiment, the structure at radio wave reflecting surface 2*a* as described in Embodiment 2 or 3 may be combined, so as to further improve the polarized wave separating characteristic.

As an example of such a combination, Embodiments 2 and 5 may be combined.

Embodiment 6

Figure 20:
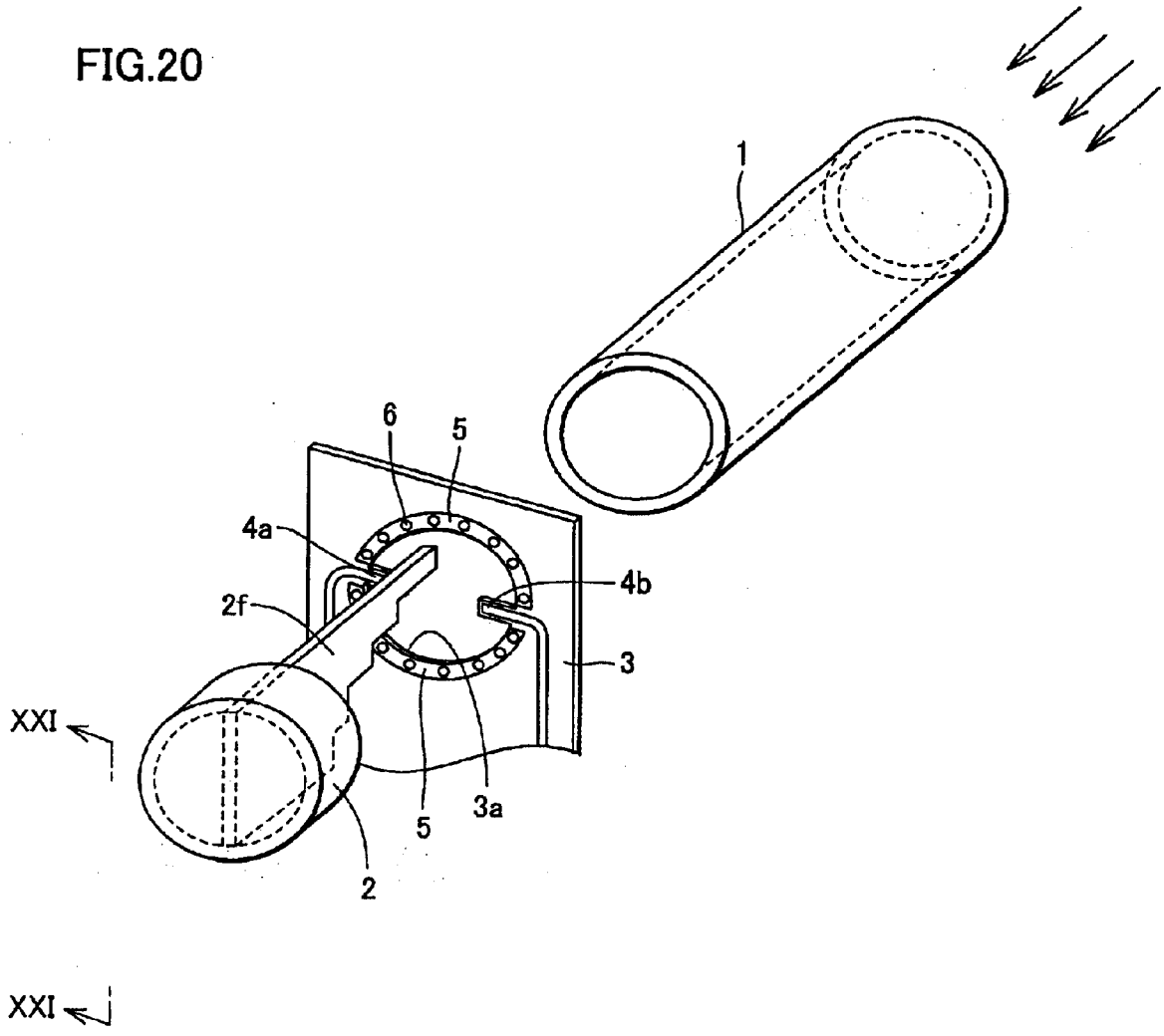
FIG. 20 is an exploded perspective view representing the polarized wave separating structure in accordance with Embodiment 6 of the present invention.
Figure 21:
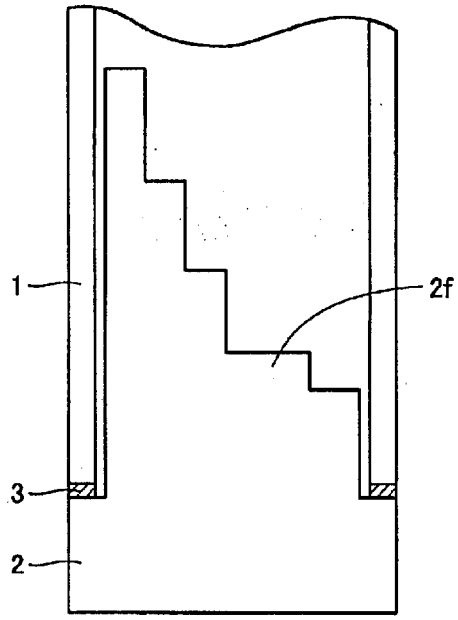
FIG. 21 is a partial cross section taken along the line XXI—XXI of FIG. 20.

Referring to FIGS. 20 and 21, the polarized wave separating structure in accordance with Embodiment 6 of the present invention will be described.

FIG. 20 is an exploded perspective view of the main portion representing the schematic structure of the present embodiment and FIG. 21 is a partial cross section taken along the line XXXI—XXI of FIG. 20.

The present embodiment differs from Embodiment 1 in that while the septum 1*a* is provided inside waveguide 1 in Embodiment 1, a septum 2*f* is provided inside radio wave reflecting portion 2. Septum 2*f* extends through opening 3*a* to the side of waveguide 1 so as to separate respective polarized waves received by the pair of radio wave receiving probes 4*a* and 4*b*. The space between septum 2*f* and waveguide 1 is set such that the end surface of waveguide 1 on the side of substrate 3 is surely in contact with the grounding surface provided on one surface of substrate 3 and the end surface of radio wave reflecting portion 2 on the side of substrate 3 is surely in contact with grounding surface 5 provided on the other surface of substrate 3. In the following, differences from Embodiment 1 will be described.

In the present embodiment, waveguide 1 does not have septum 1*a* formed therein unlike Embodiment 1 above, and the waveguide may be formed by a casting technique using, for example, aluminum die cast.

Radio wave reflecting portion 2 of the present embodiment differs from Embodiment 1 above in that it is provided with a septum (septum portion) 2*f* with a stepped portion provided therein, protruding from radio wave reflecting surface 2*a*. Septum 2*f* extends through opening 3*a* of substrate 3 to the side of waveguide 1. In the present embodiment, radio wave reflecting portion 2 and septum 2*f* are formed integrally, and these two can be formed as one piece by a casting technique using, for example, aluminum die cast.

In the present embodiment, a space between septum 2*f* and the inner surface (inside surface) of waveguide 1 is set such that the end surface of waveguide 1 on the side of substrate 3 is surely in contact with the grounding surface provided on one surface of substrate 3 and the end surface of radio wave reflecting portion 2 on the side of substrate 3 is surely in contact with grounding surface. 5 provided on the other surface of substrate 3, while septum 2*f* is not in contact with waveguide 1.

More specifically, in the present embodiment, a structure is provided in which the end surface of waveguide 1 on the side of the substrate 3 is in tight contact without any gap with and along the grounding surface provided on one surface of substrate 3 and the end surface of radio wave reflecting portion 2 on the side of substrate 3 is in tight contact without any gap with and along the grounding surface 5 provided on the other surface of substrate 3, thereby radio wave does not leak to the outside and any noise component does not enter from the outside, at the contact portion between the end surface of waveguide 1 on the side of substrate 3 and the grounding surface provided on one surface of substrate 3 and at the contact portion between the end surface of radio wave reflecting portion 2 on the side of substrate 3 and grounding surface 5 provided on the other surface of substrate 3.

In the present embodiment, septum 2*a* is provided not in contact with the inner surface of opening 3*a*, so that the end surface of waveguide 1 on the side of substrate 3 is surely in contact with the grounding surface provided on one surface of substrate 3 and the end surface of radio wave receiving portion 2 on the side of substrate 3 is surely in contact with grounding surface 5 provided on the other surface of substrate 3.

More specifically, as shown in FIG. 21, the end surface of septum 2*f* is not in contact with the inner surface (inside surface) of waveguide 1. Further, as shown in FIG. 21, the end surface of septum 2*f* is not in contact with the inner surface (inside surface) of opening 3*a* of substrate 3, either. Generally, such a radio wave receiving converter has the inside made airtight. Therefore, between septum 2*f* and waveguide 1 and between septum 2*f* and opening 3*a*, there is no separate member interposed, but gas, such as air, exists only.

By this embodiment also, similar to Embodiment 1 above, leakage of the radio wave to the outside of the waveguide space or increase of noise can be suppressed while fully satisfactory polarized wave separating characteristic is maintained. Further, unlike the second prior art example described above, a separate member for connecting the waveguide and the radio wave reflecting portion is unnecessary, and the structure is simple. Therefore, it is suitable for mass production and facilitates manufacture, and the ratio of satisfactory products of mass production can be improved.

In the present embodiment, similar to Embodiment 1, the space between septum 2*f* and waveguide 1, that is, the distance between septum 2*f* and the inner surface of waveguide 1 should preferable be set to 0.2 mm to 0.3 mm as a design value. Here, the space refers to the space between the end surface of septum 2*f* extending linearly from the position where the substrate 3 is arranged at the cross section of FIG. 21 and not the stepped portion of septum 2*f*, on the left side of FIG. 21, and the opposing inner surface of waveguide 1.

Embodiment 7

Figure 22A:
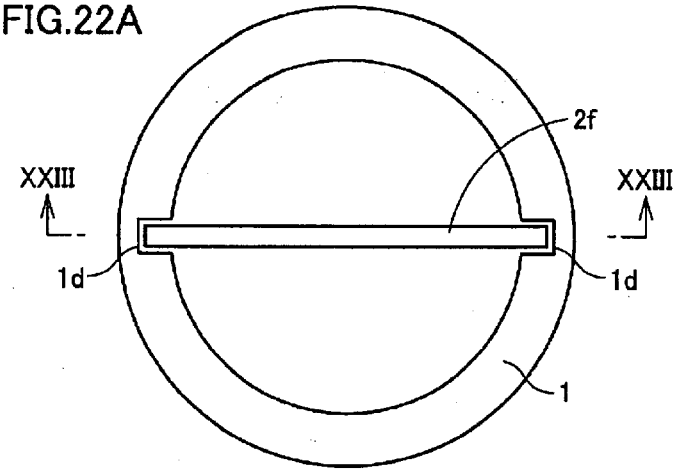
FIGS. 22A and 22B are cross sections representing the polarized wave separating structure in accordance with Embodiment 7 of the present invention.
Figure 22B:
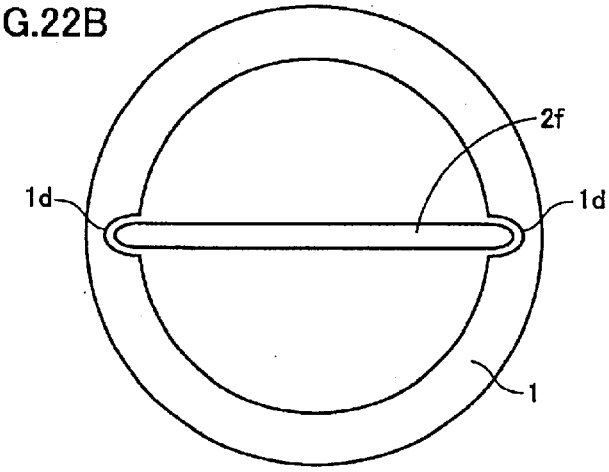
Figure 23:
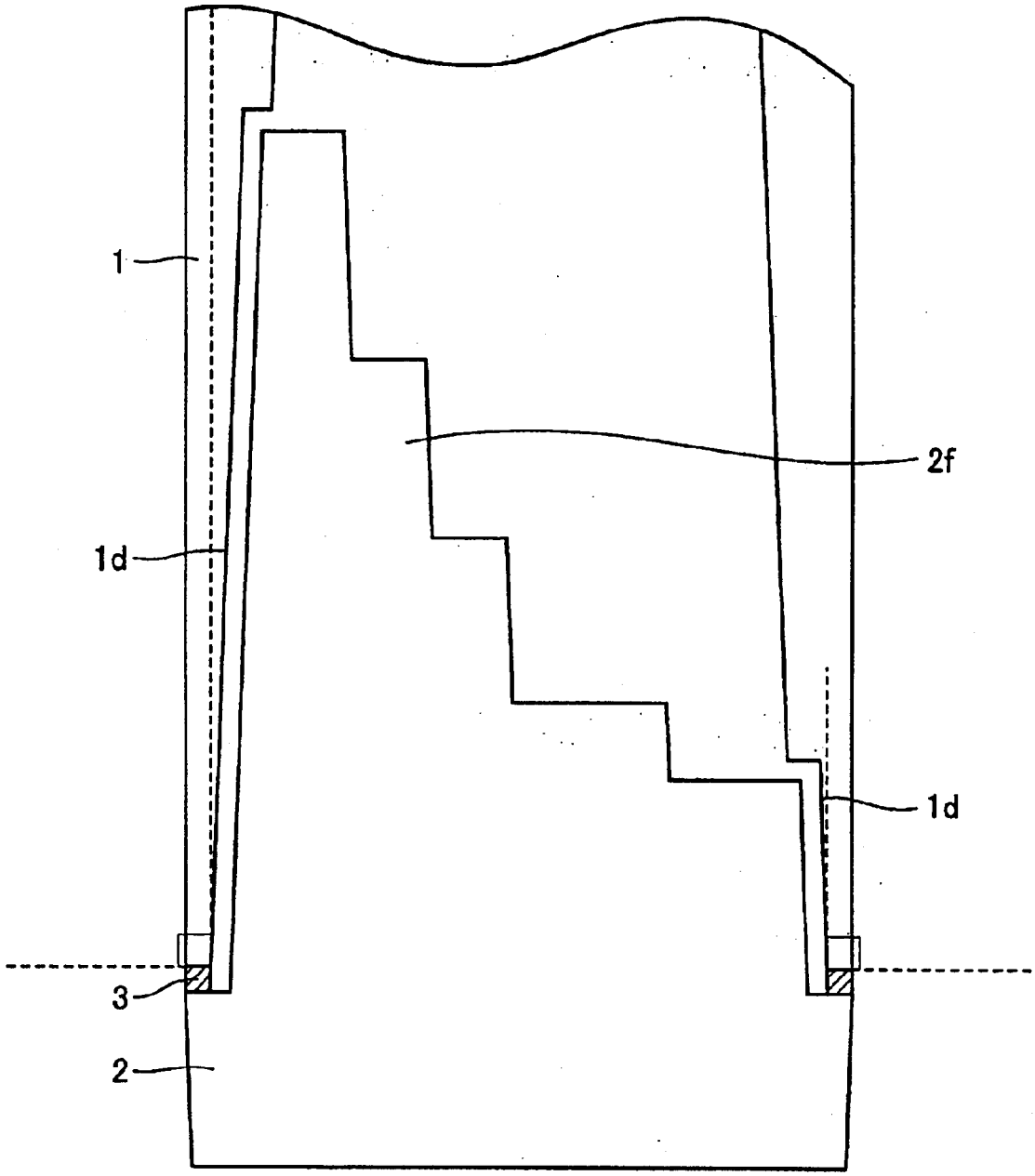
FIG. 23 is a partial cross section taken along the line XXIII—XXIII of FIG. 22A.

Referring to FIGS. 22A to 23, the polarized wave separating structure in accordance with Embodiment 7 of the present invention will be described.

FIGS. 22A and 22B are cross sections representing the schematic structure of the polarized wave separating structure in accordance with the present embodiment viewed from the direction of entrance of the radio wave, and FIG. 23 is a partial cross section taken along the line XXIII—XXIII of FIG. 22A.

Embodiment 7 differs from Embodiment 6 above mainly in that two slots 1*d* are provided on the inner surface of waveguide 1, and opposing end surface of septum 2*f* of radio wave reflecting portion 2 are extended to be inserted to slots 1*d*, while waveguide 1 and septum 2*f* are not in contact with each other. Slot 1*d* is not penetrating through the waveguide 1 to expose the waveguide space to the outside. In the present embodiment also, the space between septum 2*f* and waveguide 1, that is, the distance between septum 2*f* and the inner surface of waveguide 1 should preferably be set, as a design value, from 0.2 mm to 0.3 mm as in Embodiment 6 above.

Further, in the present embodiment, as shown in FIG. 23, the bottom portion of slot 1*d* has such a shape that widens from the radio wave entrance side to the substrate 3. More specifically, the bottom surface of slot 1*d* is a plane inclined from the direction vertical to the substrate surface of substrate 3. In the present embodiment, the angle of inclination is about 1.5 degrees. Further, as shown in FIG. 23, the space between bottom surfaces of opposing slots 1*d* is closest at the radio wave entrance side and farthest on the side of the substrate 3.

Though not shown, as in Embodiment 2, the side portion of slot 1*d* may have such a shape that widens from the bottom portion to the opening. More specifically, side surfaces of slot 1*d* may be formed as planes inclined by an angle of about 1.5 degrees, for example, from the direction vertical to the bottom surface of slot 1*d*. As to the shape of slot 1*d* having the side portion widening from the bottom portion to the opening, the cross sectional shape of slot 1*d* may be an elliptical arc as shown in FIG. 22B. When the shape of the end surface of septum 2*f* to be inserted to the slot 1*d* is also an elliptical arc, contact between septum 2*f* and waveguide 1 can easily be avoided.

When the bottom portion of slot 1*d* has such a shape that widens from the radio wave entrance side to the side of substrate 3, similar to the example in which the side portion of the slot has such a shape that widens from the bottom portion to the opening, slot 1*d* can easily be formed by casting technique using, for example, aluminum die cast, without the necessity of using cutting process. As a result, the cost necessary for forming slot 1*d* can significantly be reduced.

In the present embodiment, such slots 1*d* are formed on the inner surface of the waveguide 1, and parts of septum 2*f* of radio wave reflecting portion 2 are inserted to slots 1*d*. Therefore, at the portion of slot id, the space between septum 2*f* and waveguide 1 is not continuous as in Embodiment 6 above but disconnected in a curved surface along the inner surface of the waveguide 1. In other words, the gap detours between waveguide space A and waveguide space B, because of slot 1*d* and septum 2*f* inserted thereto.

Therefore, leakage of the radio wave between waveguide spaces A and B can more effectively reduced as compared with Embodiment 6 above, and the polarized wave separating characteristic can be improved.

Except for these points, the embodiment is the same as Embodiment 6 above.

Embodiment 8

Figure 24A:
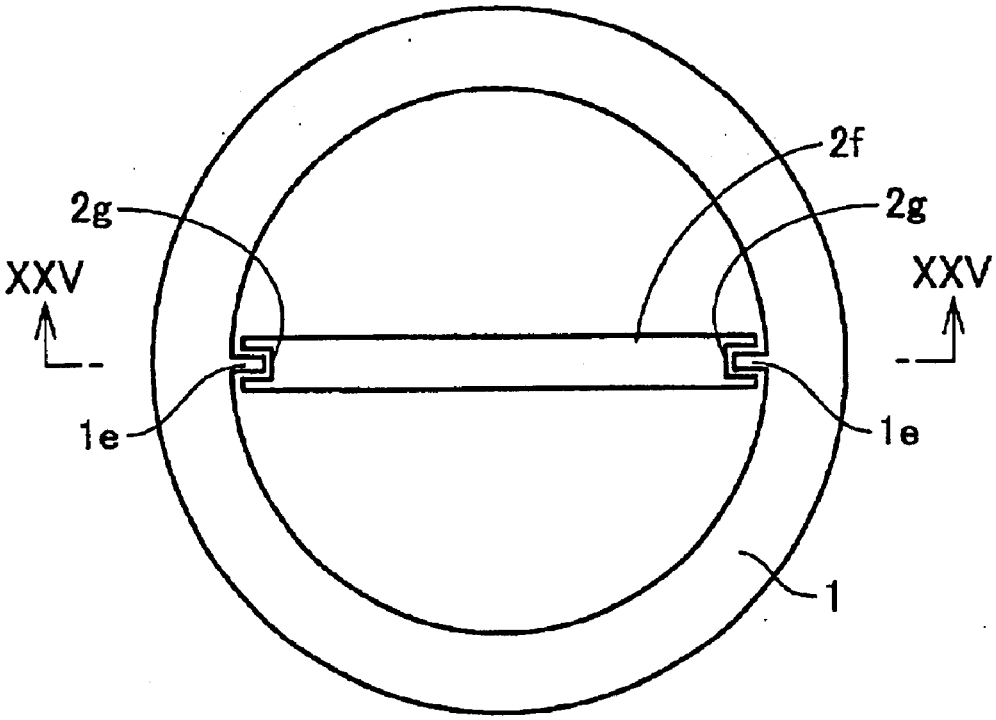
FIGS. 24A and 24B are cross sections representing the polarized wave separating structure in accordance with Embodiment 8 of the present invention.
Figure 24B:
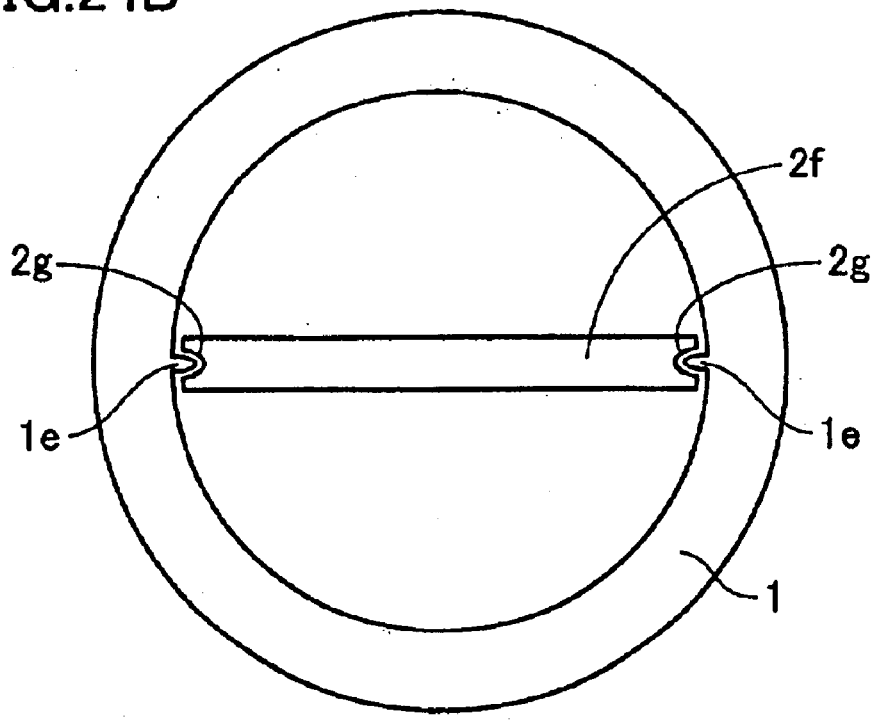
Figure 25:
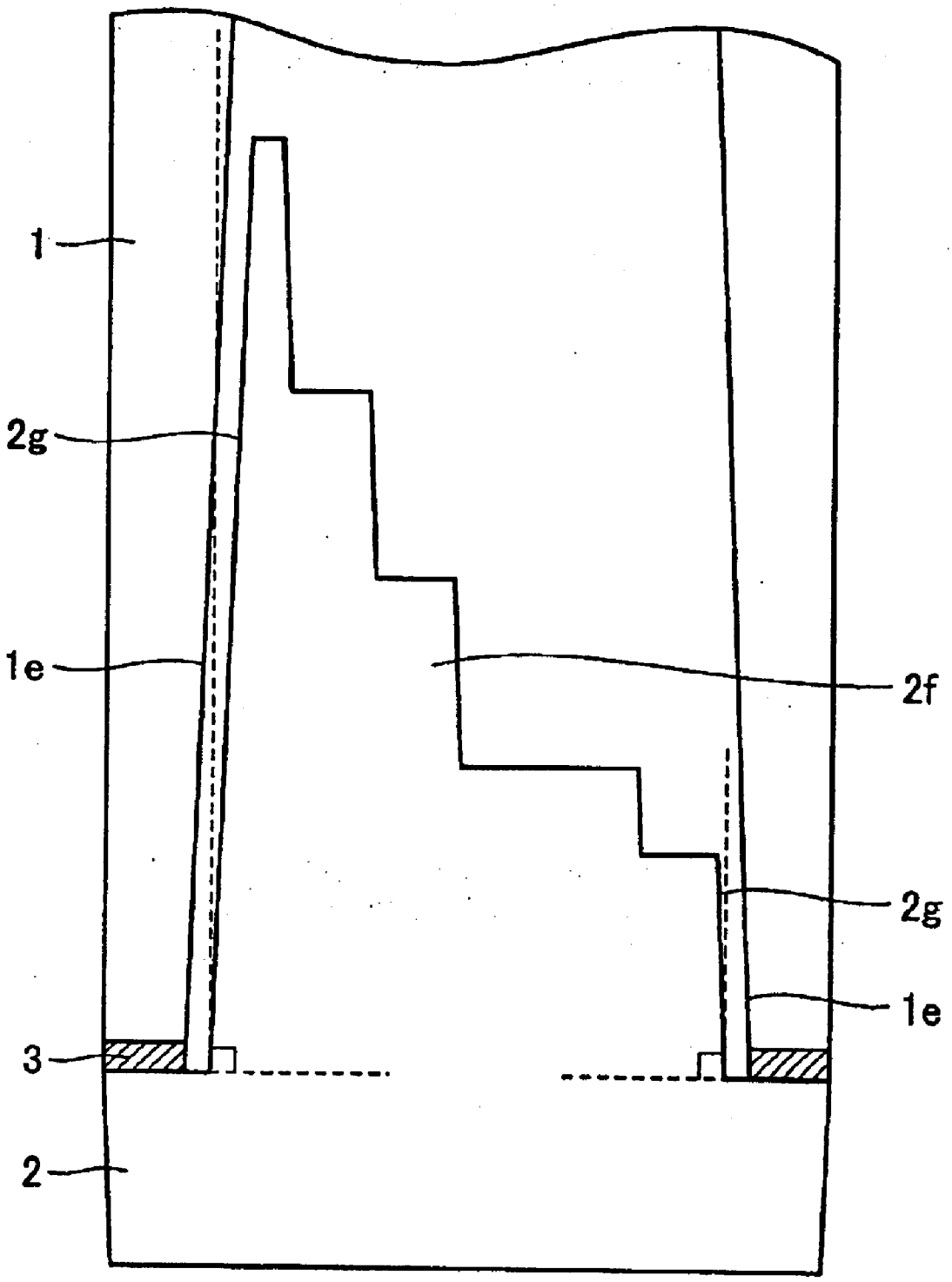
FIG. 25 is a partial cross section taken along the line XXV—XXV of FIG. 24A.

Referring to FIGS. 24A to 25, the polarized wave separating structure in accordance with Embodiment 8 of the present invention will be described.

FIGS. 24A and 24B are cross sections representing schematic structure of the polarized wave separating structure in accordance with the present embodiment, viewed from the direction of entrance of the radio wave, and FIG. 25 is a partial cross section taken along the line XXXV—XXXV of FIG. 24A.

Embodiment 8 differs from Embodiment 6 described above mainly in that two protruded portions 1e are provided on the inner surface of waveguide 1, and slots 2*g* are provided on opposing end surfaces of septum 2*f* of radio wave reflecting portion 2 to which the protruded portions 1*e* are inserted, while waveguide 1 and septum 2*f* are not in contact with each other.

In the present embodiment, protruded portions 1*e* are formed integrally with waveguide 1 and these can be formed as one piece by casting technique using, for example, aluminum die cast. In this embodiment also, the space between septum 2*f* and waveguide 1, that is, the distance between septum 2*f* and the inner surface of waveguide 1 should preferably be 0.2 mm to 0.3 mm as a design value, as in Embodiment 6 above.

Further, in the present embodiment, as shown in FIG. 25, the bottom portion of slot 2*g* has such a shape that widens from the radio wave entrance side to the substrate 3. More specifically, the bottom surface of slot 2*g* is a plane inclined from the direction vertical to the substrate surface of substrate 3. In the present embodiment, the angle of inclination is about 1.5 degrees. Further, as shown in FIG. 25, the space between bottom surfaces of opposing slots 2*g* is closest at the radio wave entrance side and farthest on the side of the substrate 3.

Though not shown, as in Embodiment 3, the side portion of slot 2*g* may have such a shape that widens from the bottom portion to the opening. More specifically, side surfaces of slot 2*g* may be formed as planes inclined by an angle of about 1.5 degrees, for example, from the direction vertical to the bottom surface of slot 2*g*. As to the shape of slot 2*g* having the side portion widening from the bottom portion to the opening, the cross sectional shape of slot 2*g* may be an elliptical arc as shown in FIG. 24B. When the cross sectional shape of the protruded portion 1*e* to be inserted to the slot 2*g* is also an elliptical arc, contact between septum 2*f* and waveguide 1can easily be avoided.

When the bottom portion of slot 2*g* has such a shape that widens from the radio wave entrance side to the side of substrate 3, similar to the example in which the side portion of the slot has such a shape that widens from the bottom portion to the opening, slot 2*g* can easily be formed by casting technique using, for example, aluminum die cast, without the necessity of using cutting process. As a result, the cost necessary for forming slot 2*g* can significantly be reduced.

In this manner, in the present embodiment, protruded portions 1e are formed on the inner surface of waveguide 1, and slots 2*g*, to which the protruded portions 1e are inserted, are formed on end surfaces of septum portion 2*f*. Therefore, at the portion of slot 2*g*, the space between septum 2*f* and waveguide 1 is not continuous as in Embodiment 6 above but disconnected in a curved surface along the inner surface of the waveguide 1. In other words, the gap detours between waveguide space A and waveguide space B, because of slot 2*g* and the protruded portion 1*e* inserted thereto.

Therefore, leakage of the radio wave between waveguide spaces A and B can more effectively reduced as compared with Embodiment 6 above, and the polarized wave separating characteristic can be improved.

Except for these points, the embodiment is the same as Embodiment 6 described above.

Embodiment 9

Figure 26:
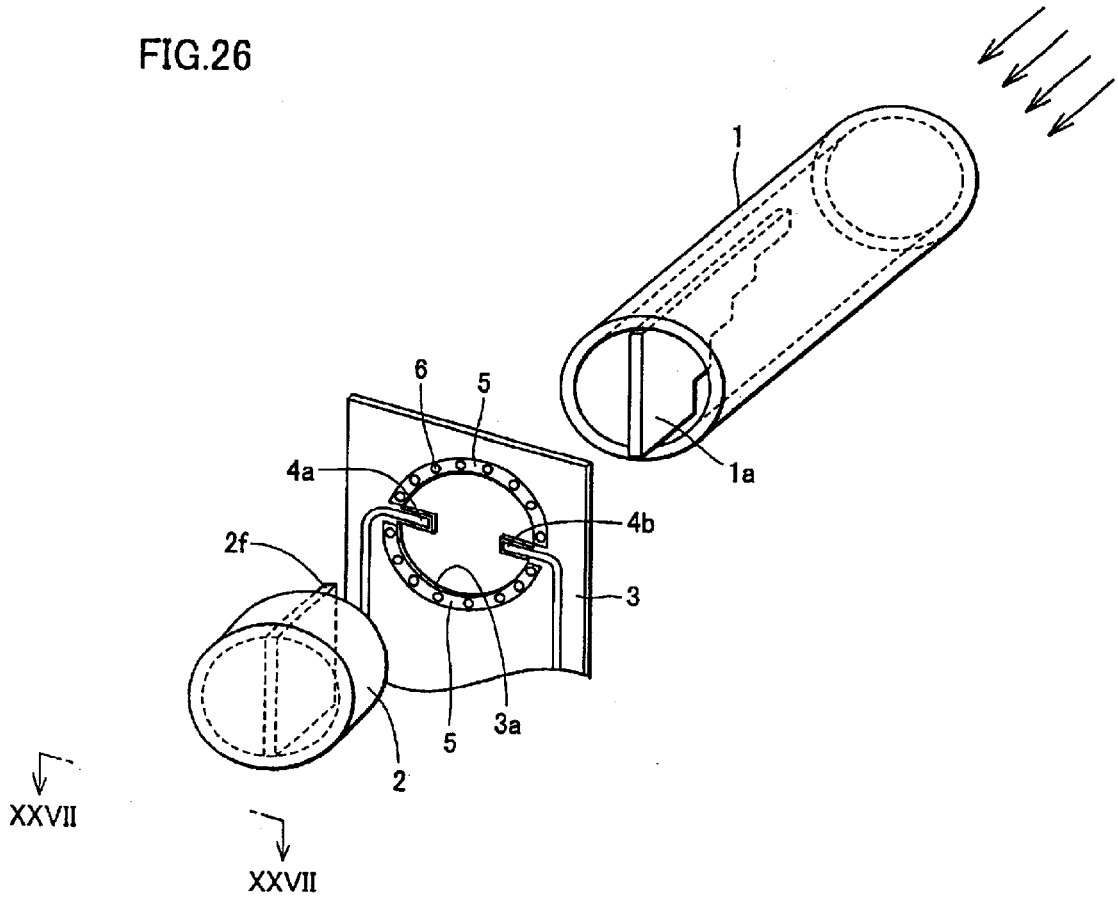
FIG. 26 is an exploded perspective view representing the polarized wave separating structure in accordance with Embodiment 9 of the present invention.
Figure 27:
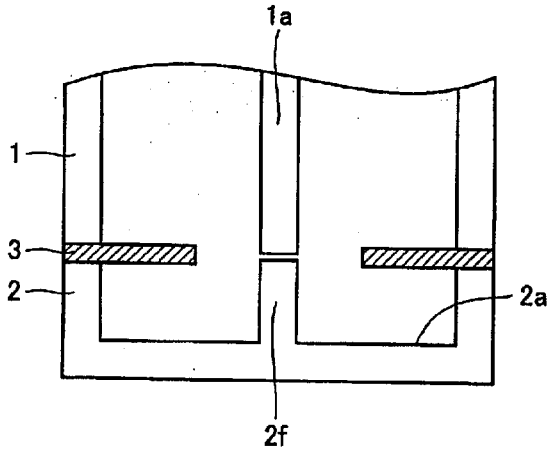
FIG. 27 is a partial cross section taken along the line XXVII—XXVII of FIG. 26.

Referring to FIGS. 26 and 27, the polarized wave separating structure in accordance with Embodiment 9 of the present invention will be described.

FIG. 26 is an exploded perspective view of the main portion representing a schematic structure of the present embodiment, and FIG. 27 is a partial cross section taken along the line XXXVII—XXXVII of FIG. 26.

In contrast to Embodiment 1 in which septum 1*a* is provided only in waveguide 1 and Embodiment 6 in which septum 2*f* is provided only in radio wave reflecting portion 2, in the present embodiment, septum 1*a* is provided in waveguide 1, and septum 2*f* is provided in radio wave reflecting portion 2. The two septums 1*a* and 2*f* are arranged opposed to each other to separate respective polarized waves received by the pair of radio wave receiving portions 4*a* and 4*b*. The space between the septums 1*a* and 2*f* is set such that the end surface of waveguide 1 on the side of substrate 3 is surely in contact with the grounding surface provided on one surface of substrate 3 and the end surface of radio wave reflecting portion 2 on the side of substrate 3 is surely in contact with the grounding surface 5 provided on the other surface of substrate 3. In the following, differences from Embodiment 1 will be described.

In waveguide 1 of the present embodiment, septum 1*a* with a stepped portion is formed inside, which is not so much extended as compared with the one of Embodiment 1. In the present embodiment, waveguide 1 and septum 1*a* are formed integrally as in Embodiment 1, and these can be formed as one piece by a casting technique using, for example, aluminum die cast.

The radio wave reflecting portion 2 of the present embodiment has a septum 2*f* formed therein, protruding from the radio wave reflecting surface. However, the septum is not so much extended as compared with the one of Embodiment 6 described above, and septum 2*f* is not provided with the stepped portion. In the present embodiment, as in Embodiment 6, radio wave reflecting portion 2 and septum 2*f* are formed integrally, and these can be formed as one piece by a casting technique using, for example, aluminum die cast.

In the present embodiment, referring to FIG. 27, the end surface of septum 1*a* is arranged opposed to the end surface of septum 2*f*, near the opening 3*a* of substrate 3. Further, a space between septums 1*a* and 2*f* is set such that the end surface of waveguide 1 on the side of substrate 3 is surely in contact with the grounding surface provided on one surface of substrate 3 and the end surface of radio wave reflecting portion 2 on the side of substrate 3 is surely in contact with grounding surface 5 provided on the other surface of substrate 3, while septums 1*a* and 2*f* are not in contact with each other.

More specifically, in the present embodiment, a structure is provided in which the end surface of waveguide 1 on the side of the substrate 3 is in tight contact without any gap with and along the grounding surface provided on one surface of substrate 3 and the end surface of radio wave reflecting portion 2 on the side of substrate 3 is in tight contact without any gap with and along the grounding surface 5 provided on the other surface of substrate 3, thereby radio wave does not leak to the outside and any noise component does not enter from the outside, at the contact portion between the end surface of waveguide 1 on the side of substrate 3 and the grounding surface provided on one surface of substrate 3 and at the contact portion between the end surface of radio wave reflecting portion 2 on the side of substrate 3 and grounding surface 5 provided on the other surface of substrate 3.

In the present embodiment, septums 1*a* and 2*f* are provided not in contact with the inner surface of opening 3*a*, so that the end surface of waveguide 1 on the side of substrate 3 is surely in contact with the grounding surface provided on one surface of substrate 3 and the end surface of radio wave receiving portion 2 on the side of substrate 3 is surely in contact with grounding surface 5 provided on the other surface of substrate 3.

More specifically, referring to FIG. 27, the end surface of septum 1*a* and the end surface of septum 2*f* opposing to each other do not contact with each other. Further, end surfaces of septums 1*a* and 2*f* are not in contact with the inner surface (inside surface) of the opening 3*a* of substrate 3. Generally, such a radio wave receiving converter has the inside made airtight. Therefore, between septums 1*a* and 2*f* and between septum 1*a* or 2*f* and opening 3*a*, there is no separate member interposed, but gas, such as air, exists only.

By this embodiment also, similar to Embodiments 1 and 6 above, leakage of the radio wave to the outside of the waveguide space or increase of noise can be suppressed while fully satisfactory polarized wave separating characteristic is maintained. Further, unlike the second prior art example described above, a separate member for connecting the waveguide and the radio wave reflecting portion is unnecessary, and the structure is simple. Therefore, it is suitable for mass production and facilitates manufacture, and the ratio of satisfactory products of mass production can be improved.

Further, the present invention has such a structure that both septums 1*a* and 2*f* do not penetrate through opening 3*a* of substrate 3, as shown in FIG. 27, and septums 1*a* and 2*f* are extended to the position of the end surfaces on the side of substrate 3 of the cylindrical portions of waveguide 1 and radio wave reflecting portion 2, respectively. In this respect, in Embodiment 1 described above, there is a gap between septum 1*a* and the inner surface of cylindrical portion of radio wave reflecting portion 2 as shown in FIG. 4, and in Embodiment 6, there is a gap between septum 2*f* and the inner surface of the cylindrical portion of waveguide 1 as shown in FIG. 21. Therefore, in the structure of the present embodiment, there is no gap formed between the septum and the inner surface of the cylindrical portion of the waveguide 1 or the inner surface of the cylindrical portion of radio wave reflecting portion 2 as in Embodiment 1 or 6 above, and hence the polarized wave separating characteristic can further be improved.

In the present embodiment, similar to Embodiments 1 and 6 described above, the space between septums 1*a* and 2*f*, that is, the distance between opposing end surfaces of septums 1*a* and 2*f* should preferably be 0.2 mm to 0.3 mm as a design value.

Embodiment 10

Figure 28A:
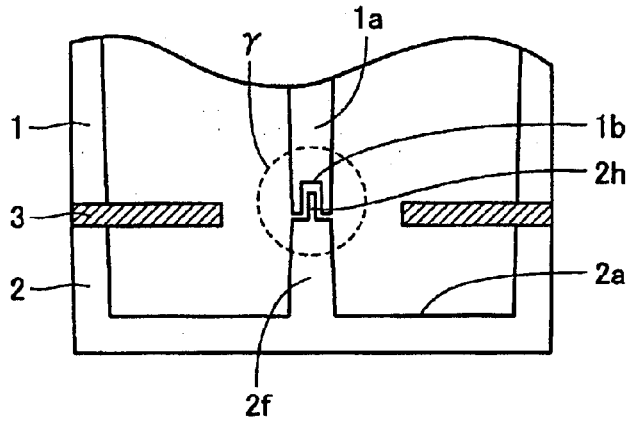
Figure 28B:
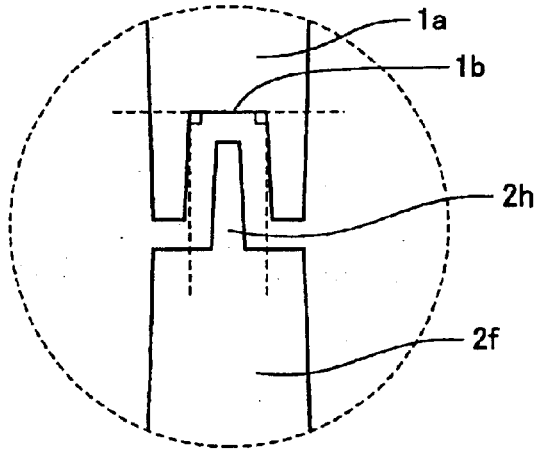
Figure 28C:
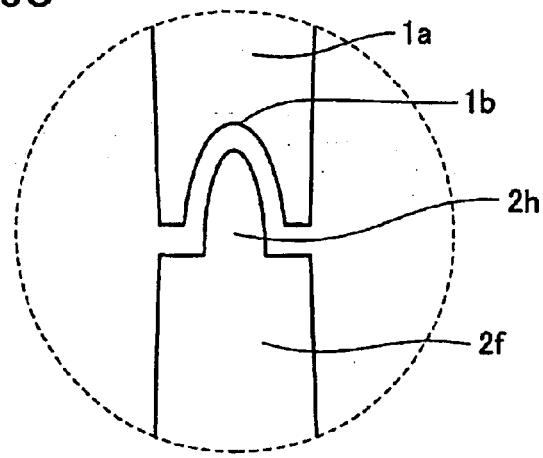

Referring to FIGS. 28A to 28C, the polarized wave separating structure in accordance with Embodiment 10 of the present invention will be described.

FIG. 28A is a partial vertical section representing a schematic structure of the polarized wave separating structure of the present embodiment that corresponds to FIG. 27, and FIGS. 28B and 28C are partial enlarged cross sections of the region γ of FIG. 28A.

Embodiment 10 differs from Embodiment 9 described above mainly in that a protruded portion 2*h* is provided at an end surface of septum 2*f* of radio wave reflecting portion 2, and a slot 1*b* is formed on the end surface of septum 1*a* of waveguide 1, to which the protruded portion 2*h* is inserted, while septums 2*f* and 1*a* are not in contact with each other.

In the present embodiment, protruded portion 2*h* is formed, together with septum 2*f*, integrally with radio wave reflecting portion 2 and these can be formed as one piece by casting technique using, for example, aluminum die cast. In this embodiment also, the space between septums 1*a* and 2*f*, that is, the distance between opposing surfaces of septums 1*a* and 2*f* should preferably be 0.2 mm to 0.3 mm as a design value, as in Embodiment 9 above.

Further, in the present embodiment, the side portion of slot 1*b* has such a shape that widens from the bottom portion to the opening as shown in FIG. 28B. More specifically, the side surface of slot 1*b* is a plane inclined from the direction vertical to the bottom surface of slot 1*b*. In the embodiment, the angle of inclination is set to about 1.5 degrees. Further, the space between opposing side surfaces of slot 1*b* is the closest on the side of the bottom surface of slot 1*b* and farthest on the side of radio wave reflecting surface 2*a*.

As to the shape of slot 1*b* with the side portion widening from the bottom portion to the opening, slot 1*b* may have a cross sectional shape of elliptical arc, as shown in FIG. 28C. Here, when the end surface of protruded portion 2*h* to be inserted to slot 1*b* also has a cross sectional shape of an elliptical arc, contact between septums 1*a* and 2*f* can more easily be avoided.

As the side portion of slot 1*b* has such a shape that widens from the bottom surface to the opening, slot 1*b* can easily be formed by casting technique using aluminum die cast, for example, without the necessity of cutting process. As a result, the cost necessary for forming slot 1*b* can significantly be reduced.

Here, a protruded portion may be provided on the end surface of septum 1*a* of waveguide 1, a slot may be formed on the end surface of septum 2*f* of radio wave reflecting portion 2 to which the protruded portion is inserted, and the side portion of the slot may have a shape that widens from the bottom portion to the opening.

In the present embodiment, a protruded portion is formed on one of the opposing end surfaces of septum 1*a* of waveguide 1 and septum 2*f* of radio wave reflecting portion 2, and a slot for inserting the protruded portion is formed on the other end surface. Therefore, at the portion of the slot, the space between septums 1*a* and 2*f* is not continuous as in Embodiment 9 above but disconnected in the same plane that is approximately vertical to the direction of progress of the radio wave in the waveguide space. In other words, the gap detours between waveguide space A and waveguide space B, because of the slot and the protruded portion inserted thereto.

Therefore, leakage of the radio wave between waveguide spaces A and B can more effectively reduced as compared with Embodiment 9 above, and the polarized wave separating characteristic can be improved.

Except for these points, the present embodiment is the same as Embodiment 9 described above.

Embodiment 11

Figure 29:
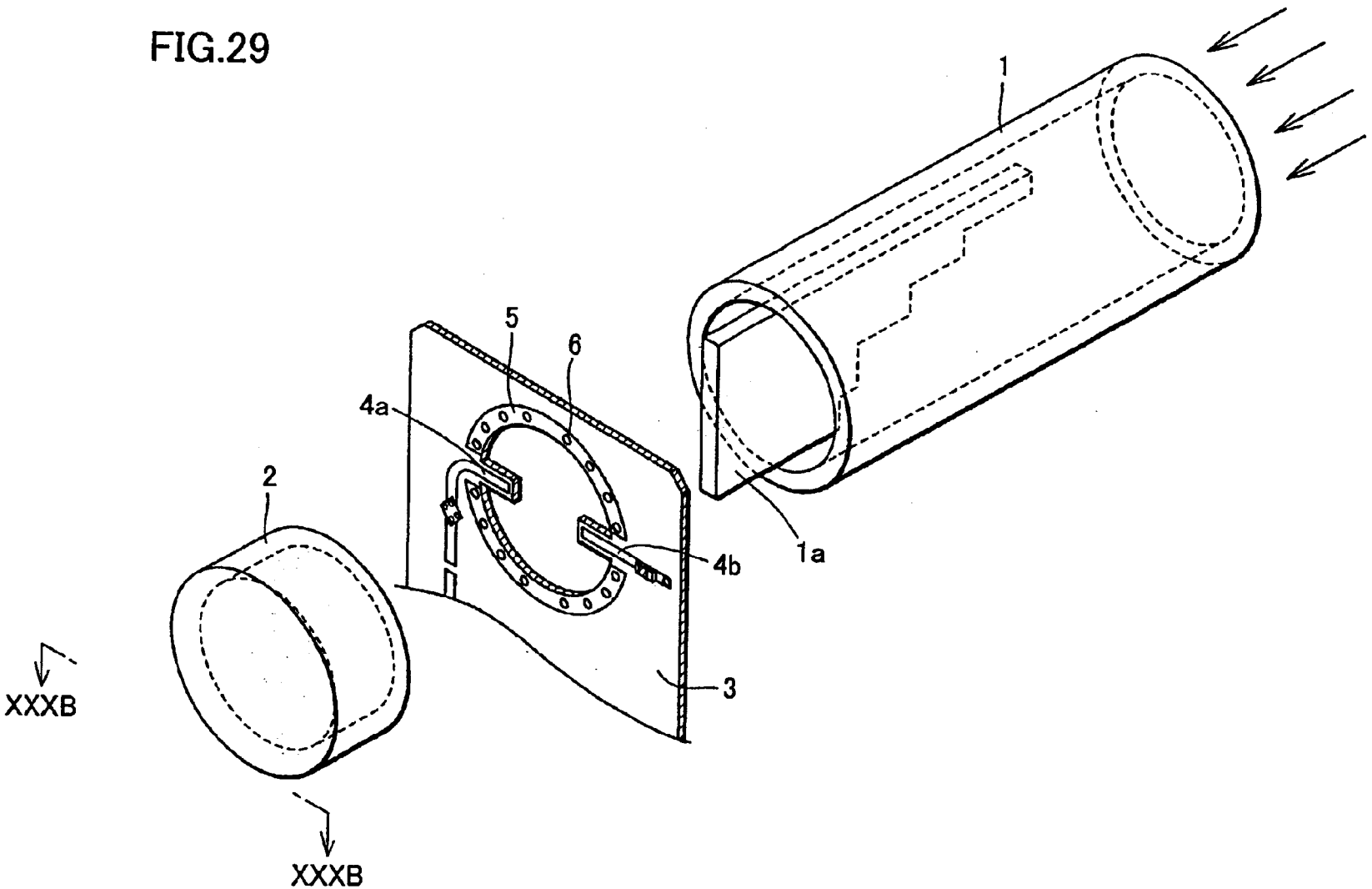
FIG. 29 is an exploded perspective view of a main portion representing a schematic structure of Embodiment 11.
Figure 30A:
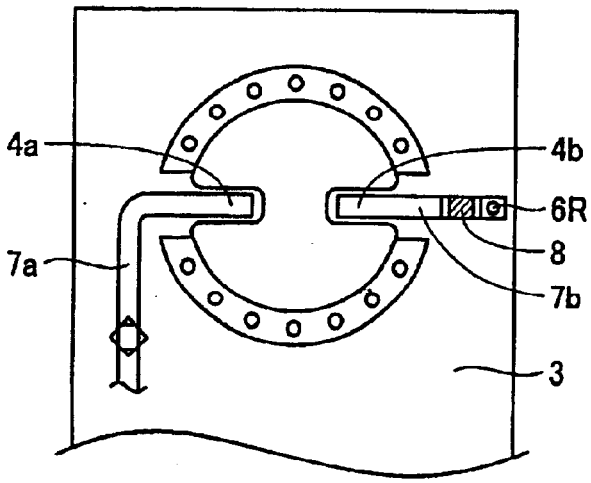
FIG. 30A is a top view of a substrate.
Figure 30B:
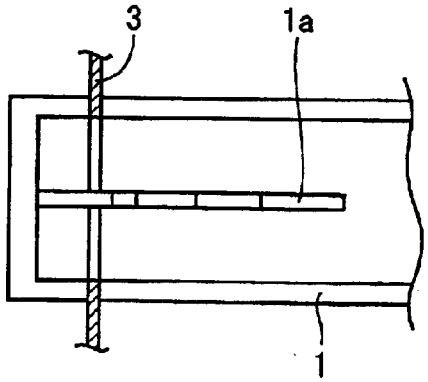
FIG. 30B is a cross section taken along the line XXXB—XXXB of FIG. 29.

Referring to FIGS. 29 and 30B, the polarized wave separating structure in accordance with Embodiment 11 will be described.

In the embodiments above, the radio wave receiving probe 4*b* must be terminated with a terminating resistance, in order to attenuate polarized wave that is not to be received by radio wave receiving probe 4*b*. For this purpose, a terminating resistance is used. A general terminating resistance, however, cannot sufficiently attenuate the polarized wave that is not to be received. Therefore, an expensive resistance with frequency characteristic compensated for microwave becomes necessary, resulting in higher cost.

Further, the polarized wave that is not to be received is once to receive by radio wave receiving probe 4*b* and guided to substrate 3. Therefore, when there is a mismatching at the terminating circuit for attenuation, the polarized wave goes over substrate 3 as a reflected wave and when this reflected wave happens to reach the probe 4*a* of the receiving side, the polarized wave that should not be received would be received, resulting in lower degree of discrimination (lower degree of cross polarization discrimination). An embodiment to solve this problem will be described in the following.

FIG. 29 is an exploded perspective view of a main portion representing a schematic structure of the present embodiment, FIG. 30A is a top view of the substrate, and FIG. 30B is a cross section taken along the line XXXB—XXXB of FIG. 29.

In FIG. 29, the polarized wave separating structure is the same as that of FIG. 2, and a reflection free terminating portion is formed for absorbing received polarized wave, on one of the pair of radio wave receiving portions 4*a*, 4*b* formed on substrate 3. Namely, referring to FIG. 30A, a resistor 8 for termination is arranged on the side of microstrip line 7*b* on the end of the substrate, from radio wave receiving probe 4*b*, and the other end of resistor 8 is connected to the grounding surface on the opposite side of substrate 3, via through hole 6R.

The d-polarized wave introduced to waveguide 1 is converted to a linearly polarized wave by the stepped septum 1*a* in waveguide 1, received by radio wave receiving probe 4*a*, transmitted to the converter circuit of the succeeding stage to be amplified with low noise, further converted to an intermediate frequency, and output to a BS receiver, for example.

The l-polarized wave is converted to a linearly polarized wave by the stepped septum 1*a*, received by radio wave receiving probe 4*b*, passed through microstrip line 7*b*, transmitted through resistor 8 and through hole 6R to the reflection free terminating circuit that is grounded, and is attenuated. Thus, unnecessary polarized wave can be absorbed, and degradation of discrimination can be avoided. Further, as the resistor 8 can be arranged near the radio wave receiving probe 4*b*, an expensive resistance with the frequency characteristic compensated for microwave is unnecessary, and matching can be attained by a general resistor. Thus, unnecessary polarized wave can sufficiently be attenuated while not increasing the cost.

Embodiment 12

Figure 31:
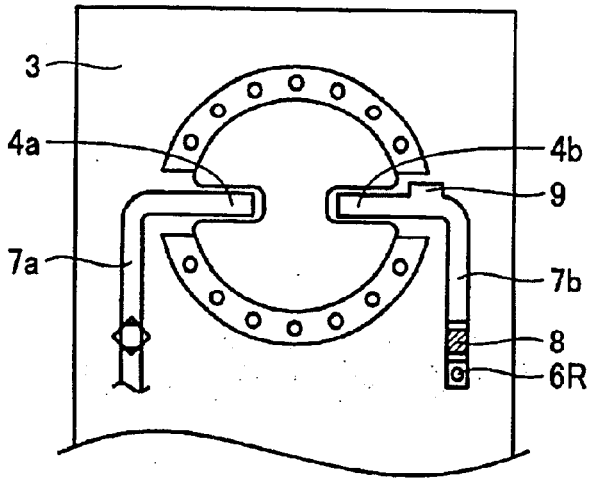
FIG. 31 is a top view of the substrate of the polarized wave separator in accordance with Embodiment 12.

Referring to FIG. 31, the polarized wave separating structure in accordance with Embodiment 12 of the present invention will be described.

FIG. 31 is a top view of the substrate of the polarized wave separator. Referring to FIG. 31, the polarized wave separating structure is the same as that of the embodiments described above, except that a stub matching portion 9 is provided on microstrip line 7*b* of substrate 3, and that the microstrip line 7*b* is bent downward at about 90°. As stub matching portion 9 realizes satisfactory adjustment of impedance matching with the reflection free terminating circuit of the succeeding stage, generation of the reflected wave can be suppressed. Further, even when the resistor 8 is an inexpensive general resistor 8, matching can be attained by stub matching portion 9. Therefore, the cost can be reduced.

Embodiment 13

Figure 32A:
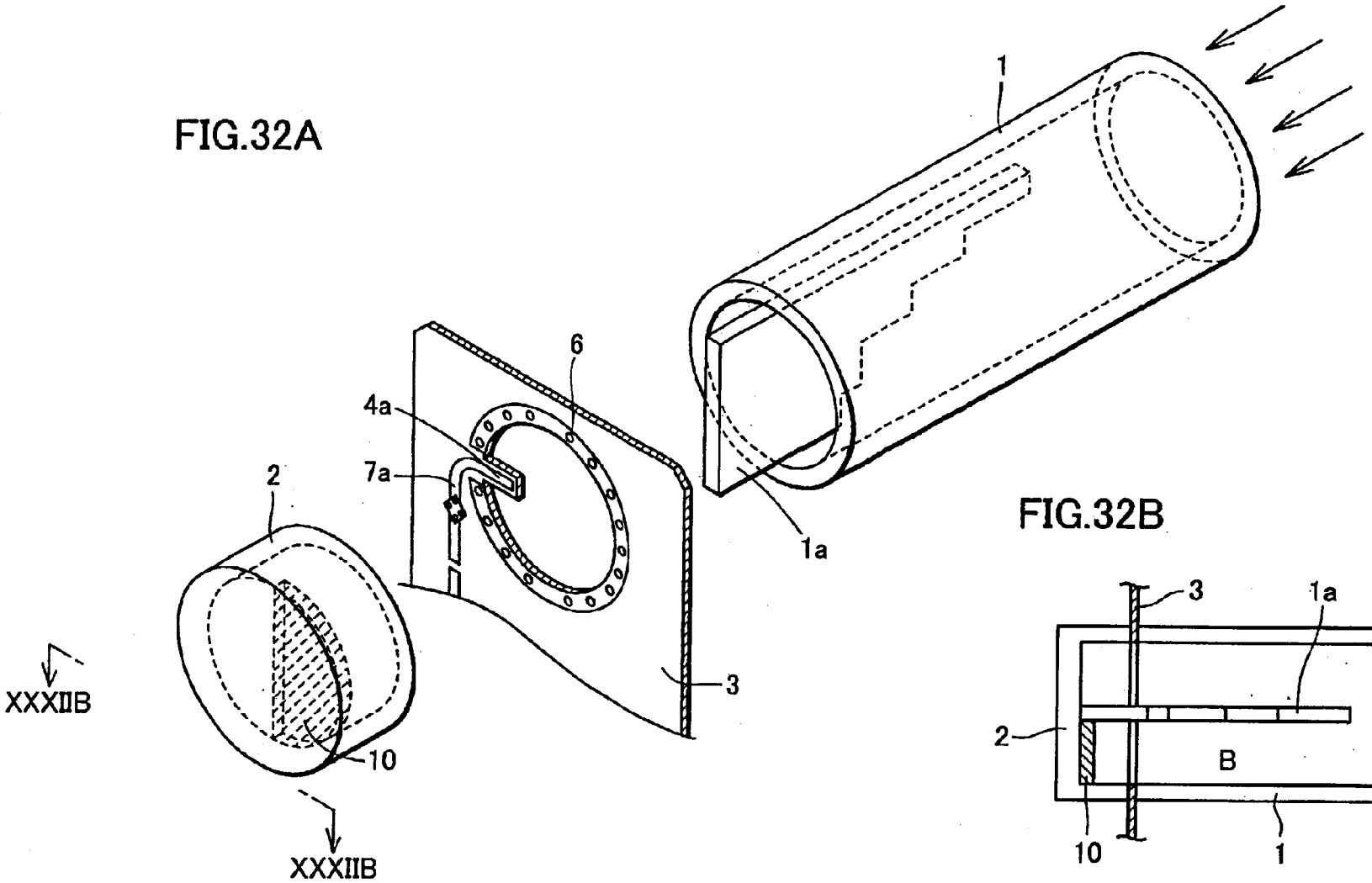
FIG. 32A is an exploded perspective view of a main portion representing the polarized wave separating structure in accordance with Embodiment 13 of the present invention.
Figure 32B:
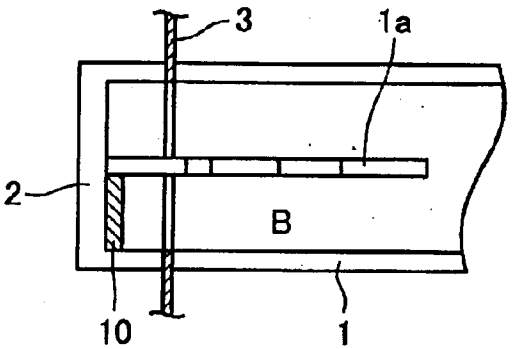
FIG. 32B is a cross section taken along the line XXXIIB—XXXIIB of FIG. 32A.

FIG. 32A is an exploded perspective view of a main portion representing the polarized wave separating structure in accordance with Embodiment 13 of the present invention, and FIG. 32 is a cross section taken along the line XXXIIB—XXXIIB of FIG. 32A.

Referring to FIG. 32A, the basic structure of the polarized wave separating structure is the same as that of FIG. 2. The radio wave receiving probe 4*b*, however, is omitted, and on the reflecting surface on the side of waveguide space B inside the radio wave reflection portion 2, a reflection free terminating portion 10 such as a radio wave absorber is provided. As reflection free terminating portion 10, one prepared by mixing magnetic powder such as ferrite in rubber based material such as silicone rubber, to provide the radio wave absorbing function, may be used.

Operation is as follows. The l-polarized wave is converted to the linearly polarized wave by the stepped septum 1*a* and guided to waveguide space B. The wave, however, is not received, as there is no radio wave receiving probe 4*b*, but introduced to radio wave reflecting portion 2. Here, reflection free terminating portion 10 is provided at radio wave reflecting portion 2. Therefore, the l-polarized wave that has been converted to linearly polarized wave is attenuated here. Therefore, leakage of the l-polarized wave component to the substrate 3, or the wave going over as the reflected wave can be suppressed.

Embodiment 14

Figure 33:
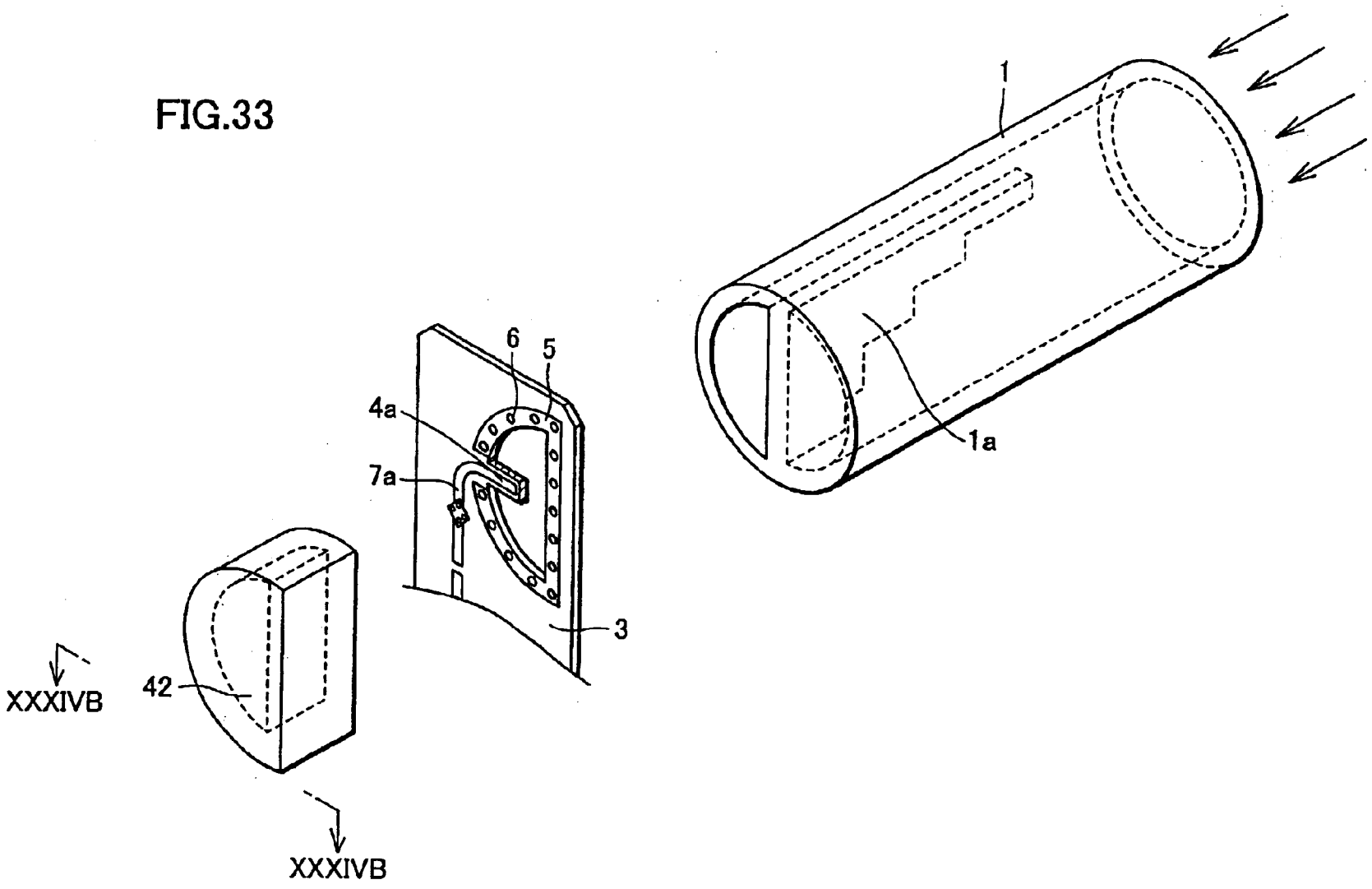
FIG. 33 is an exploded perspective view of a main portion representing the polarized wave separating structure in accordance with Embodiment 14 of the present invention.
Figure 34A:
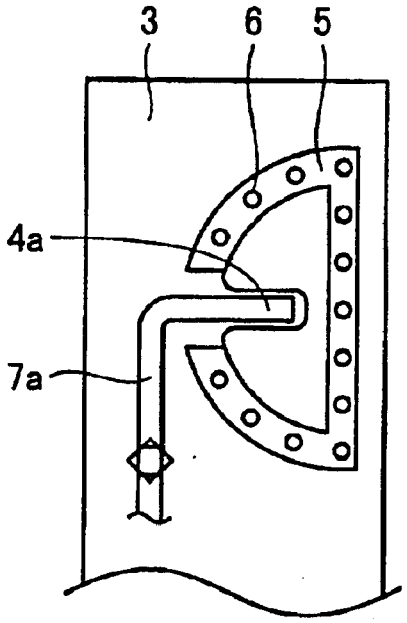
FIG. 34A is a top view of the substrate.
Figure 34B:
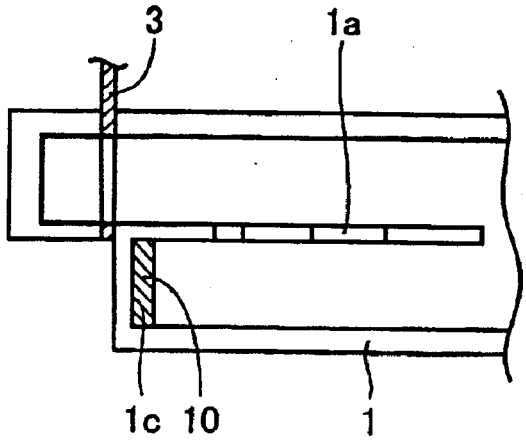
FIG. 34B is a cross section taken along the line XXXIVB—XXXIVB of FIG. 33.

FIG. 33 is an exploded perspective view of a main portion representing the polarized wave separating structure in accordance with Embodiment 14 of the present invention, FIG. 34A is a top view of the substrate, and FIG. 34B is a cross section taken along the line XXXIVB—XXXIVB of FIG. 33.

In Embodiment 14, one semicircular portion of waveguide 1 separated by septum 1*a* is closed to provide reflecting surface 1*f*, while the other semicircular portion is opened. Further, the opening of substrate 3 is adapted to correspond to the semicircular opening of waveguide 1. Further, only one radio wave receiving probe 4*a* is provided on substrate 3. As shown in FIG. 34B, at the radio wave reflecting portion, reflection free terminating portion 10 is attached to reflecting surface 1*c* of waveguide 1.

The operation is as follows. Similar to the description above, of the received polarized waves, the d-polarized wave is received by receiving probe 4*a*, as waveguide space A is formed by septum 1*a*, the semiconductor circular opening surface of substrate 3 and radio wave reflecting portion 42. The l-polarized wave is separated by septum 1*a*. The wave however, is not transmitted to substrate 3 as waveguide 1 is closed, but is reflected at reflecting surface 1*f* As the reflection free terminating portion 10 is provided on reflecting surface 1*f*, the l-polarized wave is absorbed and attenuated. Thus, only the d-polarized wave is received.

In the present embodiment, as the waveguide space B is not formed and the receiving probe 4*b* is not provided, the unnecessary l-polarized wave does no go over substrate 3, and hence higher degree of separation is expected. Further, as the l-polarized wave entering waveguide 1 is attenuated by reflection free terminating portion 10 such as the radio wave absorber, better performance is expected. Further, as the shape of substrate 3 can be made smaller, the overall device can be made smaller, which is preferable in view of cost.

Embodiment 15

Figure 35:
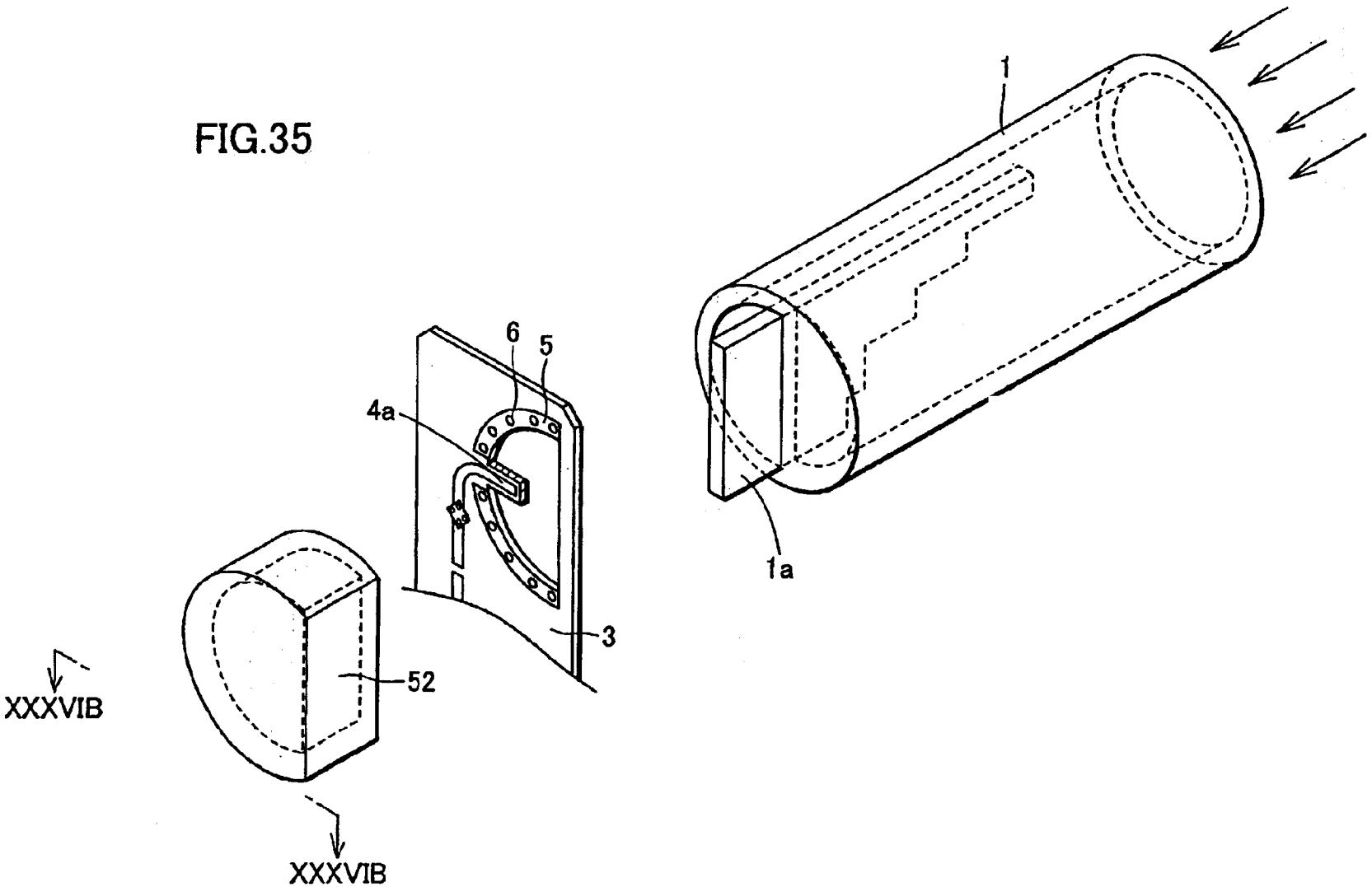
FIG. 35 is an exploded perspective view of a main portion representing the polarized wave separating structure in accordance with Embodiment 14 of the present invention.
Figure 36A:
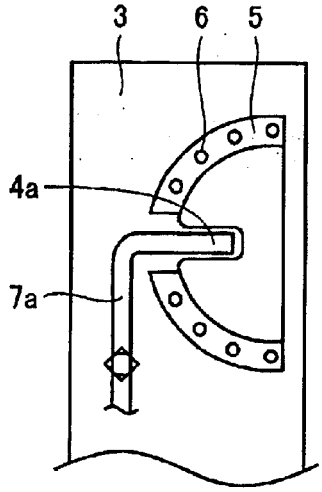
FIG. 36A is a top view of the substrate of the polarized wave separator.
Figure 36B:
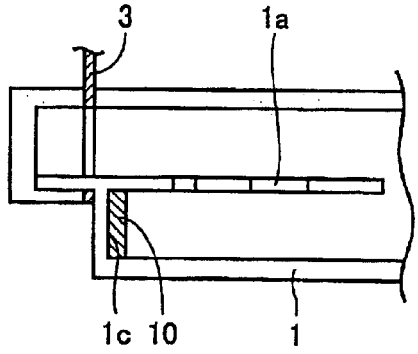
FIG. 36B is a cross section taken along the line XXXVIB—XXXVIB of FIG. 35.

FIG. 35 is an exploded perspective view of a main portion representing a polarized wave separating structure in accordance with Embodiment 15 of the present invention, FIG. 36A is a top view of the substrate, and FIG. 36B is a cross section taken along the line XXXVIB—XXXVIB of FIG. 35.

The embodiment is the same both in structure and operation as that of FIGS. 34, 34B and 35, except that the septum 1*a* of waveguide 1 is extended to the reflecting surface of radio wave reflecting portion 52. Though the shape of the opening of substrate 3 and radio wave reflecting portion 52 will be slightly larger than that in Embodiment 14 as the cross sectional shape of septum 1*a* must be covered, grounding can be attained with higher reliability, and therefore, higher degree of separation is attained.

Modifications of the reflection free terminating portions of Embodiments 13 to 15 will be described. As already described, a radio wave absorber prepared by mixing magnetic powder such as ferrite in rubber material such as silicone rubber to provide the radio wave absorbing function is used. The amount of absorption, however, is not very large, and therefore it is difficult to provide a satisfactory reflection free terminating portion 10.

Therefore, a reflection free terminating portion is formed as shown in FIGS. 37 to 40.

Figure 37A:
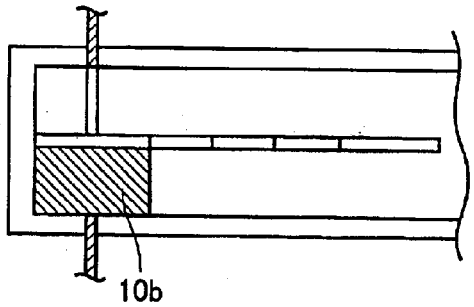
FIG. 37A is a horizontal cross section of a waveguide in another example of the polarized wave separator.
Figure 37B:
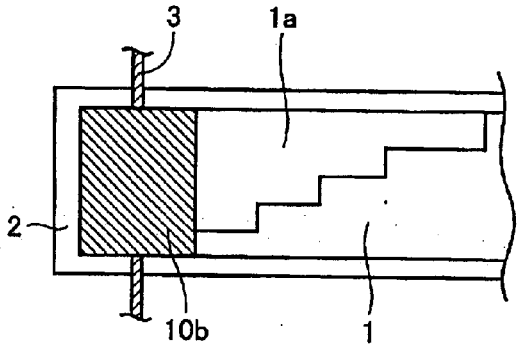
FIG. 37B is a vertical section thereof.
Figure 37C:
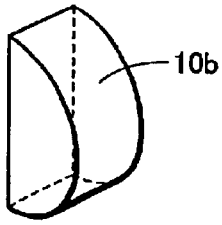
FIG. 37C represents a columner radio wave absorber.
Figure 38A:
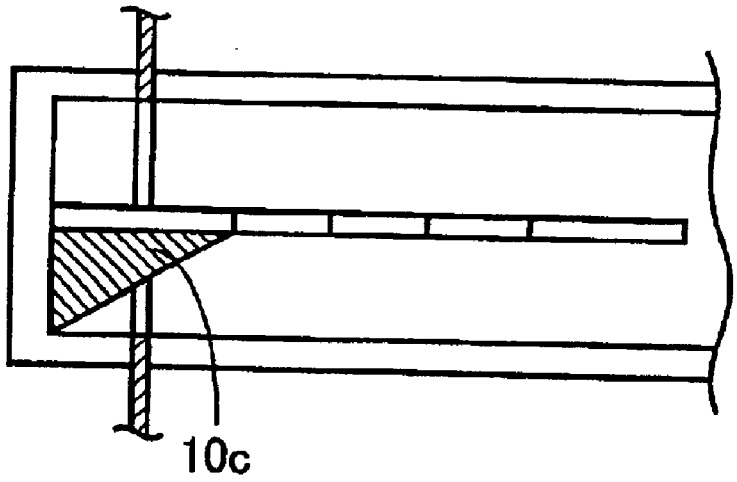
FIG. 38A is a horizontal cross section of a waveguide in a still another example of the polarized wave separator.
Figure 38B:
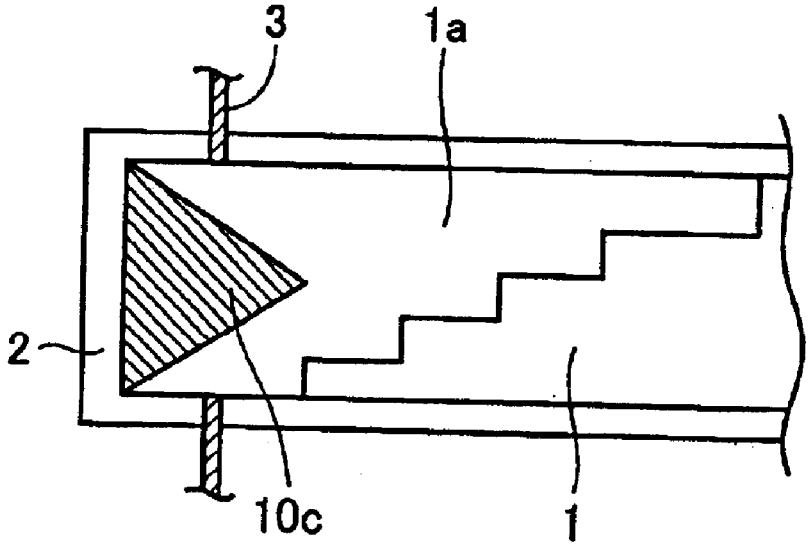
FIG. 38B is a vertical section thereof.
Figure 38C:
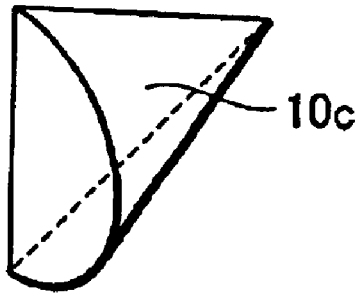
FIG. 38C represents a conical radio wave absorber.

FIGS. 37A to 40A are horizontal cross sections of the waveguide, FIGS. 37B to 40B are vertical cross sections of the same, FIG. 37C represents a columner radio wave absorber, and FIG. 38C represents a conical radio wave absorber.

As the reflection free terminating portion 10, a columner radio wave absorber 10*b* of a semi-columner shape may be formed by impregnating a polystyrol based foam, for example, with carbon and covering the waveguide space therewith as shown in FIG. 37C, to increase the amount of attenuation.

When a conical radio wave absorber 10*c* is used as shown in FIG. 38C, better matching is attained when the polarized wave enters from the space to the radio wave absorber, and hence reflection wave can be reduced.

Figure 39A:
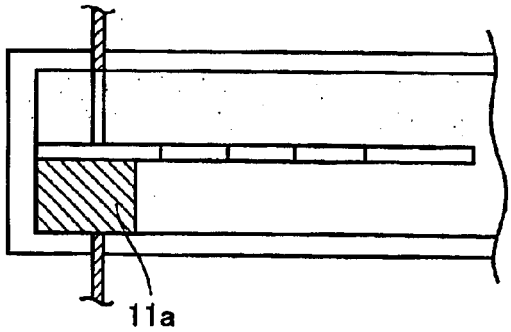
FIG. 39A is a horizontal cross section of a waveguide in a still another example of the polarized wave separator.
Figure 39B:
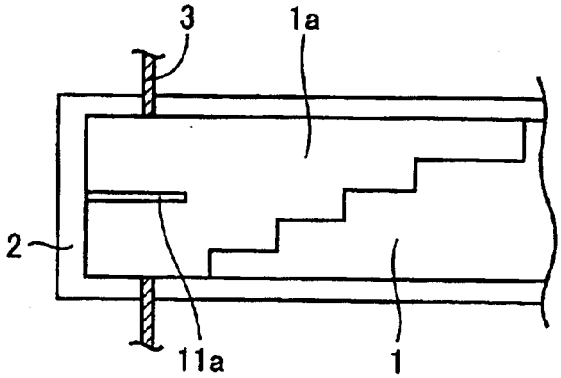
FIG. 39B is a vertical section thereof.

FIGS. 39A, 39B, 40A and 40B represent examples using resistance plates. A resistance plate 11A shown in FIGS. 39A and 39B is a resin plate prepared by applying carbon coating on a surface of a thin resin of vinyl chloride or PET so as to attain the resistance value per 10 mm×10 mm square of several tens to several hundreds Ω, which is used for absorbing radio wave that is parallel to the resistance plate 11*a*. When the resistance plate 11*a* is inserted in a direction crossing the septum 1*a* in waveguide 1, unnecessary l-polarized wave can be absorbed.

Figure 40A:
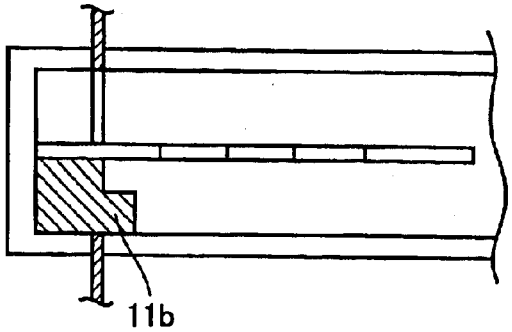
FIG. 40A is a horizontal cross section of a waveguide in a still another example of the polarized wave separator.
Figure 40B:
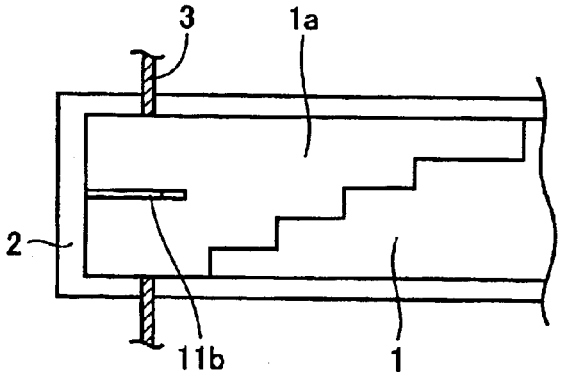
FIG. 40B is a vertical section thereof.

Further, as shown in FIGS. 40A and 40B, a cutout portion may be formed at one end of resistance plate 11*b* on the side of septum 1*a* of waveguide 1*a* at the opening side, so as to attain matching when the polarized wave enters from the space to the resistance plate 11*b* and to suppress the reflection wave generated there. Thus, more satisfactory reflection free terminating portion can be formed.

Figure 41:
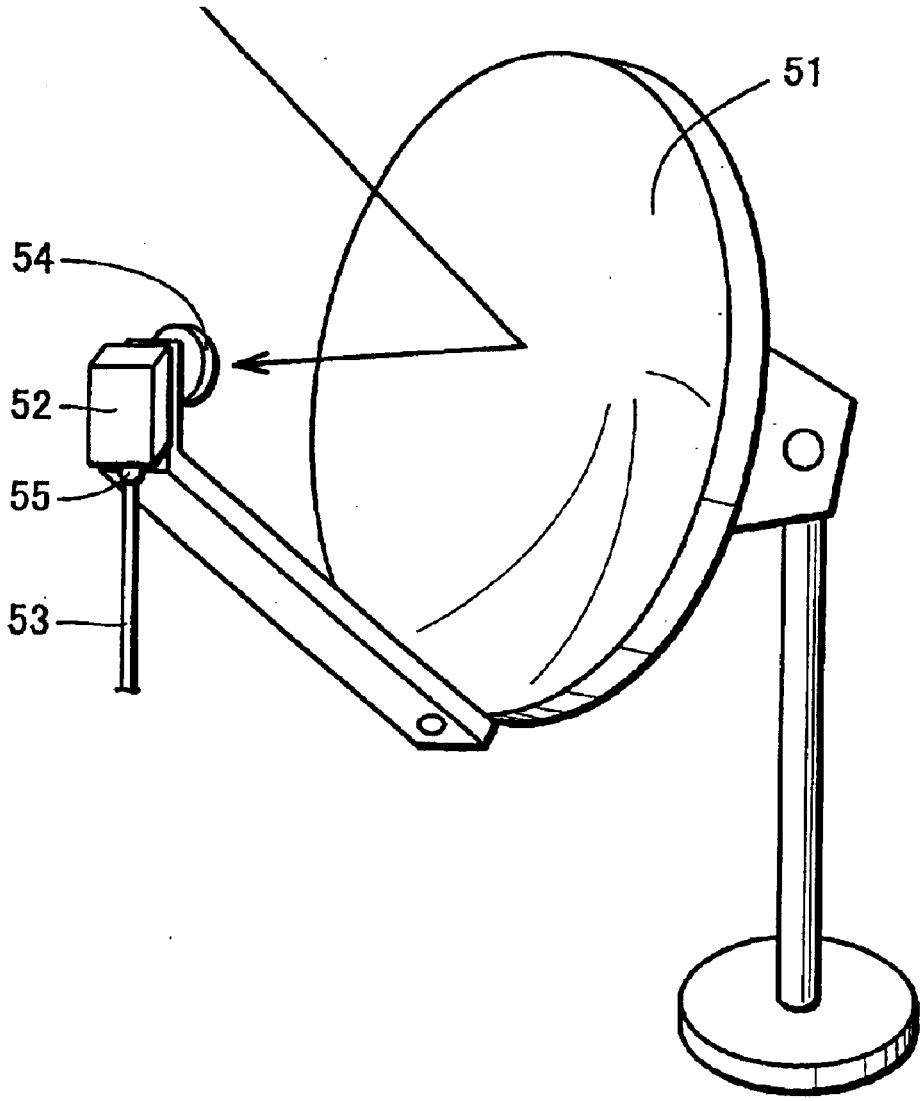
FIG. 41 is a perspective view showing an appearance of a parabola antenna provided with a satellite broadcast receiving converter mounting the polarized wave separator in accordance with the present invention.
Figure 42:
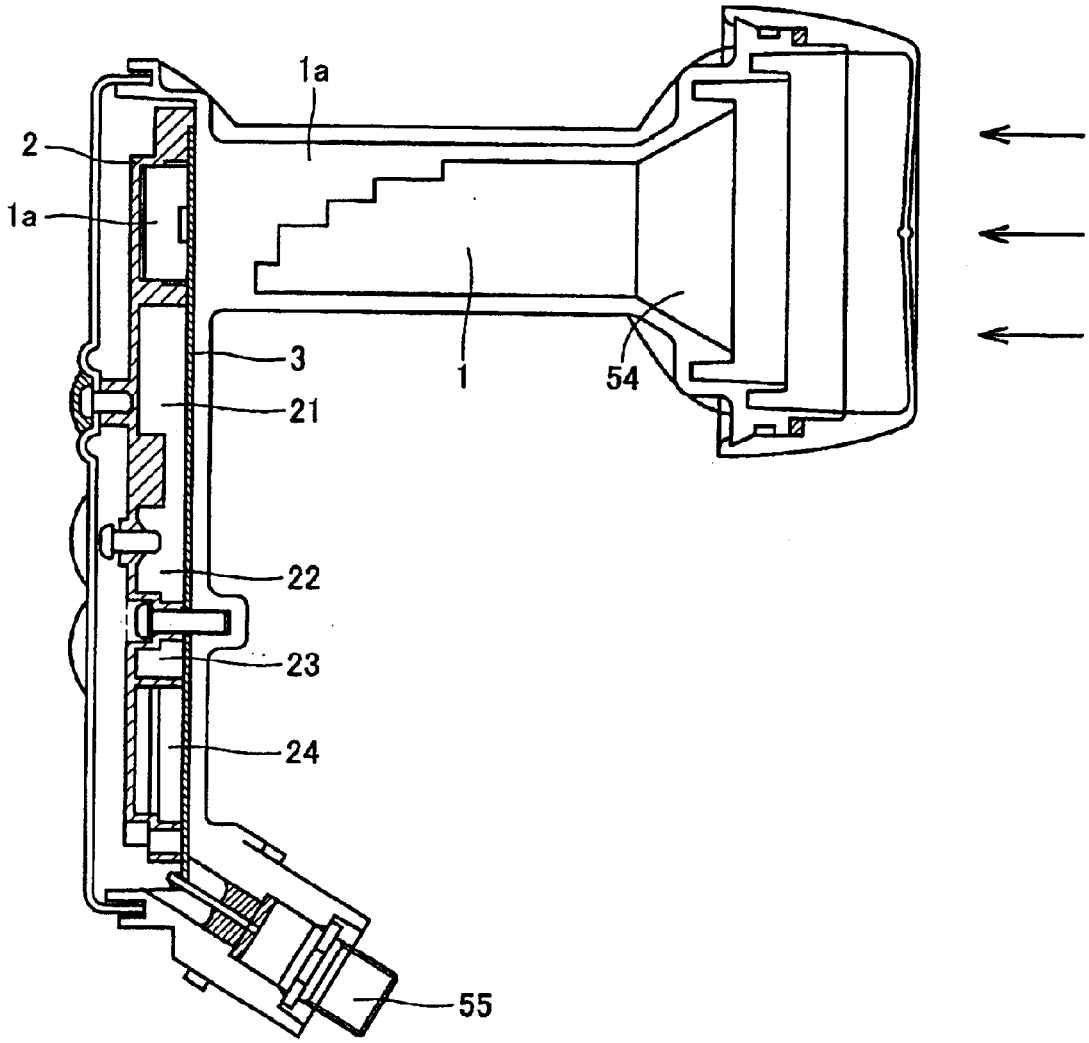
FIG. 42 is a cross section of the satellite broadcast receiving converter mounting the polarized wave separator of the present invention.
Figure 43:
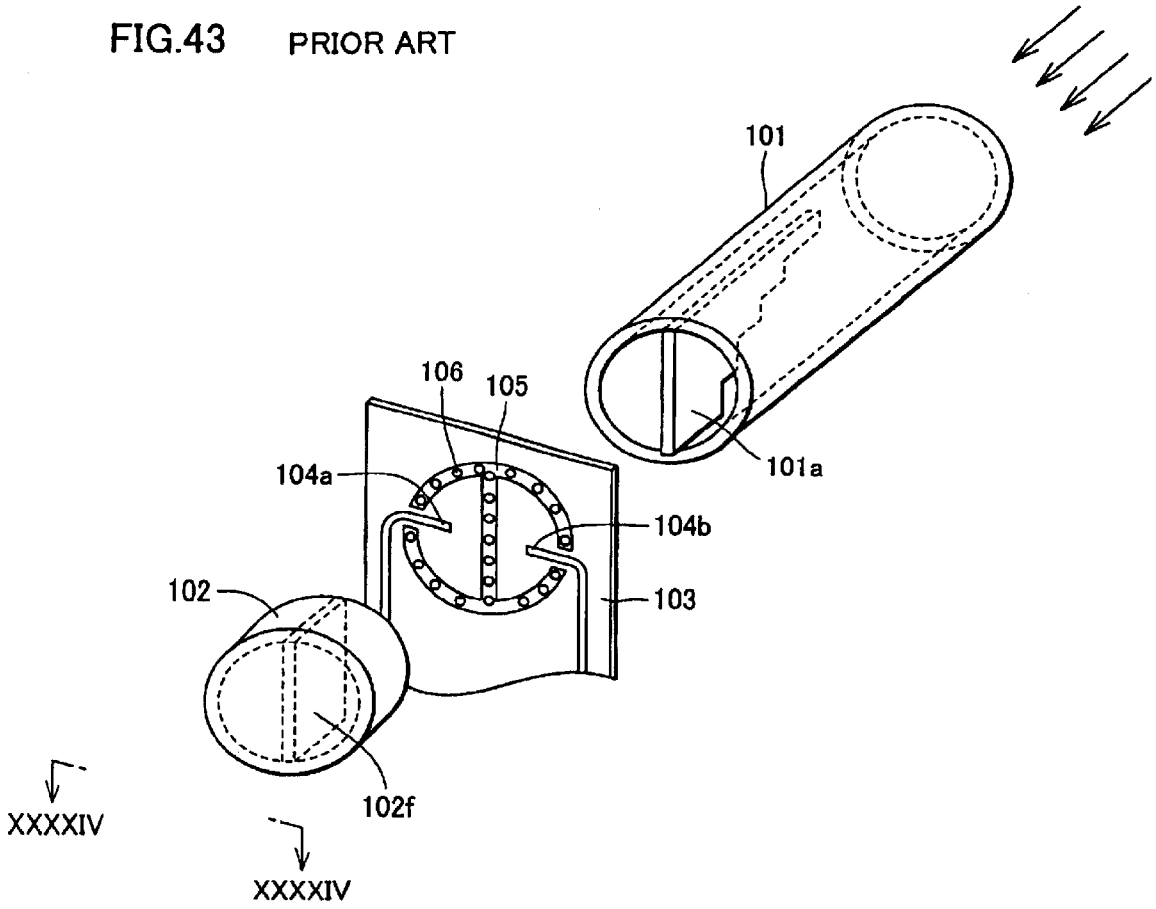
FIG.43 PRIOR ART
FIG. 43 is an exploded perspective view representing a polarized wave separating structure in accordance with the first prior art example.
Figure 44:
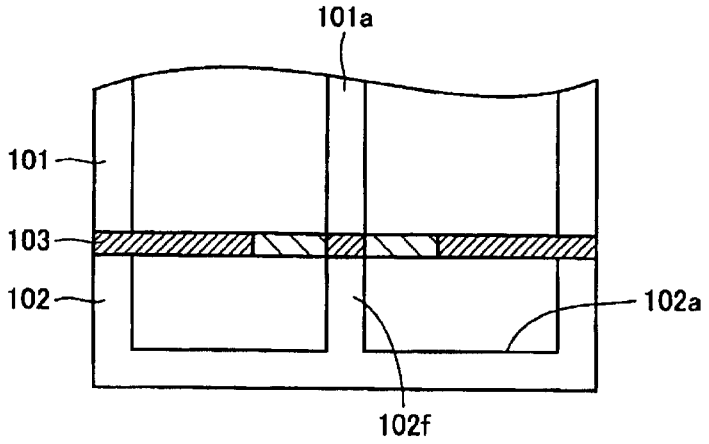
FIG.44 PRIOR ART
FIG. 44 is a partial cross section taken along the line XXXXIV—XXXXIV of FIG. 43.
Figure 45:
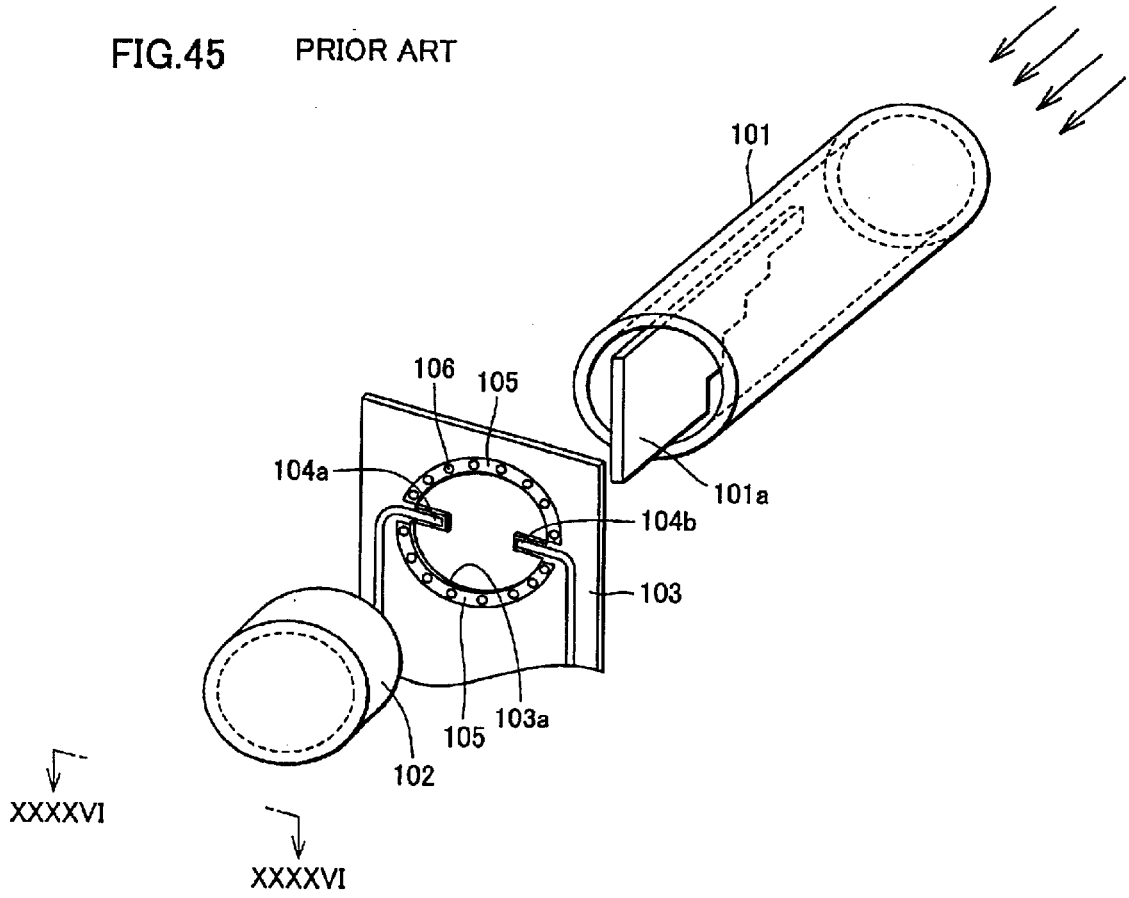
FIG.45 PRIOR ART
FIG. 45 is an exploded perspective view showing the polarized wave separating structure in accordance with the second prior art example.
Figure 46:
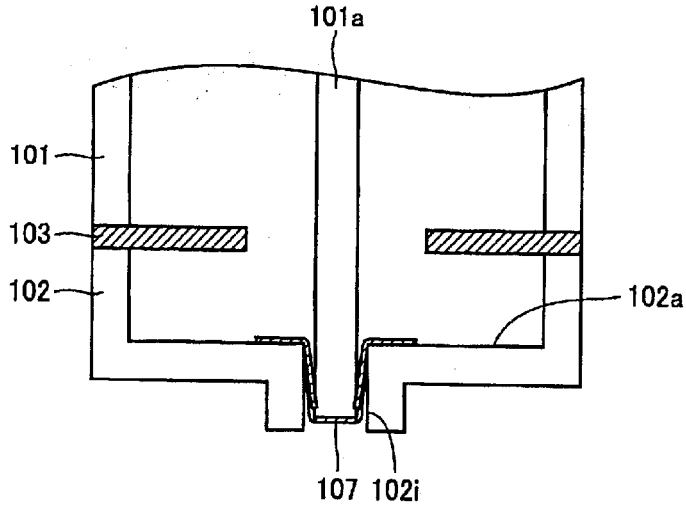
FIG.46 PRIOR ART
FIG. 46 is a partial cross section taken along the line XXXXVI—XXXXVI of FIG. 45.
Figure 47A:
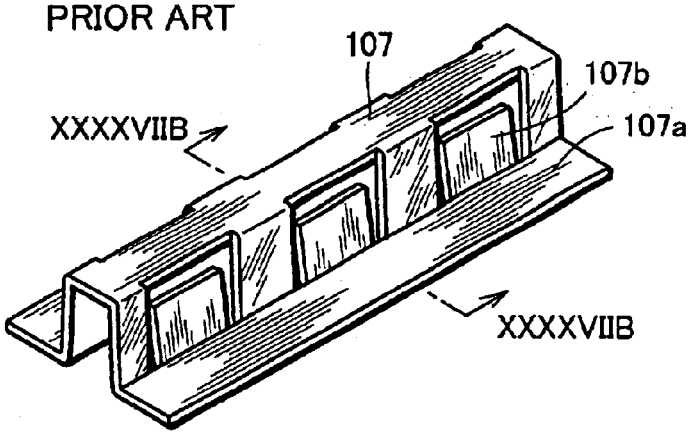
FIG.47A PRIOR ART
Figure 47B:
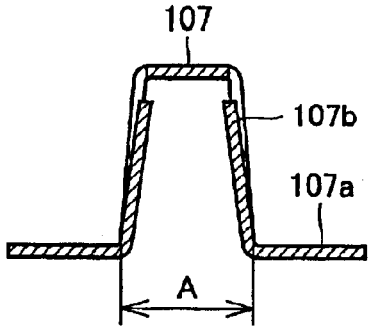
FIG.47B PRIOR ART
Figure 47C:
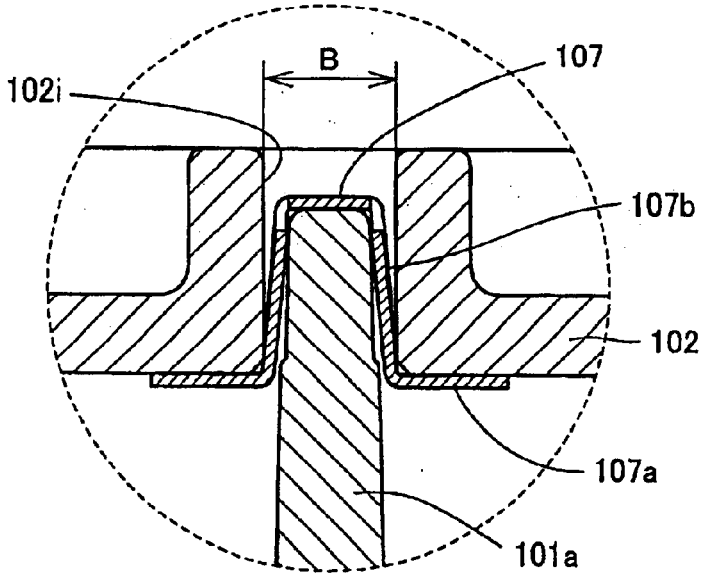
FIG.47C PRIOR ART

FIG. 41 is a perspective view showing an appearance of a parabola antenna provided with a satellite broadcast receiving converter on which the polarized wave separator of the present invention is mounted. FIG. 42 is a cross section of the satellite broadcast receiving converter mounting the polarized wave separator of the present invention.

The radio wave transmitted from a satellite is reflected by reflective parabola portion 51 shown in FIG. 41, collected and transmitted to a feed horn 54, and further transmitted to radio wave receiving converter 52. The radio wave that has been transmitted to radio wave receiving converter 52 is amplified with low noise by an internal circuitry, converted to an intermediate frequency signal, and transmitted from an output terminal 55 through a co-axial cable 56 to a BS receiver, not shown.

The structure of the satellite broadcast receiving converter mounting the polarized wave separator shown in FIG. 42 will be described. In a succeeding stage of feed horn 54, the polarized wave separator of the present invention formed by wave guide 1, substrate 3 and radio wave reflecting portion 2 is mounted. Thus, the circularly polarized wave (radio wave) collected by feed horn 54 is transmitted to waveguide 1, and by the polarized wave separator, separated into d-polarized wave and l-polarized wave. The d-polarized wave as the polarized wave to be received is subjected to low noise amplification by an LAN (low noise amplifier) 21 arranged on substrate 3, combined with a local signal that is oscillated by a local oscillator portion 22 and converted to an intermediate frequency (IF), further amplified by an IF amplifier 24, and transmitted through an output terminal to the BS receiver.

The l-polarized wave is attenuated by the reflection free terminating portion of the polarized wave separator, and therefore, it is hardly output. Namely, only the d-polarized wave as the wave to be received can be received with high purity.

As described above, according to the embodiments of the present invention, a polarized wave separating structure, a radio wave receiving converter and an antenna apparatus that can provide fully satisfactory polarized wave separating characteristic without leakage of the radio wave to the outside or increased noise, that have simple structure and improve the ratio of satisfactory products of mass production and that are low cost and superior for mass production can be obtained.

Further, when only one of the two components included in the microwave is to be received, the received polarized wave can be separated with high efficiency and the unnecessary polarized wave can sufficiently be attenuated by the reflection free terminating portion, by using the polarized wave separating structure of the present invention. Therefore, unnecessary polarized wave is not received, and satisfactory state of reception is attained.

Further, the present invention has a simple structure, is superior for mass production, and cost advantageous, as the structure can be reduced in size and inexpensive material can be used.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A polarized wave separating mechanism for separating polarized wave signals from first and second polarized wave components, comprising:

a substrate portion having an opening and provided with a pair of radio wave receiving portions;

a waveguide arranged on a side of one surface of said substrate portion, and provided with a septum portion therein; and a radio wave reflecting portion arranged on the side of the other surface of said substrate portion and provided with a radio wave reflecting surface on an inner side; wherein said septum portion is extended through said opening to said radio wave reflecting portion so as to separate respective polarized waves received by said pair of radio wave receiving portions; and a space between said septum portion and said radio wave reflecting portion is set such that an end surface of said waveguide on the side of said substrate is in contact with a grounding surface provided on one surface of said substrate portion, and an end surface of said radio wave reflecting portion on the side of said substrate portion is in contact with a grounding surface provided on the other surface of said substrate portion.

2. The polarized wave separating structure according to claim 1, wherein said space is set such that said septum portion is not in contact with said radio wave reflecting portion.

3. The polarized wave separating structure according to claim 1, wherein said septum portion is provided not in contact with an inner surface of said opening.

4. The polarized wave separating structure according to claim 1, wherein a slot to which a part of said septum portion is inserted is provided on an inner peripheral surface of said radio wave receiving portion.

5. The polarized wave separating structure according to claim 4, wherein said slot has such a shape that widens from the bottom to opening side.

6. The polarized wave separating structure according to claim 4, wherein said slot is provided on an inner surface of a cylindrical portion of said radio wave reflecting portion and the bottom portion of said slot has such a shape that widens from the side of said radio wave reflecting surface to the side of said substrate portion.

7. The polarized wave separating structure according to claim 1, wherein a slot to which a part of said septum portion is inserted is provided on the radio wave reflecting surface of said radio wave reflecting portion.

8. The polarized wave separating structure according to claim 1, wherein said radio wave reflecting portion includes a cylindrical portion, and planar portion at an end thereof, said radio wave reflecting surface is formed at a surface of said planar portion of said radio wave reflecting portion at the side of said substrate portion, and a protruded portion is provided on an inner peripheral surface of said cylindrical portion of said radio wave reflecting portion, and a slot to which said protruded portion is inserted is provided on said septum portion.

9. The polarized wave separating structure according to claim 1, wherein said radio wave reflecting portion includes a cylindrical portion, and a planar portion at an end thereof, said radio wave reflecting surface is formed at a surface of said planar portion of said radio wave reflecting portion at the side of said substrate portion, a protruded portion is provided on said radio wave reflecting surface of said radio wave reflecting portion, and a slot to which said protruded portion is inserted is provided on said septum portion.

10. The polarized wave separating structure according to claim 8, wherein said slot is provided at an end surface of said septum portion opposing to the cylindrical portion of said radio wave reflecting portion, and the bottom portion of said slot has such a shape that widens from the side of said radio wave reflecting surface to the side of said substrate portion.

11. A polarized wave separating structure for separating polarized wave signals from first and second radio wave components, respectively, comprising:

a substrate portion having an opening and provided with a pair of radio wave receiving portions;

a wave guide arranged on one side of said substrate portion; and a radio wave reflecting portion arranged on the other side of said substrate portion, provided with a radio wave reflecting surface on an inner side and a septum portion therein; wherein said septum portion is extended through said opening to said waveguide, for separating respective polarized waves received by said pair of radio wave receiving portions; and a space between said septum portion and said waveguide is set such that an end surface of said waveguide on the side of said substrate portion is in contact with a grounding surface provided on one surface of said substrate portion, and an end surface of said radio wave receiving portion on the side of said substrate portion is in contact with a grounding surface provided on the other surface of said substrate portion.

12. The polarized wave separating structure according to claim 11, wherein said space is set such that said septum portion and said waveguide are not in contact with each other.

13. The polarized wave separating structure according to claim 11, wherein said septum portion is provided not to be in contact with an inner surface of said opening.

14. The polarized wave separating structure according to claim 11, wherein a slot to which a part of said septum portion is inserted is provided on an inner peripheral surface of said waveguide.

15. The polarized wave separating structure according to claim 14, wherein said slot is formed to have such a shape that widens from the bottom to opening side.

16. The polarized wave separating structure according to claim 14, wherein the bottom portion of said slot is formed to have such a shape that widens from radio wave entrance side of said waveguide to the side of said substrate portion.

17. The polarized wave separating structure according to claim 11, wherein a protruded portion is provided on an inner peripheral surface of said waveguide, and a slot to which said protruded portion is inserted is provided on said septum portion.

18. A polarized wave separating structure, comprising;

a substrate portion having an opening and provided with a pair of radio wave receiving portions;

a waveguide arranged on one side of said substrate portion and provided with a septum portion therein; and a radio wave reflecting portion arranged on the other side of said substrate portion, and provided with a radio wave reflecting surface on an inner side and a septum portion therein; wherein said septum portions are arranged opposite to each other to separate respective polarized waves received by said pair of radio wave receiving portions; and a space between said septum portions is set such that an end surface of said waveguide on the side of said substrate portion is in contact with a grounding surface provided on one surface of said substrate portion, and an end surface of said radio wave reflecting portion on the side of said substrate portion is in contact with a grounding surface provided on the other surface of said substrate portion.

19. The polarized wave separating structure according to claim 18, wherein said space is set such that the septum portion of said waveguide is not in contact with the septum portion of said radio wave reflecting portion.

20. The polarized wave separating structure according to claim 18, wherein both the septum portion of said waveguide and the septum portion of said radio wave reflecting portion are arranged not in contact with an inner surface of said opening.

21. The polarized wave separating structure according to claim 20, wherein both the septum portion of said waveguide and the septum portion of said radio wave reflecting portion are arranged not to penetrate through said opening.

22. The polarized wave separating structure according to claim 18, wherein a protruded portion is provided on one of opposing end surfaces of the septum portions of said waveguide and said radio wave reflecting portion, and a slot to which said protruded portion is inserted is provided on the other.

23. The polarized wave separating structure according to claim 22, wherein said slot is formed to have such a shape that widens from the bottom to the opening side.

24. The polarized wave separating structure according to claim 18, wherein a reflection free terminating portion absorbing received polarized wave is provided on either one of the pair of radio wave receiving portions provided on said substrate.

25. The polarized wave separating structure according to claim 24, wherein said reflection free terminating portion is grounded through a terminating resistor.

26. The polarized wave separating structure according to claim 25, wherein said reflection free terminating portion includes a receiving probe to which said terminal resistor is connected, and a stub matching portion formed between said receiving probe and said terminating resistor.

27. A polarized wave separating structure for separating respective polarized wave signals from first and second polarized wave components, respectively, comprising:

a substrate portion having an opening and provided with one radio wave receiving portion;

a waveguide arranged on a side of one surface of said substrate portion and provided with a septum portion therein; and a radio wave reflecting portion arranged on a side of the other surface of said substrate portions and having a radio wave reflecting surface formed on an inner side; wherein said waveguide, said substrate portion, and said radio wave reflecting portion form a waveguide space;

said septum portion extends through said opening to said radio wave reflecting portion to divide said radio wave reflecting surface into two;

said waveguide space is partitioned by said septum portion into one waveguide space and another waveguide space, and said one radio wave receiving portion is positioned in said one waveguide space; and a reflection free terminating portion is formed at said another waveguide space.

28. The polarized wave separating structure according to claim 27, wherein an opening portion of said waveguide is separated into one opening portion and another opening portion by said septum portion, said one opening portion being closed by a planar member, and said another opening portion transmits the polarized wave to a succeeding stage;

said opening portion of said substrate portion has such a shape that corresponds to said another opening portion of said waveguide; and said radio wave reflecting portion is formed to have the same shape as said another opening portion of said waveguide.

29. The polarized wave separating structure according to claim 27, wherein an opening portion of said waveguide is separated into one opening portion and another opening portion by said septum portion, said one opening portion being closed by a planar member, and said another opening portion transmits the polarized wave to a succeeding stage;

the septum portion of said waveguide extends panning through said opening of the substrate portion to the radio wave reflecting portion of the succeeding stage; and the opening of said substrate portion and the opening of said radio wave reflecting portion of the succeeding stage have such shapes that correspond to the shape of said another opening portion of said waveguide and the cross sectional shape of the septum portion of said waveguide.

30. The polarized wave separating structure according to claim 28, wherein said reflection free terminating portion is formed on an inner plane of said planar member.

31. The polarized wave separating structure according to claim 27, wherein the reflection free terminating portion is a plate shaped radio wave absorber.

32. The polarized wave separating structure according to claim 27, wherein the reflection free terminating portion is a semi-columner radio wave absorber.

33. The polarized wave separating structure according to claim 27, wherein the reflection free terminating portion is a semi-conical radio wave absorber.

34. The polarized wave separating structure according to claim 27, wherein the radio wave absorber at said reflection free terminating portion is a resistance plate.

35. The polarized wave separating structure according to claim 34, wherein said resistance plate has one end on the side of the waveguide on the side of said opening provided with a cutout.

36. A radio wave receiving converter having a polarized wave separating structure for separating respective polarized wave signals from first and second polarized wave components, wherein said polarized wave separating structure includes a substrate portion having an opening and provided with a pair of radio wave receiving portions;

a waveguide arranged on a side of one surface of said substrate portion, and provided with a septum portion therein; and a radio wave reflecting portion arranged on the side of the other surface of said substrate portion and provided with a radio wave reflecting surface on an inner side; wherein said septum portion is extended through said opening to said radio wave reflecting portion so as to separate respective polarized waves received by said pair of radio wave receiving portions; and a space between said septum portion and said radio wave reflecting portion is set such that an end surface of said wave guide on the side of said substrate is in constant with a grounding surface provided on one surface of said substrate portion, and an end surface of said radio wave reflecting portion on the side of said substrate portion is in contact with a grounding surface provided on the other surface of said substrate portion.

37. An antenna apparatus comprising the structure according to claim 36, further comprising a reflecting parabola portion reflecting and guiding the received radio wave to said radio wave receiving converter.

* * * * *